US007170471B2

(12) United States Patent
Hashimoto et al.

(10) Patent No.: US 7,170,471 B2
(45) Date of Patent: Jan. 30, 2007

(54) PLASMA DISPLAY APPARATUS AND METHOD OF DRIVING A PLASMA DISPLAY PANEL

(75) Inventors: Yasunobu Hashimoto, Akashi (JP); Hajime Inoue, Akashi (JP); Yoshiho Seo, Akashi (JP); Naoki Itokawa, Akashi (JP)

(73) Assignee: Hitachi, Ltd., Tokyo (JP)

( * ) Notice: Subject to any disclaimer, the term of this patent is extended or adjusted under 35 U.S.C. 154(b) by 579 days.

(21) Appl. No.: 10/642,180

(22) Filed: Aug. 18, 2003

(65) Prior Publication Data

US 2004/0051470 A1 Mar. 18, 2004

(30) Foreign Application Priority Data

Aug. 30, 2002 (JP) ..... 2002-253654

(51) Int. Cl.
*G09G 3/28* (2006.01)

(52) U.S. Cl. ..... 345/60; 345/61; 345/63; 345/65; 345/67

(58) Field of Classification Search ..... 345/60–69, 345/428, 690, 539, 181; 315/169.1–169.4, 315/0.3; 313/582, 584, 485, 51
See application file for complete search history.

(56) References Cited

U.S. PATENT DOCUMENTS 4,700,181 A * 10/1987 Maine et al. ..... 345/539
4,992,955 A * 2/1991 Yabuuchi et al. ..... 345/428
6,580,227 B2 * 6/2003 Kobayashi ..... 315/169.4
6,603,263 B1 * 8/2003 Hashimoto et al. ..... 313/584
6,819,046 B2 * 11/2004 Hirano ..... 313/582
6,882,327 B2 * 4/2005 Mizobata ..... 345/60
6,956,546 B1 * 10/2005 Hashimoto et al. ..... 345/60
7,012,581 B2 * 3/2006 Ueda et al. ..... 345/62
7,068,243 B2 * 6/2006 Morimoto ..... 345/60
2001/0005189 A1 * 6/2001 Nunomura ..... 345/60
2002/0070908 A1 * 6/2002 Mizobata ..... 345/60
2003/0080926 A1 * 5/2003 Morimoto ..... 345/60
2003/0214224 A1 * 11/2003 Awamoto et al. ..... 313/485
2003/0214244 A1 * 11/2003 Onozawa et al. ..... 315/169.3
2005/0007312 A1 * 1/2005 Tanaka et al. ..... 345/60
2005/0088369 A1 * 4/2005 Yoshioka ..... 345/60
2005/0128222 A1 * 6/2005 Huang ..... 345/690
2006/0061279 A1 * 3/2006 Kim ..... 313/582

* cited by examiner

*Primary Examiner*—Bipin Shalwala
*Assistant Examiner*—Prabodh Dharia
(74) *Attorney, Agent, or Firm*—Staas & Halsey LLP

(57) ABSTRACT

An interlace-type PDP is driven by an improved driving method so as to achieve a greater operating margin, higher resolution, and higher brightness. The interlace-type PDP is driven using odd and even frames in such a manner that the cells are grouped into cell groups such that each cell group includes two or three cells which are adjacent in a direction crossing the electrode pairs, and the cells are driven in units of cell groups. The grouping of cells is performed differently for even and odd frames such that, in one type of frame, locations of two or three cells grouped into each group are shifted by one cell, in the direction crossing the electrode pairs, from the locations of cells grouped together in the other type of frame.

19 Claims, 64 Drawing Sheets

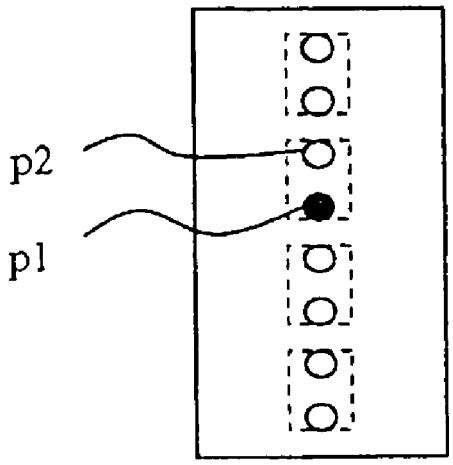
FIG. 19A1
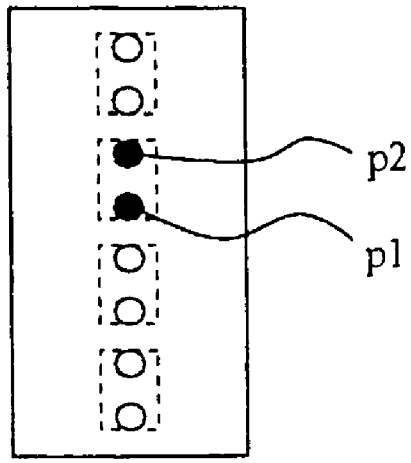
FIG. 19A2
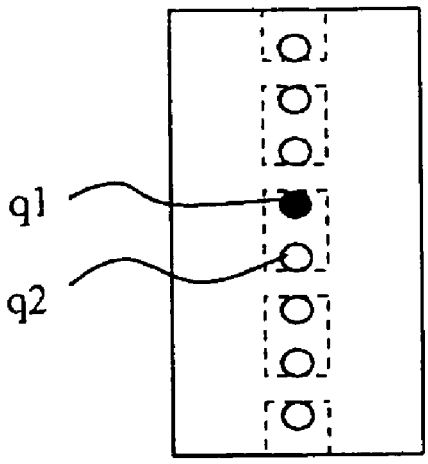
FIG. 19B1
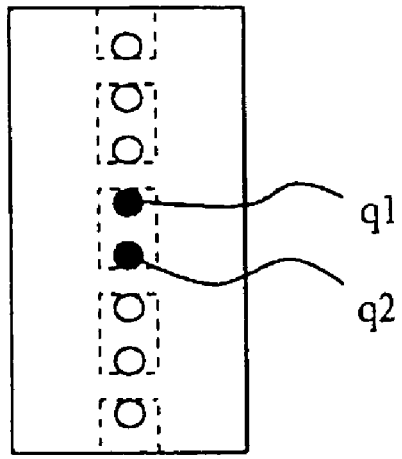
FIG. 19B2

FIG. 48A
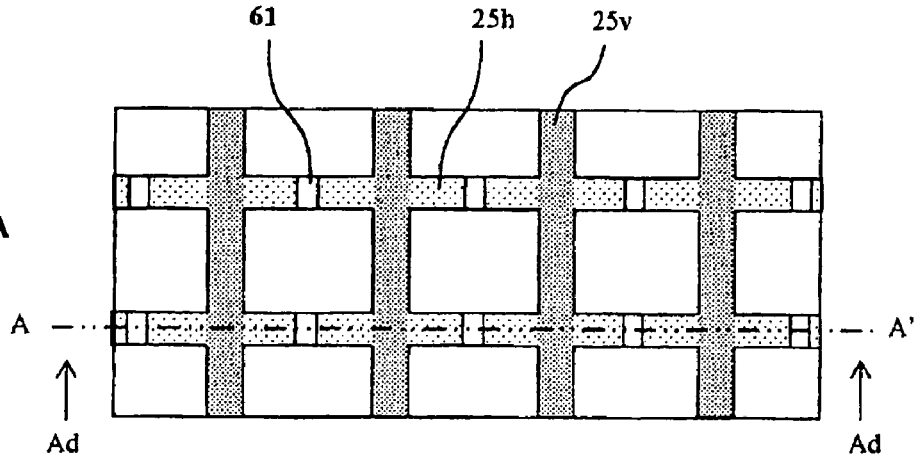
FIG. 48B1
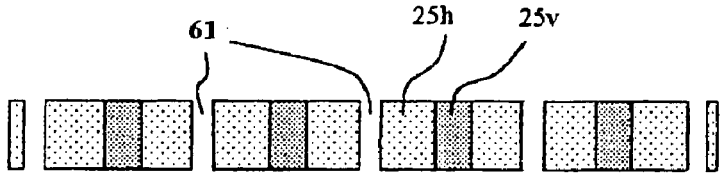
FIG. 48B2
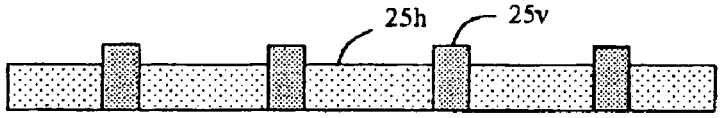
FIG. 48B3
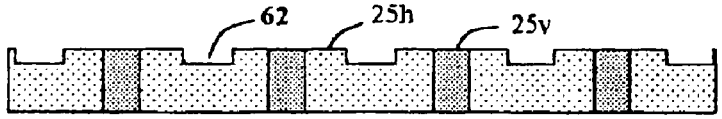

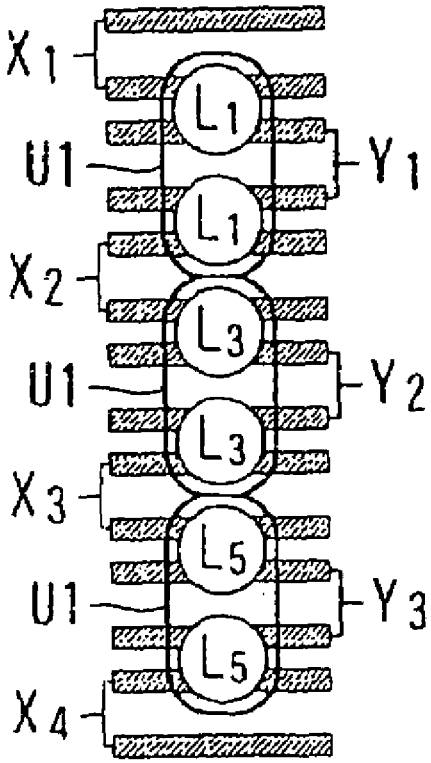
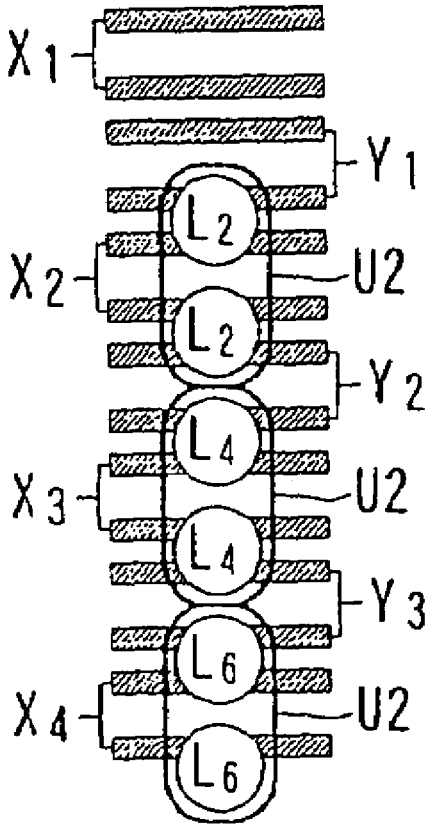
FIG. 54A
FIG. 54B

First half address cell
First half transfer cell
Yodd
Xeven
Yeven
First half addressing
991
991
992
917
A Wall charge at the end of addressing Transfer preparation Wall discharge at the end of transfer preparation Transfer Wall discharge at the end of transfer

PLASMA DISPLAY APPARATUS AND METHOD OF DRIVING A PLASMA DISPLAY PANEL

BACKGROUND OF THE INVENTION

1. Field of the Invention

The present invention relates to a method of driving a plasma display panel and a plasma display apparatus, and more particularly, to improvements in an interlace-type plasma display panel and a technique of driving of a plasma display panel in an interlaced fashion.

2. Description of the Related Art

A technique of driving, in an interlaced fashion, a plasma display panel (hereinafter referred to as a PDP) is disclosed, for example, in Japanese Unexamined Patent Application Publication No. 9-160525. In this technique disclosed in the patent cited above, X electrodes (display electrodes) and Y electrodes (scanning electrodes) are formed on a PDP such that an equal gap is formed between any two adjacent electrodes and such that an electric discharge can occur in any discharge gap. Using the PDP constructed in such a manner, an image is displayed in an interlaced fashion by generating discharges alternately in odd electrode gaps (discharge gaps) and even electrode gaps (discharge gaps). This technique allows achievement of greater resolution and higher brightness in a displayed image than can be achieved in other conventional PDPs.

FIGS. 1 and 2 show the structure of the interlace-type PDP panel based on the technique cited above. In FIGS. 1 and 2, $X_1$, $X_2$, and $X_3$ denote display electrodes 11, $Y_1$, $Y_2$, and $Y_3$ denote scanning electrodes 12, and $A_1$ to $A_6$ denote address electrodes 21. Each display electrode 11 is formed of a transparent electrode 11*i* and a bus electrode 11*b*, and each scanning electrode 12 is formed of a transparent electrode 12*i* and a bus electrode 12*b*. $L_1$ to $L_5$ denote discharge gaps, each of which forms a display line. Furthermore, barrier ribs 25 are formed so as to partition a surface discharge between each display electrode 11 and a corresponding adjacent scanning electrode 12 into a plurality surface discharges (that is, into a plurality of cells), and fluorescent layers 26R, 26G, or 26B for emitting red, green, or blue light are formed between two adjacent barrier ribs 25.

FIGS. 3A and 3B shows waveforms of driving signals used to drive the above-described PDP in a display period.

During the display period in which a display discharge is generated, as shown in FIGS. 3A and 3B, the phase of the driving pulses applied to the electrodes becomes opposite between the odd X electrodes $X_{odd}$ and the odd Y electrodes $Y_{odd}$ and also between the even X electrodes $X_{even}$ and the even Y electrodes $Y_{even}$ in odd fields (also called odd frames). Therefore, discharges occur in the odd display lines $L_{odd}$ ($L_1$, $L_3$, and $L_5$, in FIG. 1), and thus odd display lines serve as display lines in the odd fields. On the other hand, in even fields (also called even frames), the phase of the driving pulses becomes opposite between $X_{odd}$ and $Y_{even}$ and also between $X_{even}$ and $Y_{odd}$. Thus, discharges occur in even display lines $L_{even}$ ($L_3$ and $L_4$ in FIG. 1), and even display lines serve as display lines in the even fields.

By changing the driving waveforms in the above-described manner between the odd field (odd frames) and the even fields (even frames), all electrode gaps equally formed between the display electrodes 11 and the scanning electrodes 12 on the PDP can be used as display lines. This makes it possible for the PDP to display an image with high resolution and high brightness.

In the conventional interlace-type PDP (FIGS. 1 and 2), as described above, all electrode gaps are formed so as to have an equal gap distance, and all electrode gaps can be used as display lines (discharge gaps). If one of electrode gaps is used as a discharge gap (in which a display discharge occurs) in either an odd field (odd frame) or an even field (even frame), this electrode gap must be a non-discharge gap (in which no display discharge occurs) in the other field (frame).

The gap distance of each electrode gap is set to a rather small value so that the electrode gaps can function well when they are used as discharge gaps in the odd field (odd frame) or even field (even frame). However, when electrode gaps are used as non-discharge gaps in the other type of field (frame), that is, when they are used as gaps for isolating cells, the gap distance determined in the above-described manner is not large enough for use as the non-discharge gaps.

In the above-described technique disclosed in Japanese Unexamined Patent Application Publication No. 9-160525, to solve the above problem, voltages are applied to the electrodes so that the phase of voltage becomes equal between the adjacent electrodes between which there is a non-discharge gap, thereby reducing the voltage across the non-discharge gap to a small level (or a voltage equal to 0). However, in this conventional technique of driving the interlace-type PDP, there is a limitation on a further improvement in the operation margin.

Thus, there is a need to improve the structure of the PDP, the method of driving the PDP, and the waveform used in the driving of the PDP so as to have a greater operating margin.

SUMMARY OF THE INVENTION

Thus, it is an object of the present invention to provide an interlace-type PDP having a structure which allows an increase in the operating margin. It is another object of the present invention to provide a method of driving such a PDP with an increased operating margin. It is a still another object of the present invention to provide a method of driving such a PDP to display an image with improved resolution and/or increased brightness.

To achieve the above objects, an improved structure for an interlace-type PDP is first disclosed. In the interlace-type PDP according to the present invention, unlike the (above-described) conventional interlace-type PDP in which discharge gaps are successively formed, a non-discharge gap is formed between any two adjacent discharge gaps. That is, in this structure according to the present invention, two adjacent cells are isolated from each other by a non-discharge gap formed between them. The gap distance of the discharge gaps is set to a small value optimized for generating discharges, while the gap distance of the non-discharge gap is set to a large value optimized for isolation of discharges (that is, to prevent undesirable discharges).

By employing the above-described structure for the interlace-type PDP, an improved operating margin can be obtained. However, the provision of the non-discharge gaps each of which is additionally formed between discharge gaps, results in a reduction in brightness or resolution of an image displayed by the PDP. To avoid the above problem, the method of driving the PDP and driving waveforms used to drive the PDP are improved. That is, cells are grouped such that each group includes two or three cells adjacent to one another in a direction crossing the discharge gaps, and cells are turned on or off in units of groups. By simultaneously lighting two cells, brightness and resolution can be improved.

A structure for an interlace-type PDP having no non-discharge gaps (that is, having only discharge gaps successively disposed) may be modified such that at least one of the electrode structure and the barrier rib structure is improved so as to reduce the coupling between adjacent cells to a desirable low level at which adjacent cells are properly coupled to each other.

If the above-described improved structure in which there is no non-discharge gap is employed for the interlace-type PDP, the coupling between adjacent cells can be reduced to an optimal low level, and the operating margin can be increased. However, the above-described structure results in a reduction in the brightness of images displayed by the PDP. The above problem can also be overcome by improving the driving method and/or the driving waveform. That is, cells are grouped such that each group includes two or three cells adjacent to one another in a direction crossing the discharge gaps, and cells are turned on or off in units of groups. By simultaneously lighting two cells, brightness can be improved.

The details of the improved structure of the PDP (PDP apparatus) and the driving method therefor are described below.

According to a first aspect of the present invention, there is provided a method of driving a plasma display panel including a plurality of electrodes formed on a base plate so as to extend in one direction; discharge gaps for generating discharges, each discharge gap being formed between two adjacent electrodes; and non-discharge gaps in which no discharge occurs, each non-discharge gap being formed between adjacent electrodes, discharge gaps and non-discharge gaps formed alternately, two electrodes of each electrode pair between which one of the non-discharge gaps is formed being electrically connected to each other, each of the discharge gaps being partitioned into a plurality of discharge cells, the method of driving the plasma display panel comprising the step of displaying an image by using two types of frames including an odd frame and an even frame, the method further comprising the steps of: grouping cells such that two or three cells which are adjacent to one another in a direction crossing the electrode pairs are grouped together; and controlling lighting states of cells in units of cell groups, wherein the grouping of cells is performed differently for even and odd frames such that, in one type of frame, locations of two or three cells grouped into each group are shifted by one cell, in the direction crossing the electrode pairs, from the locations of cells grouped together in the other type of frame.

In this method of driving a PDP, each frame may be divided into a plurality of sub-frames, and the controlling of light states of cells may be performed as follows. In a case in which grouping of cells is performed such that each cell group includes two cells, the two cells of each cell group are both turned on at least in part of a display period in one sub-frame. On the other hands in a case in which grouping of cells is performed such that each cell group includes three cells, two adjacent cells of three cells in each group are both turned on at least in part of the display period in one sub-frame.

According to a another aspect of the present invention, there is provided a plasma display apparatus including a plasma display panel and a driver circuit, wherein the plasma display panel includes line-shaped discharge gaps including a plurality of discharge cells and line-shaped non-discharge gaps including no discharge cell, barrier ribs for portioning cells, electrode pairs formed such that one of non-discharge gaps is formed between each electrode pair and such that electrodes of each electrode pair are electrically connected to each other, the electrode pairs including scanning electrode pairs and display electrode pairs, the scanning electrode pairs and the display electrode pairs being disposed alternately, and wherein the driver circuit drives the plasma display panel by using two types of frames including an even frame and an odd frame in such a manner that cells are grouped such that two or three cells adjacent to one another in a direction crossing the electrode pairs are grouped together, and lighting states of cells are controlled in units of cell groups, wherein the grouping of cells is performed differently for even and odd frames such that, in one type of frame, locations of two or three cells grouped into each group are shifted by one cell, in the direction crossing the electrode pairs, from the locations of cells grouped together in the other type of frame.

As described above, it is possible to achieve an interlace-type plasma display apparatus having a large operating margin and capable of displaying an image with high resolution and high brightness, by employing one of PDP structure in conjunction with one of driving method or a combination thereof disclosed herein.

BRIEF DESCRIPTION OF THE DRAWINGS

FIGS. 19A1, 19A2, 19B1, and 19B2 are diagrams showing a manner in which cells are lit in a display period according to a second embodiment;

FIGS. 48A, 48B1 to 48B3 are diagrams showing a sixth PDP structure (rib structure) according to the fifth embodiment;

FIGS. 54A and 54B are diagrams showing groups for cells;

DESCRIPTION OF THE PREFERRED EMBODIMENTS

First Embodiment

Referring to FIGS. 4 to 14, a structure of a PDP and a method of driving it, according to a first embodiment of the present invention, are described below.

Figure 4:
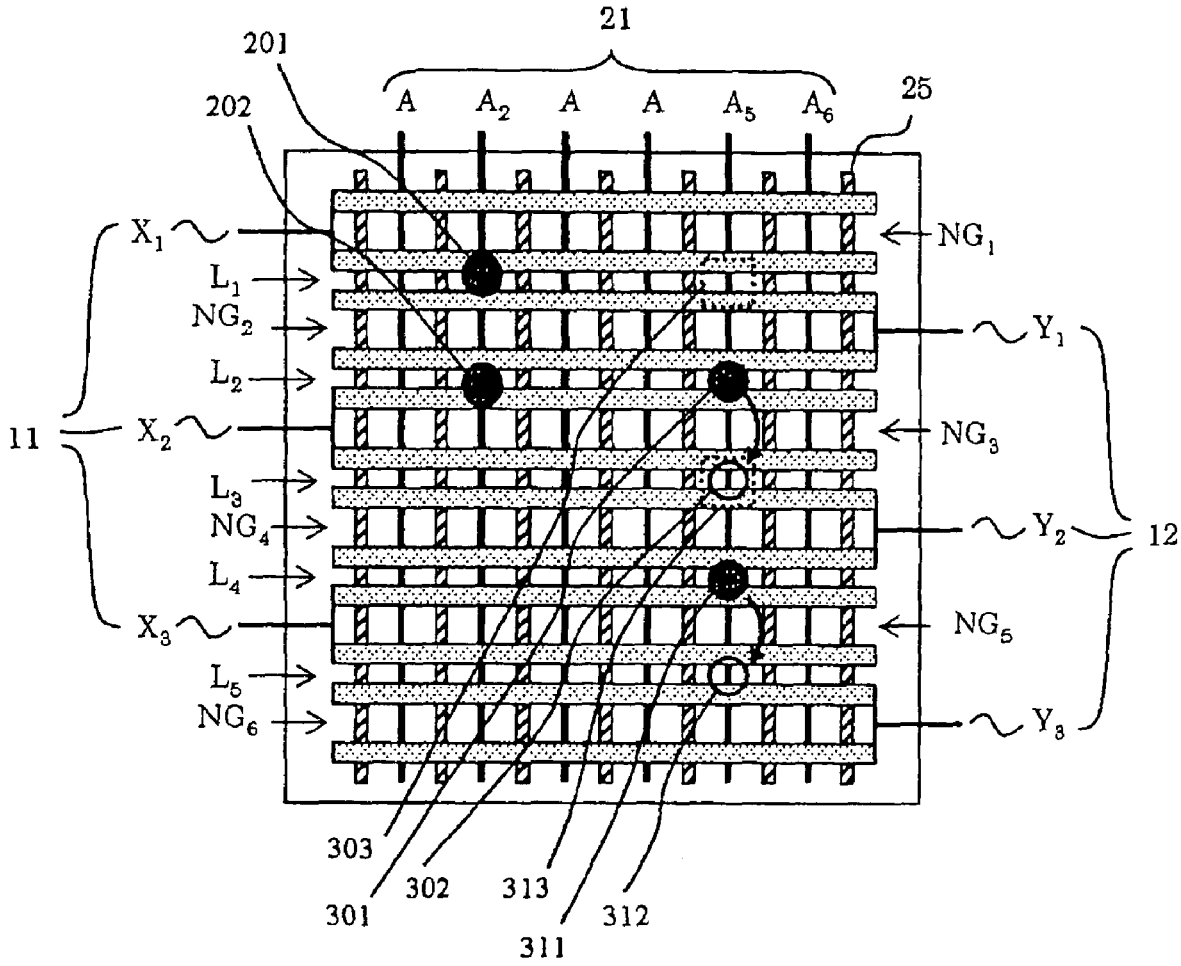
FIG. 4 is a plan view showing a PDP structure according to a first embodiment.
Figure 5:
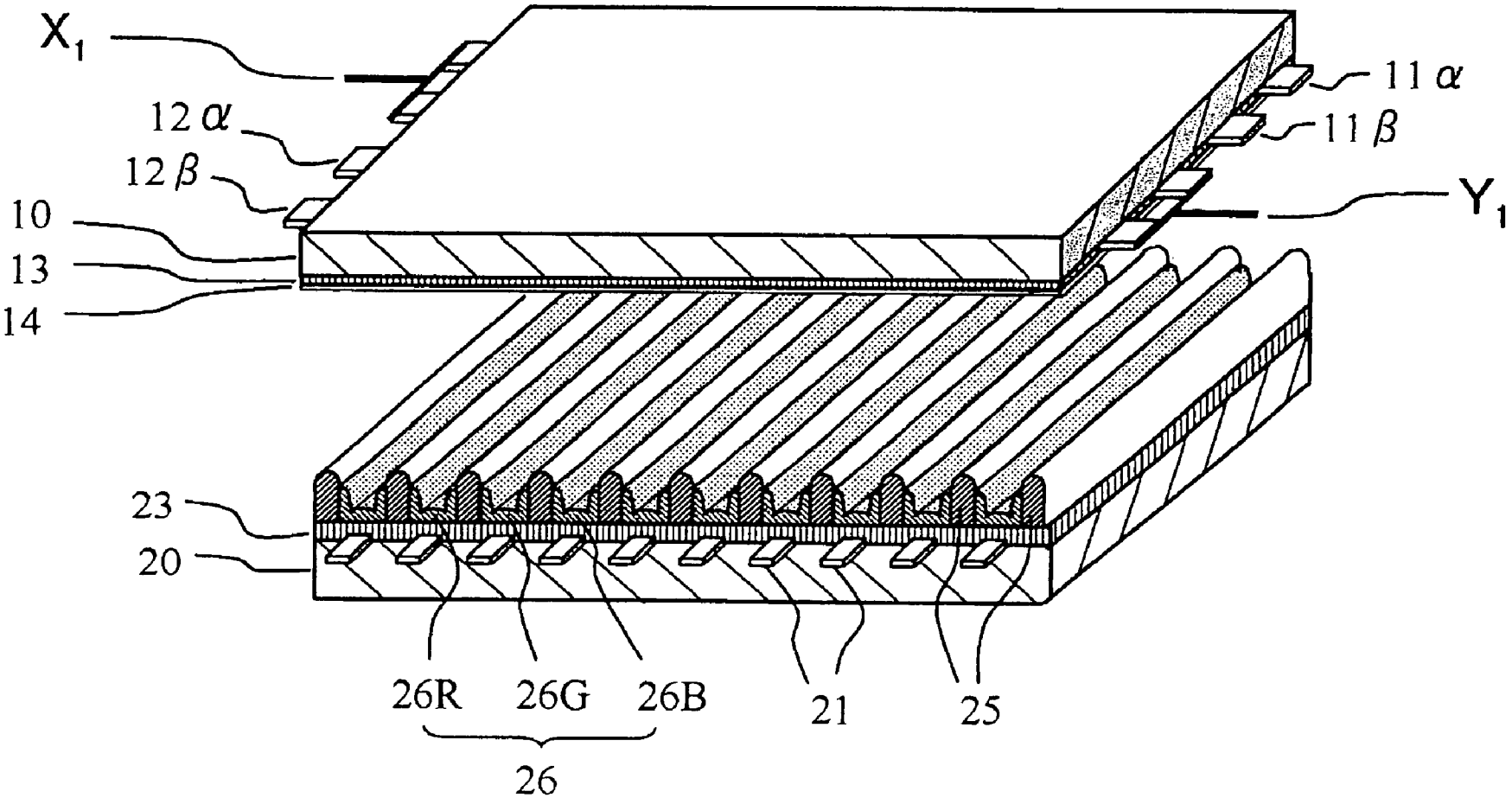
FIG. 5 is an exploded perspective view showing a PDP structure usable in the first to fourth embodiments.

FIG. 4 is a plan view showing the structure of the PDP according to the first embodiment, and FIG. 5 is an exploded perspective view thereof.

In FIGS. 4 to 40, $X_1$ to $X_3$ denote display electrode pairs 11, $Y_1$ to $Y_3$ denote scanning electrode pairs 12, and A1 to A6 and 21 (FIG. 5) denote address electrodes. Although rather small numbers of electrode pairs are shown in those figures for the purpose of convenience representation, a practical PDP includes great numbers of electrode pairs. Each of the display electrode pairs 11 and also each of the scanning electrode pairs 12 include two electrodes. In the example shown in FIG. 5, two electrodes 11α and 11β form an electrode pair $X_1$, and two electrodes 12α and 12β form an electrode pair $Y_1$. Each electrode of any electrode pair is formed of a transparent electrode and a bus electrode, as with the electrodes based on the conventional technique show in FIG. 1 or 2, although not shown in FIGS. 4 and 5. The electrode structure formed of a combination of a transparent electrode and a bus electrode will be described in detail later with reference to a fourth embodiment.

Figure 2:
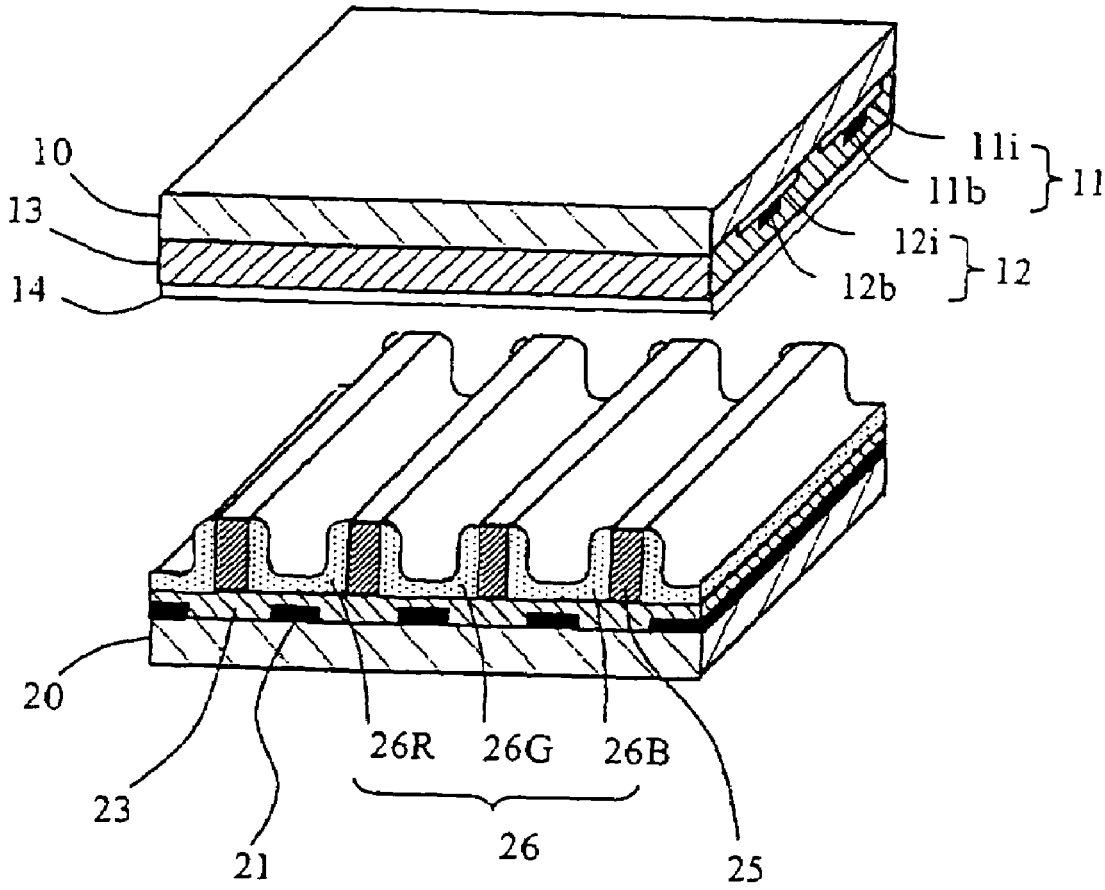
PRIOR ART FIG. 2
FIG. 2 is an exploded perspective view showing the structure of the conventional interlace-type PDP.

Furthermore, as with the conventional PDP shown in FIG. 2, in order to partition stripe-shaped surface discharges which occur between the display electrode pairs 11 and the scanning electrode pairs 12 into a plurality of dot-shaped surface discharges (that is, into a plurality of discharge cells (also referred to simply as cells), a plurality of barrier ribs 25 are formed in a direction crossing the electrode pairs (in a direction parallel to the address electrodes), and each space between adjacent barrier ribs 25 is filled with fluorescent layers 26R, 26G, or 26B for emitting red, green, or blue light.

In FIG. 4, reference symbols $L_1$ to $L_5$ denote discharge gaps (electrode gaps for generating discharges therebetween) which function as display lines, and $NG_1$ to $NG_5$ denote non-discharge gaps (that is, electrode gaps in which no discharge occurs.)

In order to suppress interference between adjacent cells thereby achieving a greater operating margin, the gap distance of the non-discharge gaps is set to be greater than the gap distance of the discharge gaps. Two adjacent electrodes between which a non-discharge gap is formed are electrically connected to each other, basically in an area outside the display area so that an identical voltage is applied to the two electrodes. This structure is equivalent to that obtained by dividing each electrode in the conventional PDP shown in FIGS. 1 and 2 into two electrodes. Although two electrodes of each electrode pair are electrically connected in an area outside the display area, there is no electrical connection in the display area. Strictly speaking, there is no electrical connection at least in areas (cell areas) in which discharges occur. This is important to achieve good isolation between discharges in cells which are adjacent in a direction crossing the electrodes.

Figure 3A:
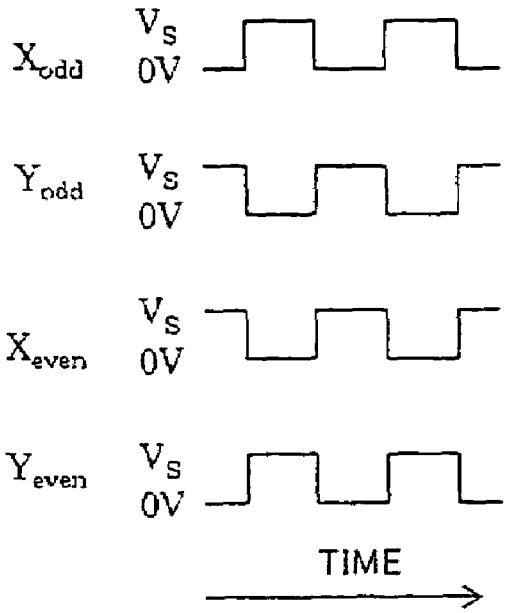
PRIOR ART FIG. 3A
FIGS. 3A and 3B are diagrams showing the waveforms of driving pulses used to drive an interlace-type PDP according to a conventional technique.
Figure 3B:
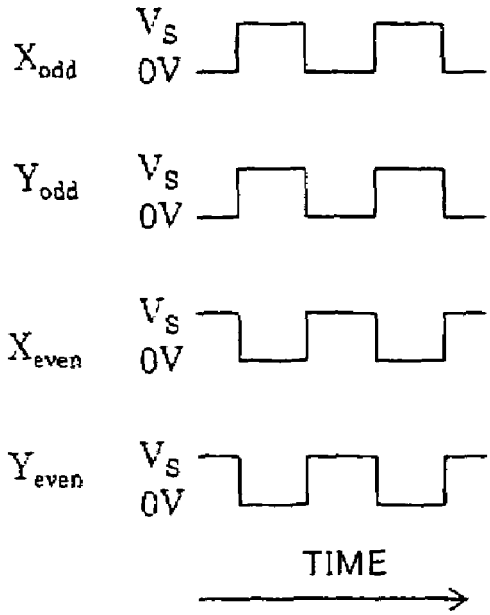
PRIOR ART FIG. 3B
Figure 6:
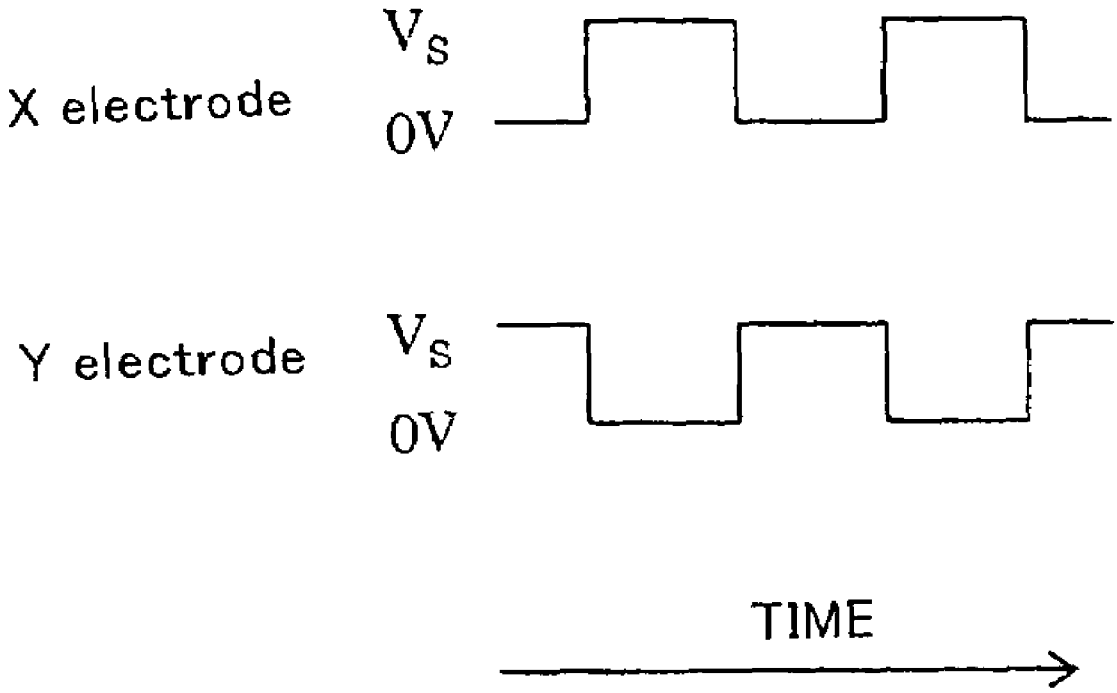
FIG. 6 is a diagram showing driving waveforms applied to the PDP shown in FIG. 4 during a display period.

In the PDP shown in FIG. 4, display discharges are generated in the display period by applying driving pulses having the waveforms shown in FIG. 6 to the electrodes. In the waveforms shown in FIG. 6, unlike the conventional waveforms shown in FIGS. 3A and 3B, alternating driving pulses having the same waveform are applied to all X electrode pairs and alternating driving pulses having the same waveform are applied to all Y electrode pairs so that the phase becomes opposite between the X electrode pairs and the Y electrode pairs. This makes it possible to simultaneously generate display discharges in all discharge gaps. This is different from the conventional technique shown in FIGS. 3A and 3B.

Before generating display discharges by applying the driving pulses shown in FIG. 6, cells to be turned on are selected as described below with reference to FIGS. 7 to 12.

Figure 7A:
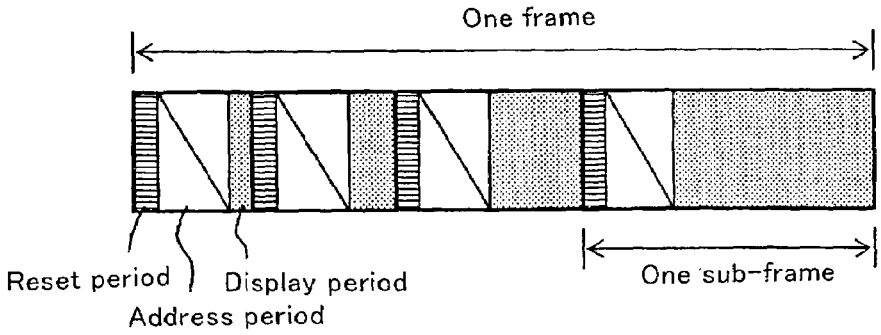
FIGS. 7A and 7B are diagrams showing a frame structure of the driving waveforms according to the first embodiment.
Figure 7B:
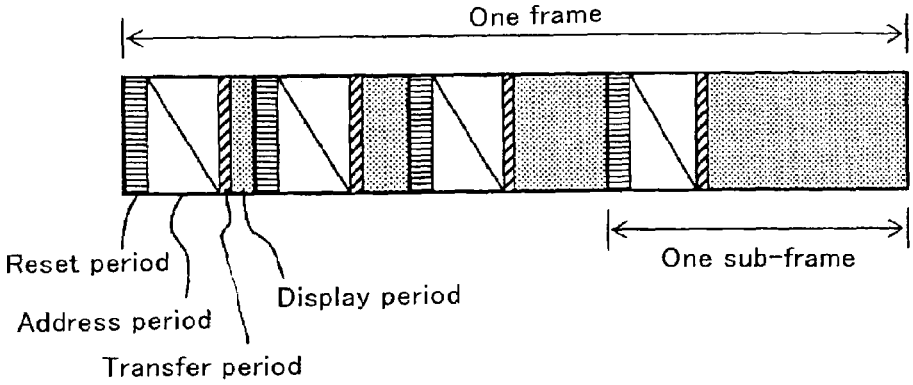

The frame structure associated with the driving waveform is shown in FIGS. 7A and 7B.

In the present embodiment, displaying is controlled using two types of frames, that is, odd frames shown in FIG. 7A and even frames shown in FIG. 7B. In each odd frame, an odd frame display signal (display data) is dealt with, and an even frame display signal (display data) is dealt with in each even frame. In general, the display signal (display data) of each odd frame is displayed on odd display lines, and the display signal (display data) of each even frame is displayed on even display lines. Conversely, the display signal (display data) of each odd frame may be displayed on even display lines, and the display signal (display data) of each even frame may be displayed on odd display lines. That is, the terms "odd frames" and "even frames" are used herein to specify two types of successive frames wherein each type of frame includes a corresponding type of display signal, and "odd" and "even" do not have a further meaning other than the above. (The terms "odd frames" and "even frames" are also used in a similar manner in other embodiments which will be described later.)

As shown in FIG. 7A, the odd frame includes a plurality of sub-frames each of which includes a reset period, an address period, and a display period, wherein the display period is weighted depending on the corresponding sub-frame. The "reset period," the "address period", and the "display period" are simply denoted by "reset", "address", and "display", respectively, in FIGS. 7A and 7B, for the purpose of simplicity. Similar notations will also be employed elsewhere in other figures.

On the other hand, as shown in FIG. 7B, the even frame includes an additional period called a transfer period between an address period and a display period. The transfer period will be described in detail later.

In the odd frame, the same data is written into two adjacent cells between which there is a Y electrode pair, while, in the even frame, the same data is written into two adjacent cells between which there is an X electrode pair. More specifically, for example, as shown in FIG. 4, in the odd frame, the same data is written into cells 201 and 202 between which there is the Y electrode pair $Y_1$, while, in the even frame, the same data is written into cells 301 and 302 between which the X electrode pair $X_2$ is located or the same data is written into cells 311 and 312 between which the X electrode pair $X_3$ is located.

Figure 8:
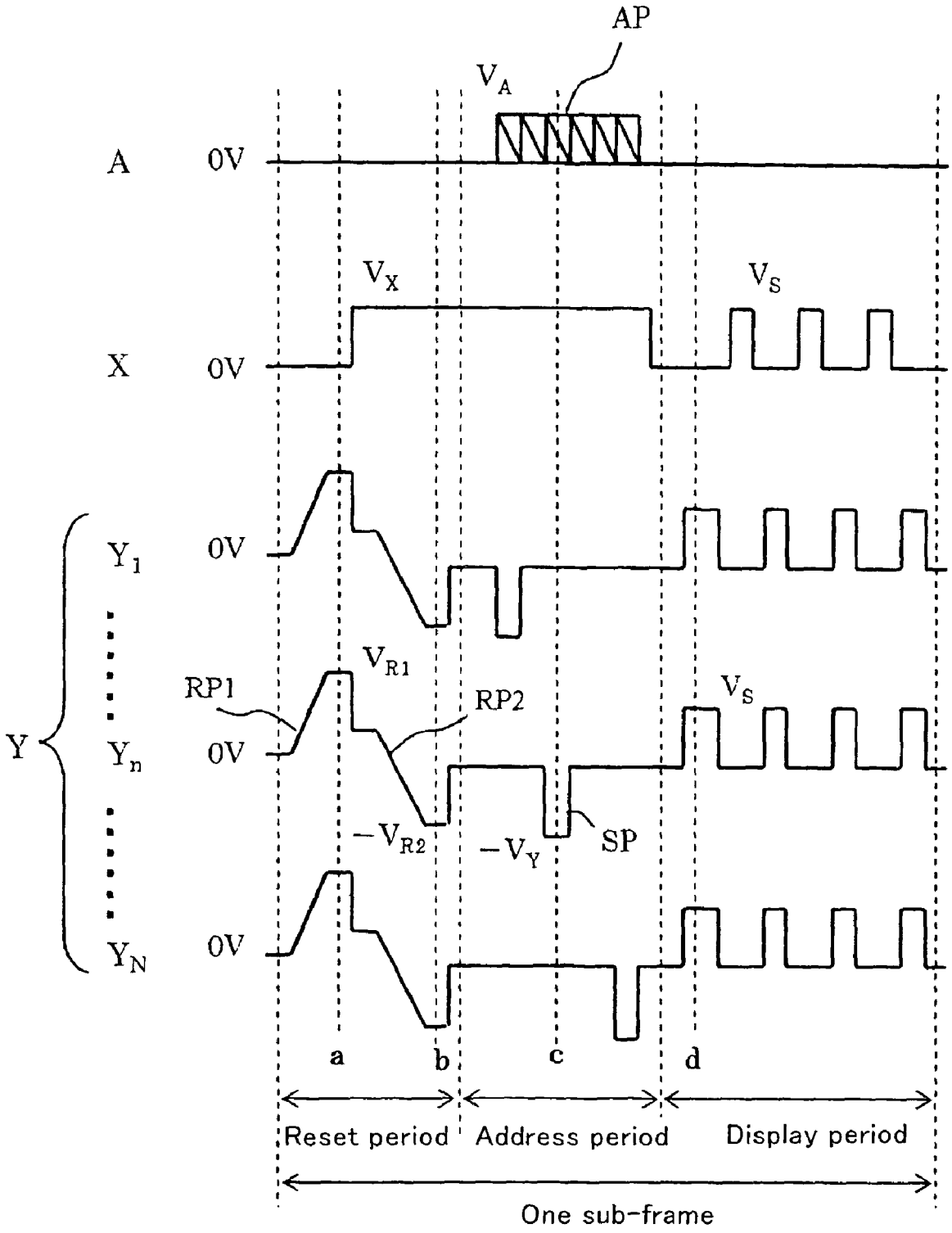
FIG. 8 is a diagram showing driving waveforms used in a sub-frame in an odd frame according to the first embodiment.

FIG. 8 shows the waveforms of driving pulses used (to write data into, for example, cells 201 and 202) in one sub-frame in the odd frame shown in FIG. 7A.

The driving pulses shown in FIG. 8 are basically similar to those used to drive the conventional PDP. However, because there are discharge gaps at both sides of each electrode pair as shown in FIG. 4, the driving pulses are applied so that address discharges are simultaneously generated in two cells (for example, 201 and 202 in FIG. 4) one of which is located at one side of an electrode pair and the other one of which is located at the opposite side of that electrode pair. In the reset period, as shown in FIG. 8, ramp signals RP1 and RP2 are applied to the electrode pairs so that weak discharges occur in cells thereby resetting the cells. Note that the waveforms of the driving signals used in the reset period are not limited to those shown in FIG. 8.

When cells in the PDP are driven by the driving pulses having the waveforms shown in FIG. 8, they operate as described below with reference to FIG. 9. FIG. 9 is a cross-sectional view of the PDP taken along a line parallel to an address electrode A, wherein electric charges on surfaces of dielectric layers formed on cells are also shown. Note that, in FIG. 9, two electrodes of a Y electrode pair $Y_n$ are shown, but only one electrode is shown for an X electrode pair $X_n$ and for an X electrode pair $X_{n+1}$.

Figure 9A:
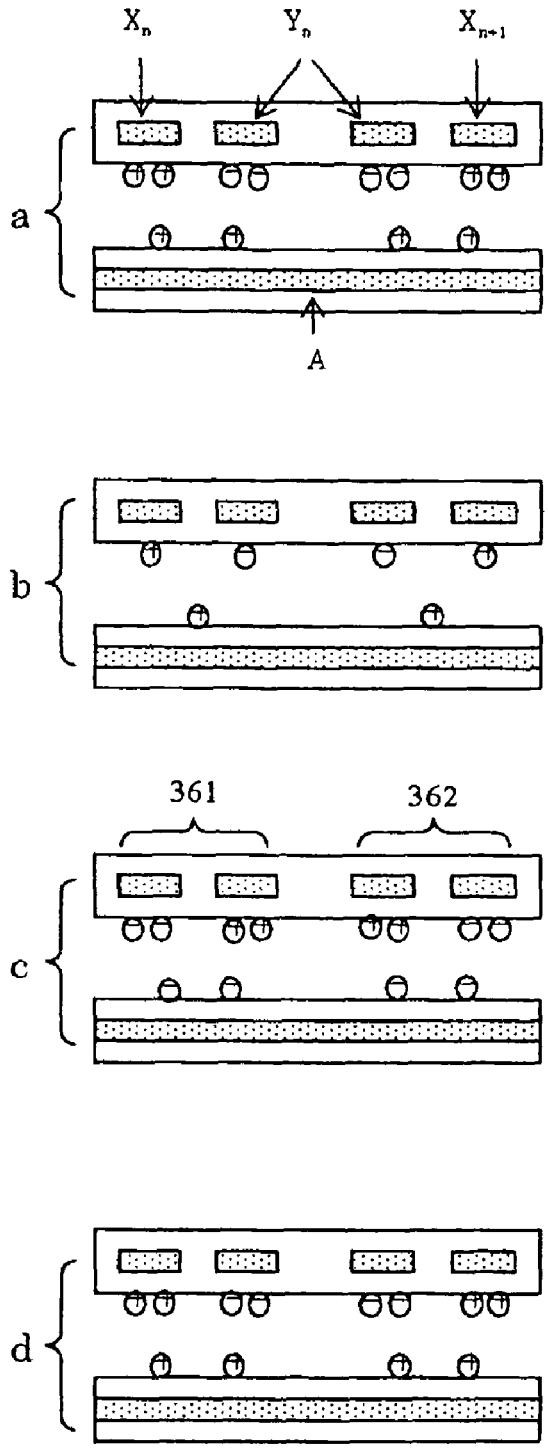
FIGS. 9A and 9B are diagrams showing operating states of the PDP in the sub-frame in the odd frame according to the first embodiment.
Figure 9B:
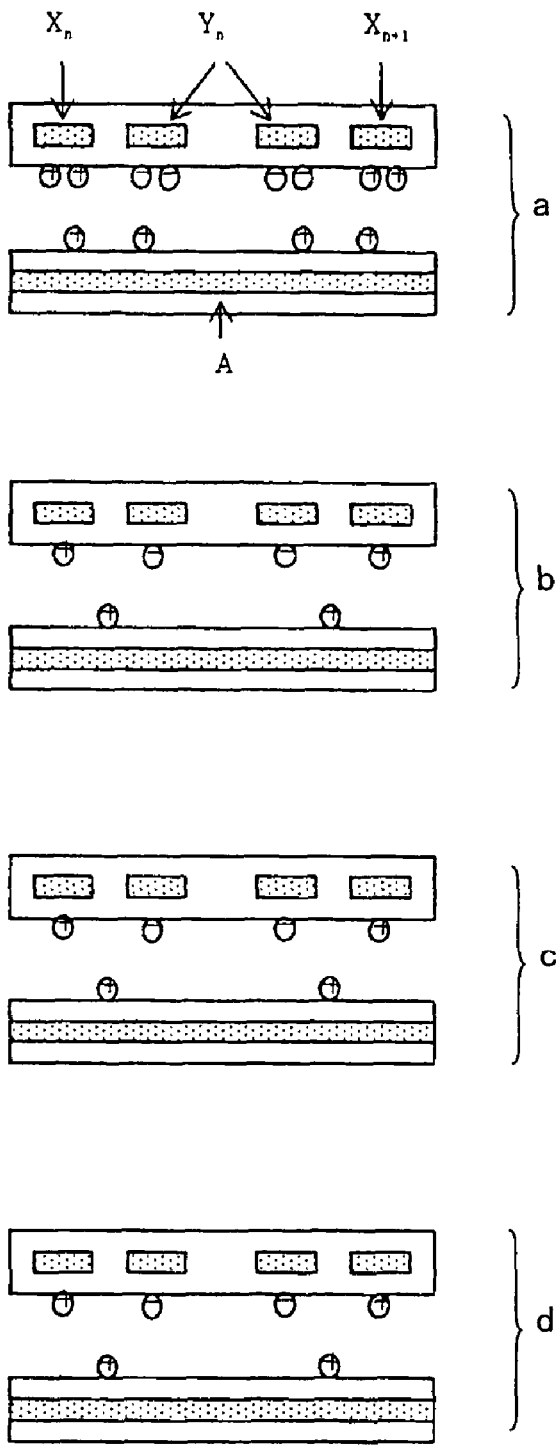

In FIG. 9, states denoted by reference symbols a to d correspond to steps denoted by reference symbols a to d in FIG. 8. In FIG. 9A, states of lit cells are shown, and states of unlit cells are shown in FIG. 9B. The states of cells are described below with reference to FIGS. 9A and 9B in conjunction with the waveforms of driving pulses shown in FIG. 8.

First, during the reset period shown in FIG. 8, a first ramp voltage RP1 is applied so that a wall voltage is stored in all cells (step a). Subsequently, a second ramp voltage RP2 is applied so that the wall voltage is adjusted to a level suitable for address discharge (step b).

As a result, all cells are initialized such that wall charges are uniformly formed in all cells as shown a and b of FIGS. 9A and 9B.

In the address period, as shown in FIG. 8, scanning pulses SP (with a voltage of $-V_Y$) are applied to Y electrodes, while address pulses AP are applied to address electrodes, depending on whether a strong address discharge should be generated (step c). More specifically, for cells to be lit, an address pulse AP with a voltage of $V_A$ is applied so that a strong address discharge is generated by the combination of the address pulse AP and the scanning pulse SP with a voltage of $-V_Y$, thereby forming a wall voltage on the surface of the dielectric layer in two cells 361 and 362 (two adjacent cells between which there is the Y electrode pair $Y_n$), which is high enough to cause a display discharge to occur in the display period. Note that in FIG. 9A, the two cells 361 and 362 correspond to the two cells 201 and 202 shown in FIG. 4.

On the other hand, for cells to be unlit, the address pulse AP with a voltage of $V_A$ is not applied. In this case, the address discharge is weak and the wall voltage formed is not high enough to allow a display discharge to occur in the display period. Note that the term "weak address discharge" is used to describe not only a literally weak address discharge but also a state in which no address discharge occurs.

Thus, in step c, as shown on (c) of FIG. 9A, a large amount of wall charge is formed in the cells 361 and 362 to be lit, while the wall charge in the cells to be unlit is maintained at a low level as shown on (c) of FIG. 9B.

Note that, as described above, the address discharge is produced simultaneously for two cells (361 and 362) adjoining each other via a Y electrode pair.

In the following display period, a sequence of sustain pulses is applied and, in response thereto, display discharges occur only in those cells in which the strong discharge was produced.

Thus, the state of cells to be lit (shown in FIG. 9A) and the state of cells to be unlit (shown in FIG. 9B) become different from each other in step c and step d. That is, a large amount of wall charge is formed in the cell to be lit and thus the cells are turned on, while a small amount of wall charge is formed in the cells to be unlit and they are maintained in the off-state.

Now the waveforms of driving pulses applied in sub-frames in the even frame and the operation which occur in response to the driving pulses are described below with reference to FIGS. 10 to 12.

Figure 10:
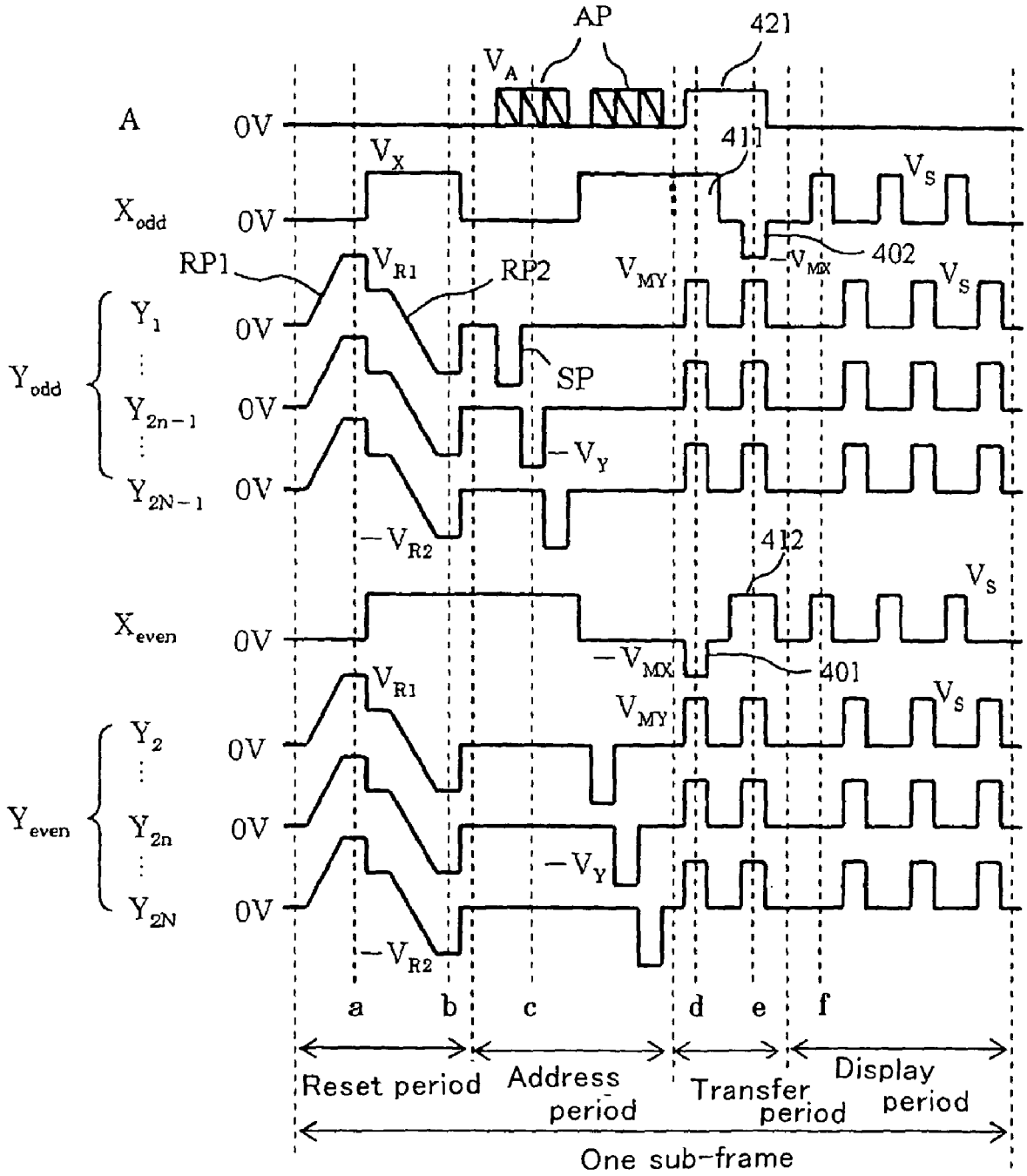
FIG. 10 is a diagram showing driving waveforms used in a sub-frame in an even frame according to the first embodiment.

FIG. 10 shows the waveforms of driving pulses applied in sub-frames in the even frame. FIGS. 11 and 12 show operating states of cells in the sub-frames.

In the even frame, unlike the odd frame in which cells located at both sides of Y electrode pairs are simultaneously addressed, driving pulses are applied so that address discharges occur only in cells located at one side of each Y electrode pair.

For example, the cell 301 at a downstream side of the Y electrode pair $Y_1$ shown in FIG. 4 and the cell 311 at a downstream side of the electrode pair $Y_2$ are addressed. Herein, the term "downstream side" is used to describe, of two sides of an electrode pair, a side which is scanned at a later time than the opposite side. In the example shown in FIG. 4, lower sides of respective electrode pairs are downstream sides (the term "upstream side" will be used to describe the opposite side, and the terms "upstream side" and "downstream side" will be used elsewhere in the present description to specify sides in a similar manner).

In FIG. 10, in order to make it possible to address only those cells located at one side of each Y electrode pair, the display electrode pairs are grouped into a group of even X electrode pairs $X_{even}$ and a group of odd X electrode pairs $X_{odd}$.

When odd Y electrode pairs $Y_{odd}$ ($Y_1$ to $Y_{2N-1}$) are sequentially addressed in a first half of each address period, the voltage applied to the odd X electrode pairs $X_{odd}$ is lowered so that no address discharge occurs at upstream sides of Y electrode pairs, while the voltage applied to the even X electrode pairs $X_{even}$ is increased so that an address discharge occurs at downstream sides. On the other hand, when even Y electrode pairs $Y_{even}$ ($Y_2$ to $Y_{2N}$) are sequentially addressed in a second half of the address period, the voltage applied to the even X electrode pairs $X_{even}$ is lowered so that no address discharge occurs at upstream sides of Y electrode pairs, while the voltage applied to the odd X electrode pairs $X_{odd}$ is increased so that an address discharge occurs at downstream sides.

During the display period of the even frame, two cells which adjoin each other via an X electrode pair are grouped together, and displaying is performed in units of groups. More specifically, a strong address discharges, which was produced in a cell during an address period, is transferred into a cell which is adjacent, via the corresponding X electrode pair to the cell in which the strong address discharge was produced so that discharges occur simultaneously in both the former cell and the latter cell into which the discharge is transferred. In order to perform discharge transfer, a transfer period is provided between each address period and the following display period.

During the transfer period, a voltage ($V_{MY}+V_{MX}$, that is, the difference between a voltage $V_{MY}$ applied to a Y electrode pair and a voltage $-V_{MX}$ applied to an X electrode pair) slightly lower than a discharge starting voltage is applied to a cell (such as the cell 302 or 312 shown in FIG. 4) which is adjacent, at a downstream side, to the addressed cell so that a discharge is induced in the cell (such as the cell 302 or 312 shown in FIG. 4) which is adjacent, at the downstream side, to the addressed cell, in response to a discharge which was produced in the addressed cell (such as the cell 301 or 311 shown in FIG. 4). That is, the discharge in the addressed cell functions as a trigger which causes a discharge to be started in the cell adjacent, at the downstream side, to the addressed cell.

If a sufficient wall voltage is formed (that is, if a strong address discharge occurs) during the address period in a cell (such as the cell 301 or 311 shown in FIG. 4) at the upstream side, a discharge in that cell can function as a trigger, in the transfer period, which causes a discharge to occur in a cell (such as the cell 302 or 312 in FIG. 4) adjacent at the downstream side. However, in a case in which a sufficient wall voltage is not formed during the address period in a cell at the upstream side (that is, in a case in which a weak address discharge occurs or no discharge occurs in that cell), no discharge occurs in that cell in the transfer period and thus no discharge is induced in a cell adjacent at the downstream side.

In order that, in response to a discharge in an addressed cell, a discharge is induced only in a cell (such as the cell 302 or 312 in FIG. 4) adjacent, at the downstream side, to an addressed cell, without causing a discharge to be induced in a cell (such as the cell 303 or 313 shown in FIG. 4) adjacent, at the upstream side, to the addressed cell, X electrode pairs are grouped into a group of odd X electrode pairs $X_{odd}$ and a group of even X electrode pairs $X_{even}$ in the transfer period, as in the address period, and driving pulses are applied such that a high voltage is not applied to cells (upstream cells) located at the opposite side of the respective Y electrode pairs.

More specifically, in step d, a negative transfer pulse 401 (with a voltage of $-V_{MX}$) is applied to even X electrode pairs $X_{even}$ while a positive pulse 411 for suppressing discharge transfer is applied to odd X electrode pairs $X_{odd}$ (successively after the pulse applied during the address period). Thereafter, in step e, a negative transfer pulse 402 (with a voltage of $-V_{MX}$) is applied to odd X electrode pairs $X_{odd}$, while a positive transfer suppression pulse 412 is applied to even X electrode pairs $X_{even}$.

In the driving process described above, first, one of two cells adjoining each other via a Y electrode pair is addressed in the address period. In the following transfer period, the discharge is transferred from the addressed cell into a cell (downstream cell, in this case) which is adjacent, via an X electrode pair, to the addressed cell. During the display period, displaying is performed in units of cell groups each consisting of an addressed cell and a cell into which the discharge was transferred (that is, in units of two cells adjoining each other via an X electrode pair).

The operating states of cells of the PDP driven in the above-described manner are described below with reference to FIGS. 11 and 12.

Figure 11:
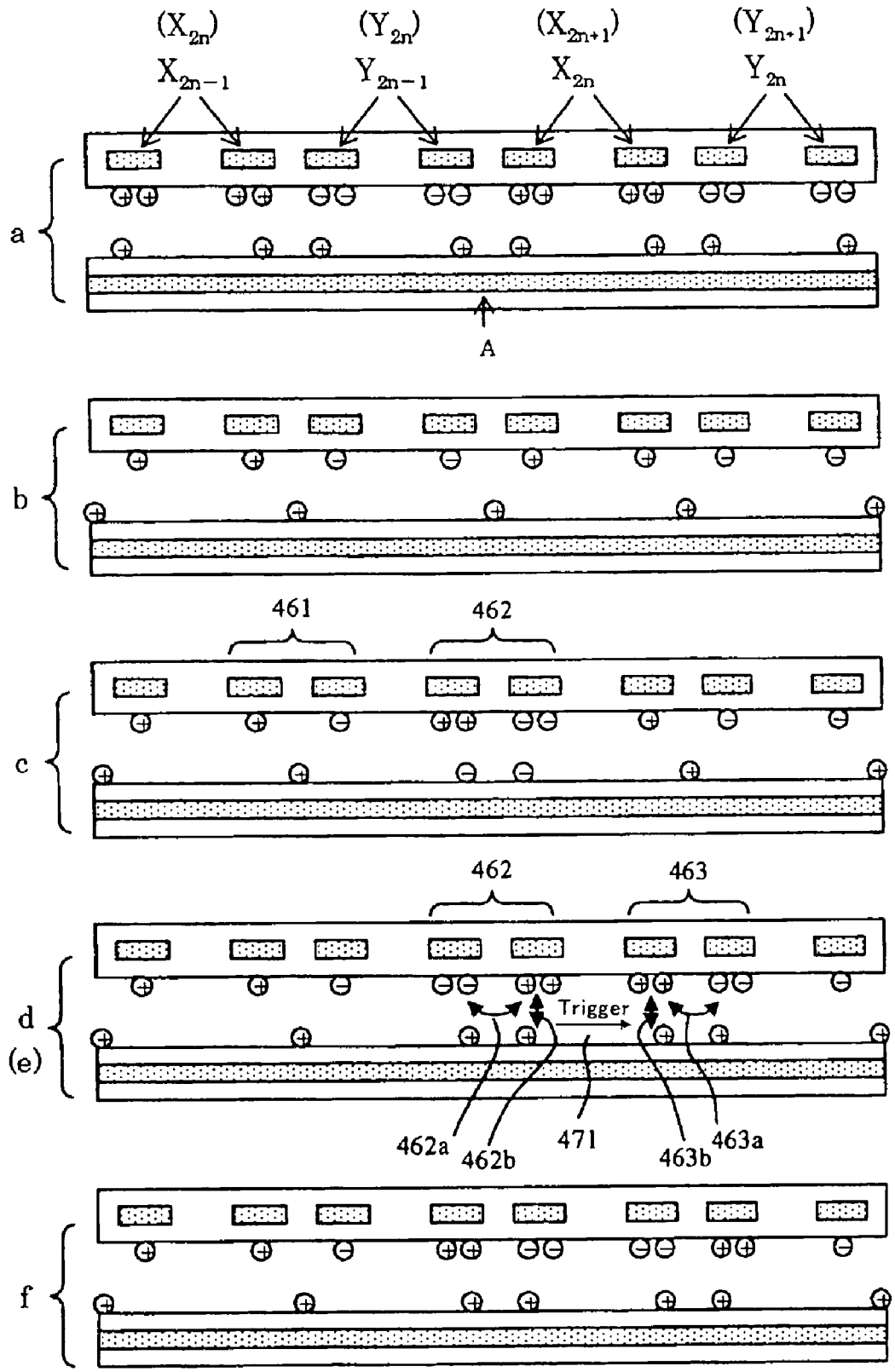
FIG. 11 is a diagram showing operating states of cells lit in the sub-frame in the even frame according to the first embodiment.
Figure 12:
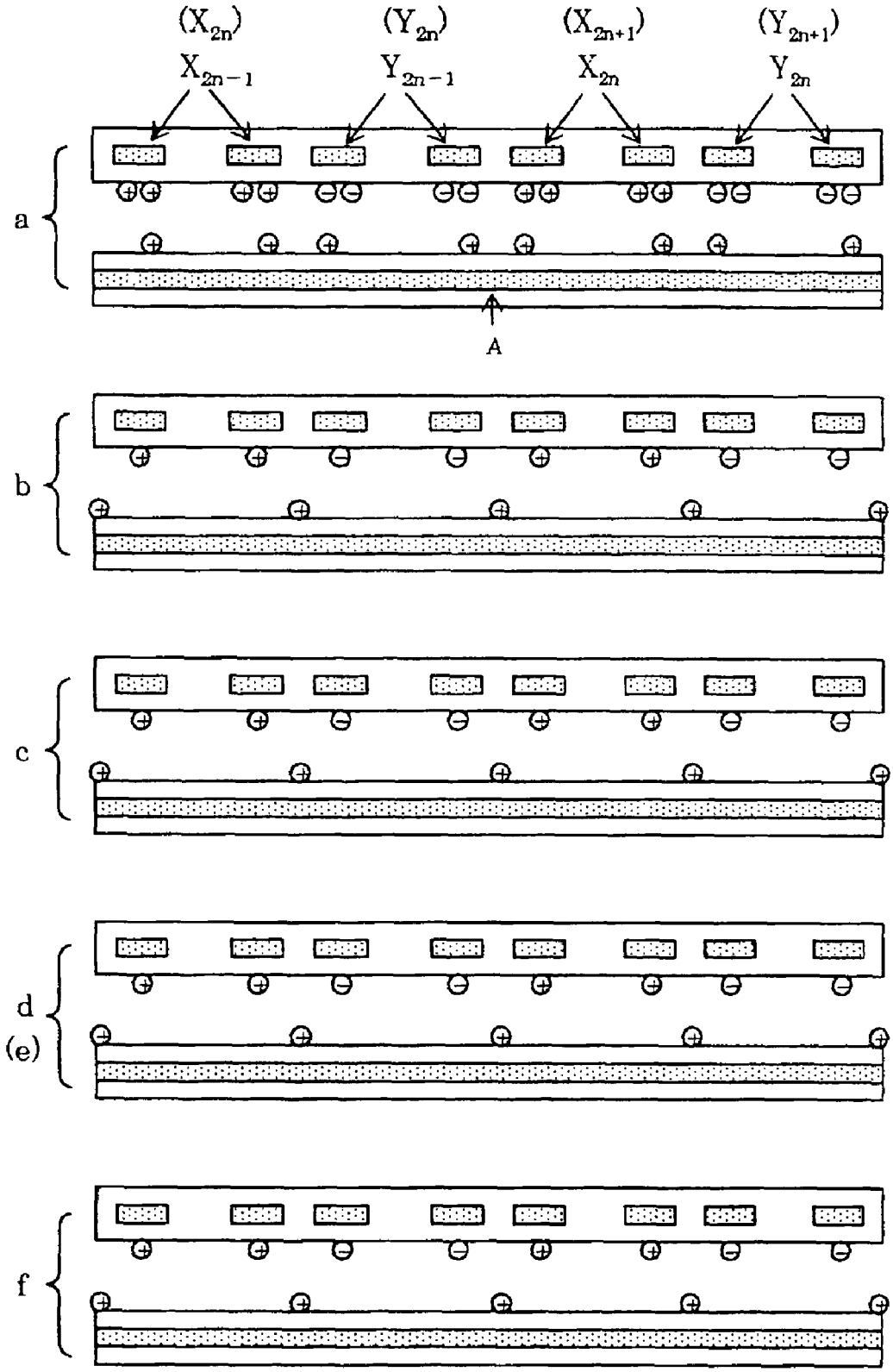
FIG. 12 is a diagram showing operating states of cells unlit in the sub-frame in the even frame according to the first embodiment.

In FIGS. 11 and 12, reference symbols a to f denote states of cells in steps a to f shown in FIG. 10, while cells in the lit state in steps a to f are shown in FIG. 11 and cells in unlit state are shown in FIG. 12. The operating states of the cells shown in FIGS. 11 and 12 are described below in connection with the driving waveforms shown in FIG. 10.

First, during the reset period shown in FIG. 10, a first ramp voltage RP1 is applied so that a proper wall voltage is stored in all cells (step a). Subsequently, a second ramp voltage RP2 is applied so that the wall voltage is adjusted to a level suitable for address discharge (step b).

As a result, all cells are initialized such that wall charges are uniformly formed in all cells in steps a and b, as shown in FIGS. 11 and 12.

In the address period shown in FIG. 10, a scanning pulse SP (with a voltage of $-V_Y$) is applied to Y electrode pairs, and a weak or strong address discharge is selectively produced depending on whether a pulse is applied to address electrode pairs (step c). That is, an address pulse AP with a voltage of $V_A$ is applied to cells to be lit so that a strong address discharge is produced by a voltage resulting from a combination of the address pulse AP and the scanning pulse SP with the voltage of $-V_Y$ thereby forming a wall voltage high enough to allow a display discharge to occur during the display period. On the other hand, the address pulse AP with the voltage of $V_A$ is not applied to cells to be unlit so that a weak address discharge occurs (or no address discharge occurs) in those cells thereby maintaining the wall voltage in a state in which a display discharge cannot occur during the display period. Furthermore, in the address period, a selection level voltage (high voltage) or a non-selection level voltage (low voltage) is applied to odd X electrode pairs or even X electrode pairs as shown in FIG. 10 thereby addressing, of two cells (such as 461 and 462 in FIG. 11) adjacent via an Y electrode pair to each other, only one cell (such as 462 in FIG. 11) at one side of the Y electrode pair (step c).

In this step c, as shown in c of FIG. 11, a large amount of wall charge is formed in the cell 462, while a small amount of wall charge is formed in the cell 461. The cells 461 and 462 shown in FIG. 11 correspond to the cells 303 and 301 (or the cells 313 and 311), respectively, shown in FIG. 4.

In the following step d (or e) (in the transfer period) shown in FIG. 11, the discharge is transferred from the cell 462 into the cell 463. That is, a surface discharge 462*a* is transferred into a surface discharge 463*a*.

In the transfer of the surface discharge, an opposed discharge between an address electrode pair A and an X electrode pair $X_{2N}$ may be used to enhance the transfer operation. More specifically, in state d shown in FIG. 11, when the surface discharge 462*a* is generated, an opposed discharge is also generated substantially simultaneously. Also in the cell 463 into which the discharge is to be transferred, a voltage is applied so that an opposed discharge 463*b* can occur in addition to the surface discharge 463*a*. Thus, in the transfer process, both the surface discharge 462*a* and the opposed discharge 462*b* serve as a trigger which causes the opposed discharge 463*b* and the surface discharge 463*a* to be induced substantially simultaneously in the adjacent cell 463*b*. In a case in which the voltage applied during the transfer process is small, there is a possibility that the opposed discharge 463*b* is not generated although the opposed discharge 462*b* is generated. Even in such a case, the opposed discharge 462*b* can contribute to enhancement of the discharge transfer.

Because the distance between two opposed discharges 462*b* and 463*b* is smaller than the distance between two surface discharges 462*a* and 463*a*, the opposed discharge makes the discharge transfer easier.

To generate such an opposed discharge between opposing electrodes to enhance the discharge transfer, an auxiliary transfer pulse is applied to the address electrode A as represented by reference numeral 421 in FIG. 10. The timing of raising the auxiliary transfer pulse 421 is set to be coincident with or earlier than the timing of the transfer pulse 401. Although the auxiliary transfer pulse 421 is not necessarily needed in the transfer operation, the auxiliary transfer pulse 421 ensures that the transfer operation is performed in a more reliable fashion. In other words, the operation margin in the transfer operation can be increased.

In the transfer period, there are two transfer steps d and e shown in FIG. 10 and those two steps correspond to states d and (e), respectively, shown in FIG. 11. Note that, in state (e) shown in FIG. 11, electrodes are denoted by reference symbols put in parentheses (such as ($X_{2N}$) to ($Y_{2n+1}$)). On the other hand, electrodes associated with step d are denoted by reference symbols which are not enclosed in parentheses.

As shown in FIG. 11, in step d, a discharge in a cell addressed by an odd Y electrode pair $Y_{2N-1}$ is transferred into a cell adjacent to an even X electrode pair $X_{2N}$. On the other hand, in step (e), a discharge in a cell addressed by an even Y electrode pair $Y_{2N}$ is transferred into a cell adjacent to an odd X electrode pair $X_{2n+1}$.

FIG. 12 shows operating states of unlit cells in sub-frames in the even frame. In FIG. 12, states in steps a and b (reset period) are similar to those in FIG. 11. However, in step c (address period), the amount of wall charge is small in all cells shown in FIG. 11 because all cells are to be unlit. In FIG. 12, there is no cells (in the lit state) in which a discharge occurs, and thus the wall charges of all cells are maintained at the low level in all steps from d through f.

As described above with reference to FIGS. 7 to 12, in both odd and even frames, cells arranged in two lines adjacent in a vertical direction (in the column direction of the matrix screen) to each other form one line of a display screen, and each line of the display screen is shifted by one cell, that is, by a half pitch, between even frames and odd frames, thereby achieving interlacing.

The interlacing technique is described in further detail below with reference to FIGS. 13A, 13B, 14A and 14B.

Figure 13A:
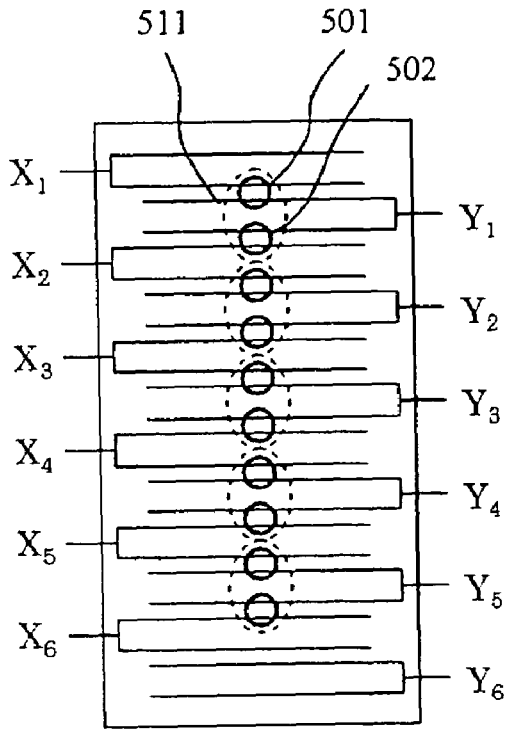
FIG. 13 is a diagram showing display cell groups.
Figure 13B:
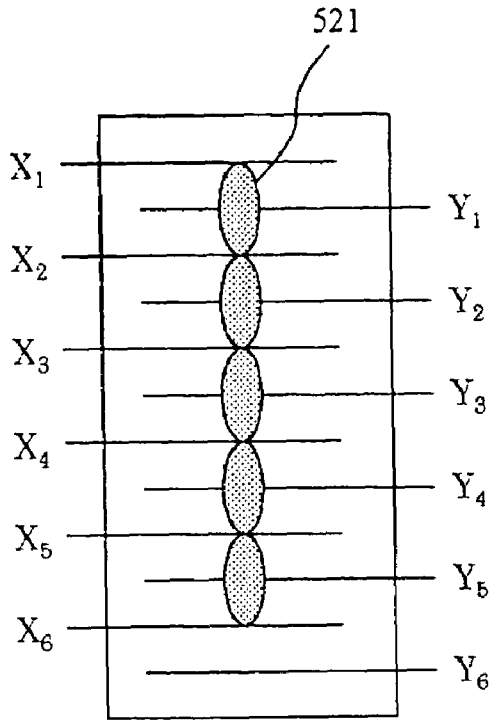

FIG. 13A shows a set of cells responsible for displaying one column of the screen, wherein those cells correspond to cells disposed on one line of address electrode. $X_1$ to $X_6$ denote X electrode pairs each including two electrodes, and $Y_1$, to $Y_6$ denote Y electrode pairs each including two electrodes. In FIG. 13A, circles denote cells formed between adjacent X and Y electrode pairs. Cells are grouped such that each group includes two adjacent cells, and displaying operation is performed in units of cell groups each including two cells. For example, two cells 501 and 502 shown in FIG. 13A are grouped as denoted by a broken circle 511. FIG. 13B is a simplified representation of FIG. 13A. In FIG. 13B, the cell group 511 shown in FIG. 13A is represented by a shaded area 521, the electrode pairs $X_1$ to $X_6$ and the electrode pairs $Y_1$ to $Y_6$, each of which is represented by two lines in FIG. 13A, are each represented in a simplified fashion by one line (similar representations will also be used elsewhere).

Figure 14A:
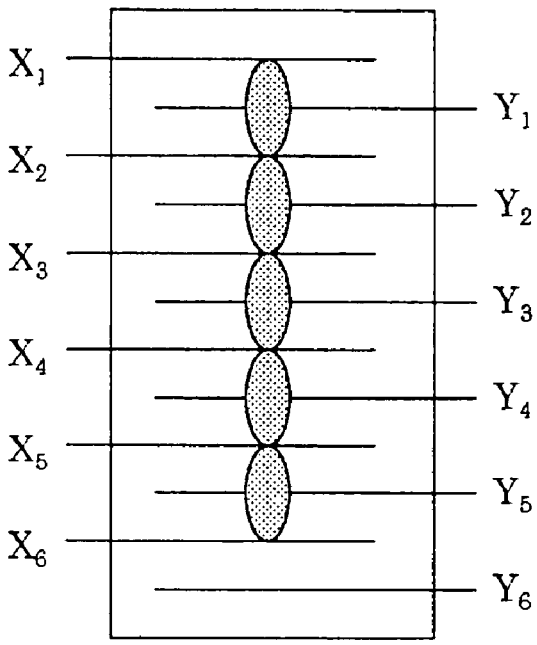
FIGS. 14A and 14B are diagrams showing display cell groups according to the first embodiment.
Figure 14B:
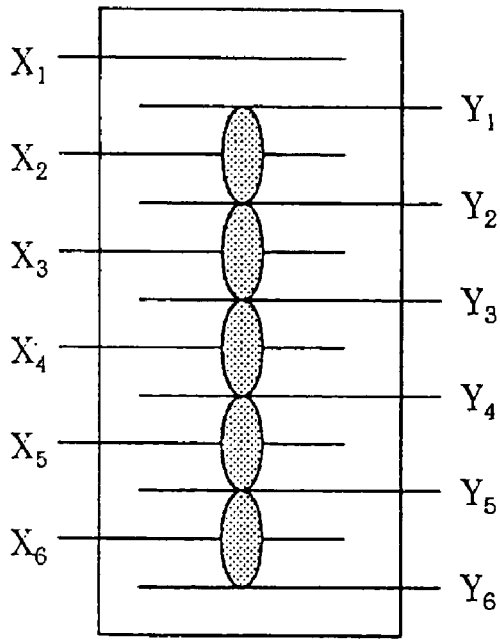

FIGS. 14A and 14B show cell groups subjected to the displaying operation in the display period according to the first embodiment. As can be seen from FIGS. 14A and 14B, grouping of cells is performed differently for the odd and even frames such that a location shift by one cell or a half pitch in the display line occurs between the odd and even frames. Thus, high vertical resolution depending on the number of electrodes can be achieved as with the conventional technique shown in FIGS. 2 and 3, and thus an image with high resolution can be displayed.

Although in the first embodiment described above, cell groups used to display even frames are shifted by one cell in the downstream direction relative to cell groups used to display odd frames, the shifting may be performed in the opposite direction, that is, in the upstream direction. In this case, corresponding modifications in combinations of driving waveforms must be made.

Second Embodiment

The technique disclosed above in the first embodiment can be used to display a high-resolution image of a general pattern. However, when a special pattern is displayed, degradation in resolution can occur. A second embodiment of the present invention provides a driving technique which makes it possible to display a high-resolution image even for such a special pattern.

First, when such a special pattern is displayed, what occurs with the first embodiment is described with reference to FIGS. 15A, 15B, 16A, 16B and 16C.

Figures 15A, 15B:
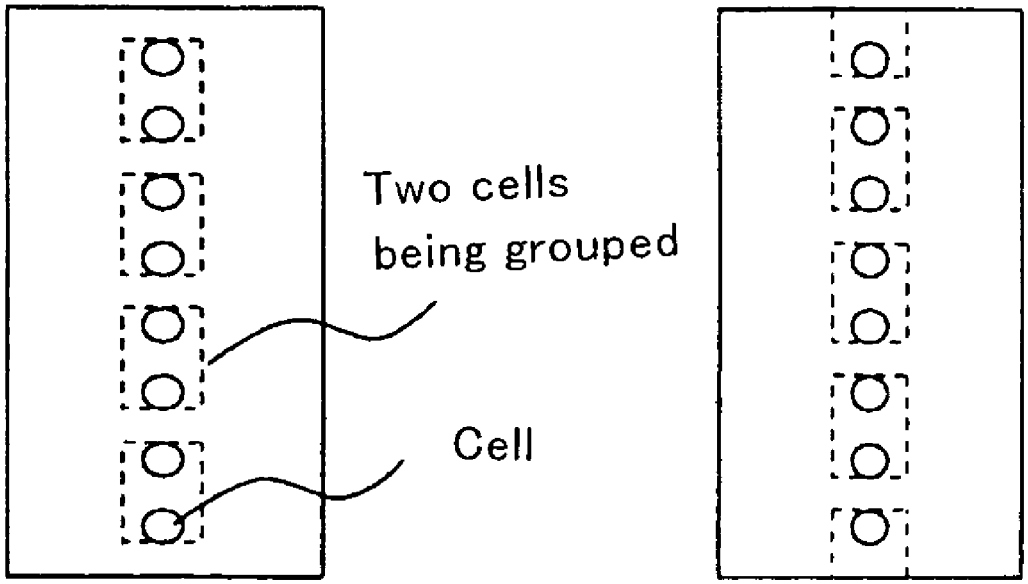
FIGS. 15A and 15B show a method of driving cells according to the first embodiment.

FIGS. 15A and 15B show the method of turning on/off cells according to the first embodiment, in which cells are grouped such that two cells adjacent in the vertical direction to each other are grouped together, and two cells in each group are simultaneously turned on or off, wherein grouping of cells is shifted by one cell in the vertical direction between the frame (as shown in FIG. 15A) and the odd frame (as shown in FIG. 15B).

Figure 16A:
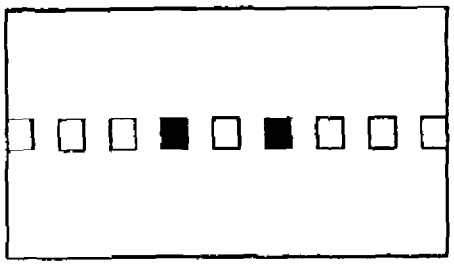
FIGS. 16A to 16C are diagrams for showing display resolution obtained for a special pattern, according to the first embodiment.
Figure 16B:
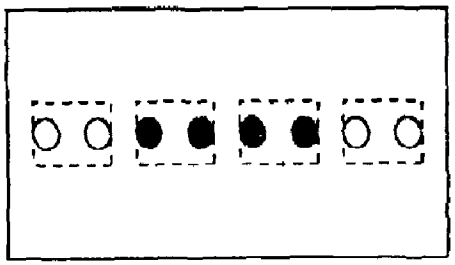
Figure 16C:
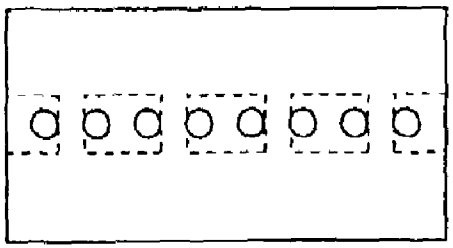

When display data such as that shown in FIG. 16A is displayed using the driving method according to the first embodiment described above with reference to FIG. 15, cells are lit in such a manner as shown in FIG. 16B in the even frame and as shown in FIG. 16C in the odd frame.

The display data shown in FIG. 16A includes two high-level dots between which there is one low-level dot. However, when this display data is displayed on the PDP according to the driving method of the first embodiment, four successive cells are lit in the even frame as shown in FIG. 16B, while no cells are lit in the odd frame as shown in FIG. 16C.

Herein, the term "dot" is used to describe a picture element, while the term "cell" is used to describe a display element realized by one discharge cell of the PDP. Solid squares in FIG. 16A indicate high-level dots, while solid circles in FIG. 16B indicate lit cells (similar representations will also be used elsewhere in the following description).

As described above, when such display data including two high-level dots between which there is one low-level dot is displayed, the resultant displayed image includes, as shown in FIG. 16B, no low-level dot which should appear between two high-level dots. That is, the problem of the driving method according to the first embodiment is that degradation in resolution occurs when such a special pattern is displayed.

Figure 17A:
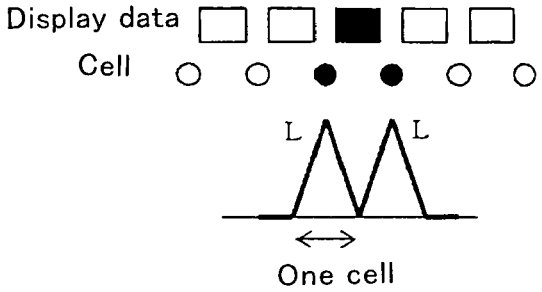
FIGS. 17A and 17B are diagrams showing the correspondence between a dot in display data and a manner in which cells are lit in an interlaced fashion.

The above-described problem originates from the driving method in which, as shown in FIG. 17A, the position of each dot of display data corresponds to the middle of two cells, that is, one display dot corresponds to two adjacent cells, and the two cells corresponding to one dot are lit such that the two lit cells have the same luminance.

Figure 17B:
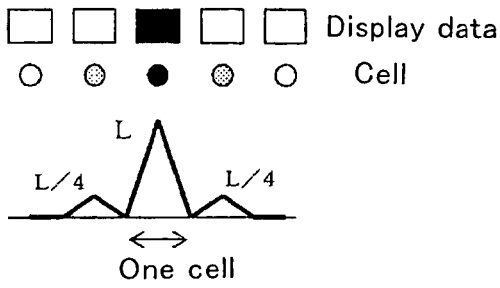
Figure 18A:
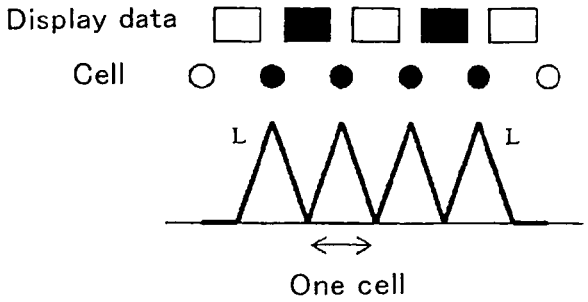
FIGS. 18A and 18B are diagrams showing the correspondence between dots in display data and a manner in which cells are lit, wherein the dots in the display data includes to high-level dots between which there is one low-level dot.
Figure 18B:
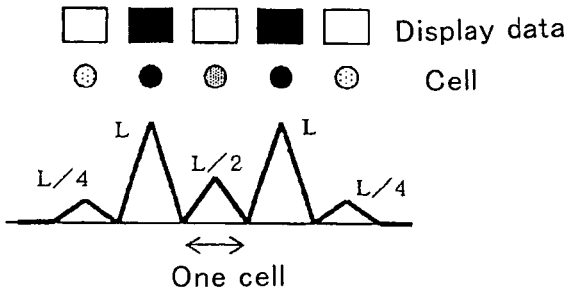

In the second embodiment of the present invention, to avoid the above problem, as shown in FIG. 17B, each dot is represented by three cells and those three cells are lit such that two cells at both sides of a center cell have lower luminance than the center cell. Furthermore, each dot of display data is related to a center cell of three cells grouped together. If this driving technique is used, when display data including two high-level dots between which there is one low-level dot is displayed, two dots are correctly separated in the resultant image as shown in FIG. 18B.

Thus, in the second embodiment, it is possible to correctly resolve even a special pattern which cannot be resolved by the technique according to the first embodiment. Furthermore, because adjacent cells are also lit, the reduction in brightness can be suppressed compared with the technique disclosed in Japanese Unexamined Patent Application Publication No. 9-160525.

Advantages and disadvantages of the first and second embodiments are summarized below.

In the first embodiment, although a display pattern can be generally displayed with high resolution, degradation in resolution occurs for a special pattern such as that shown in FIG. 16.

In contrast, in the second embodiment, high resolution is always achieved for all display patterns including such a special pattern. However, in the second embodiment, it is needed to use a complicated driving method as described later.

The advantage of the first embodiment is that the driving method is much simpler than the driving method according to the second embodiment. Besides, in many practical applications such as TV, the problem in displaying a special pattern such as that shown in FIG. 16 is not significant.

That is, the first and second embodiments have their own advantages and disadvantages. The first embodiment is suitable when general display data is displayed by a simple driving method, while the second embodiment is suitable when high complexity in the driving method is allowed if very high resolution is achieved.

Now, controlling of the luminance level is discussed below. In one example according to the second embodiment shown in FIG. 17B, a center cell corresponding to one dot of display data is lit so as to have luminance L, while two cells at both sides of the center cell are lit so as to have luminance L/4. On the other hand, in the first embodiment, two cells corresponding to one dot of display data are lit such that both cells have luminance L. If display data including dots which are alternately at high and low levels is displayed by setting the luminance in the above-described manner, dots are displayed, according to the second embodiment, in such a manner that, as shown in FIG. 18B, two cells corresponding to two high-level dots are lit so as to have luminance L, one cell between those two cells is lit so as to have luminance L/2, and two cells at outward sides of the two cells with luminance L are lit so as to have luminance of L/4. On the other hand, in the case of the first embodiment, dots are displayed in such a manner that all four cells corresponding to the two high-level dots are all lit so as to have luminance L, as shown in FIG. 18A. As can be understood from the above discussion, the second embodiment allows display data to be displayed with higher resolution than the first embodiment. Note that although in the example shown in FIG. 17B, of three cells grouped together, two cells at both sides of a center cell are lit so as to have luminance L/4, the luminance is not limited to L/4.

Figure 1:
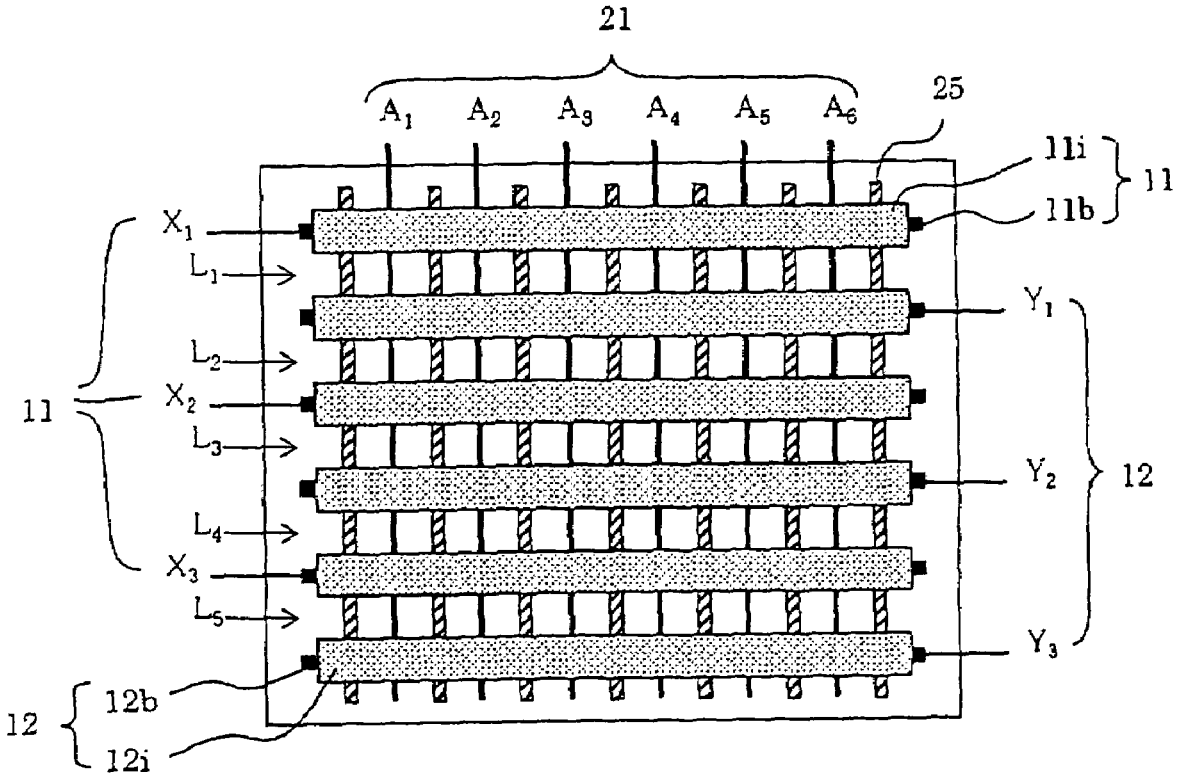
PRIOR ART FIG. 1
FIG. 1 is a plan view showing a structure of a conventional interlace-type PDP.

FIGS. 19A1, 19A2, 19B1 and 19B2 show a specific example of a method of driving three cells in the manner shown in FIG. 17B. First, a cell (a center cell of three cells, denoted by p1 in FIGS. 19A1 and 19A2) corresponding to a dot position and an adjacent cell (denoted by p2 in FIGS. 19A1 and 19A2) at one side of the former cell are grouped. The display period of a sub-frame is divided into a first display period and a second display period, and, of the two cells grouped together, only the cell (p1) corresponding to the dot position is lit during the first display period, as shown in FIG. 19A1, while both cells (p1 and p1) are both lit during the second display period, as shown in FIG. 19A2.

Grouping of two cells is performed in two different modes. For example, in FIGS. 19A1 to 19B2, cells p1 and p2 are grouped in a first mode, while cells q1 and q2 are grouped in a second mode. In the first mode, a cell (a center cell of three cells) corresponding to a dot position and an adjacent cell at the upstream side of the former cell are grouped together, while in the second mode, the cell (the center cell of three cells) corresponding to the dot position and an adjacent cell at the downstream side are coupled together. Note that in FIGS. 19A1 to 19B2 reference symbols p1 and q1 denote the same cell (the center cell of three cells).

The group of two cells in the first mode is referred to as a type-A group, and the group in the second mode is referred to as a type-B group (although the manner of grouping is not limited to the above).

In each frame, cells are grouped in both the first mode (into type-A groups) and the second mode (into type-B groups). More specifically, cells are grouped into type-A groups in one sub-frame, while cells are grouped into type-B groups in the other sub-frame, wherein the former sub-frame is referred to as a type-A sub-frame and the latter sub-frame is referred to as a type-B sub-frame.

By driving the PDP cell in the manner as described above (with reference to FIGS. 19A1, 19A2, 19B1 and 19B2) in accordance with display data, it is possible to realize a state (shown in FIG. 17B) in which a center cell of three cells is lit so as to have high luminance while two cells at both sides of the center cell are lit so as to have low luminance.

Figure 20:
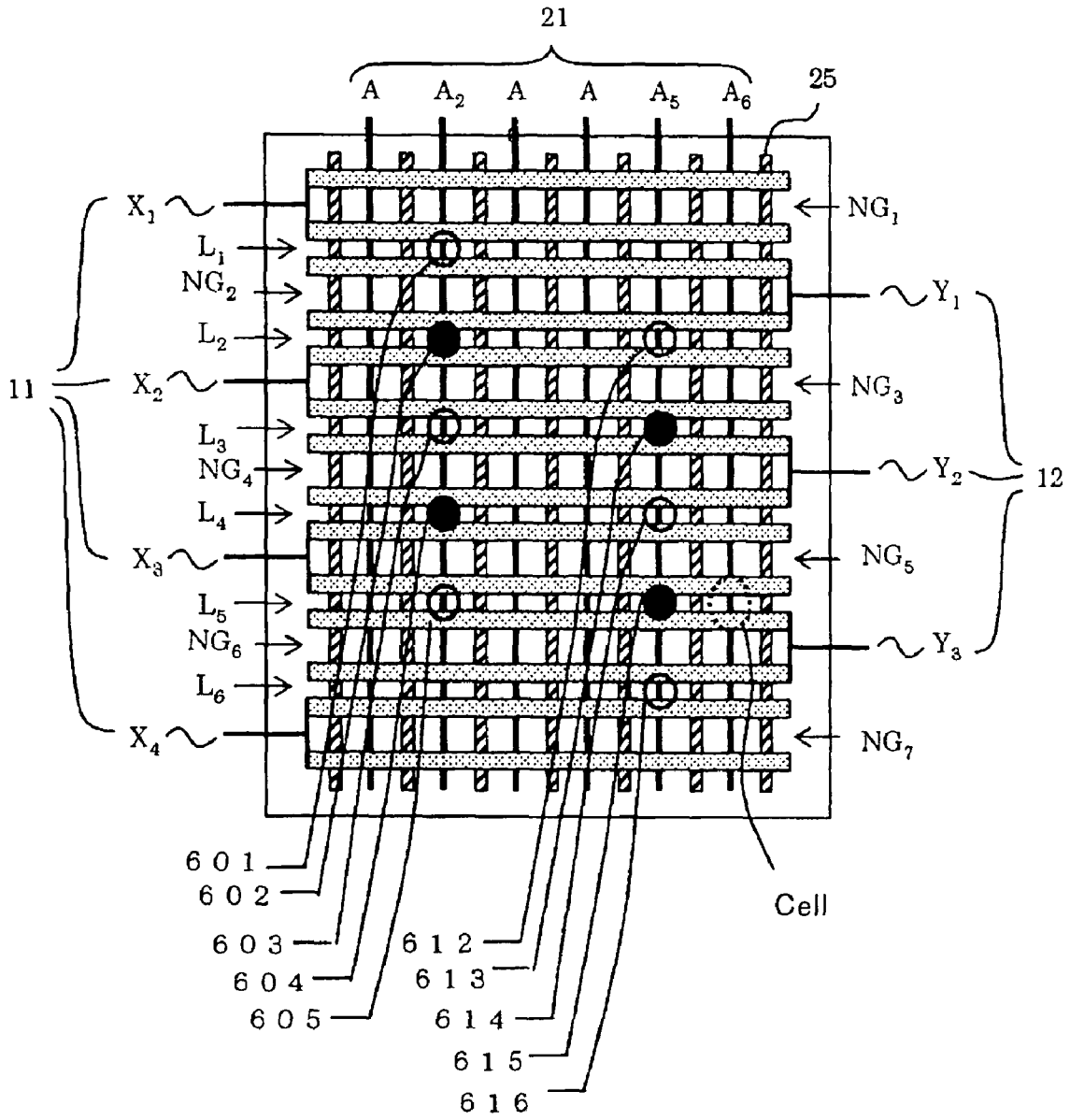
FIG. 20 is a diagram showing a PDP structure according to the second embodiment.

The structure of the PDP according to the second embodiment is shown in FIG. 20 (in the form of a plan view) and FIG. 5 (in the form of a perspective view), wherein some cells are shown for the purpose of description of the driving method according to the second embodiment. The structure of the PDP is similar to that according to the first embodiment shown in FIG. 4 (plan view) and FIG. 5 (perspective view), and similar reference symbols are used to denote similar parts such as electrodes and discharge gaps.

First, a specific example of a driving method is described.

Figure 21:
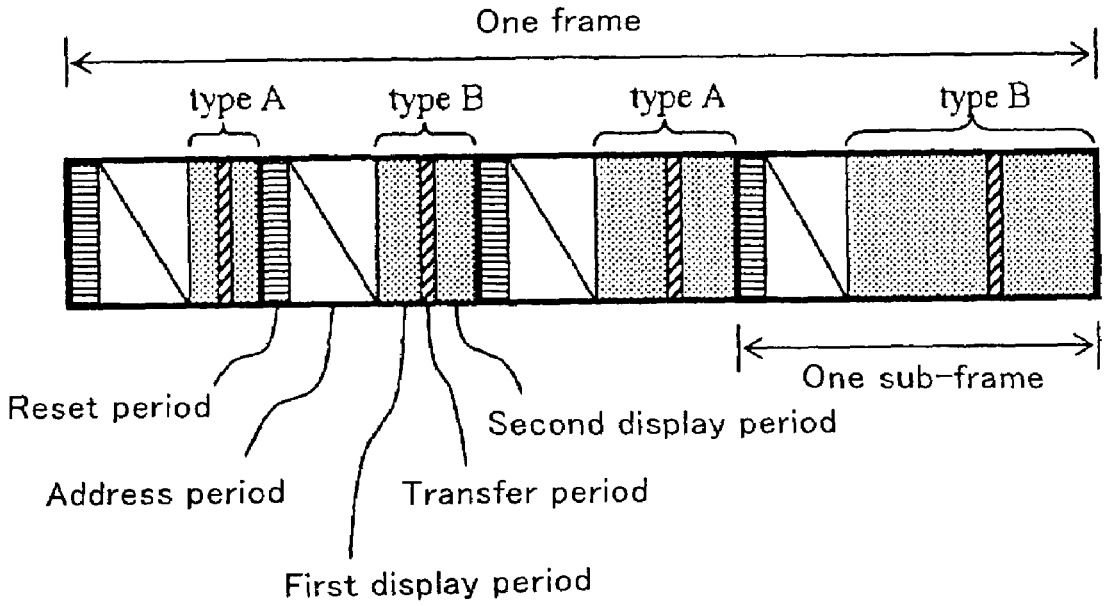
FIG. 21 is a diagram showing a frame structure associated with driving waveforms according to the second embodiment.

As shown in FIG. 21, each sub-frame includes a reset period, an address period, and a display period, and the display period includes a first display period (a first half display period) and a second display period (a second half display period) between which there is a transfer period.

In the first display period, cells in even lines are lit in even frames, while cells in odd lines are lit in odd frames (in general, cell in even lines may be lit in odd frames and cells in odd lines may be lit in even frames). Cells to be lit in even or odd frames are selected during the address period.

For example, during the address period and the first display period of the even frame shown in FIG. 21, cells such as those denoted by 602 and 604 in FIG. 20 are lit, while cells such as those denoted by 613 and 615 in FIG. 20 are lit during the address period and the first display period in the odd frame shown in FIG. 21.

In the second display period shown in FIG. 21, cells adjacent in the upstream direction to respective cells which were lit during the first display period are lit in the type-A sub-frame, while cells adjacent in the downstream direction to respective cells which were lit during the first display period are lit in the type-B sub-frame. Grouping of cells into such groups each including two cells is performed in the transfer process during the transfer period.

For example, during the transfer period and the second display period in the type-A sub-frame of the even frame shown in FIG. 21, two cells 601 and 602 and two cells 603 and 604 shown in FIG. 20 are simultaneously lit. On the other hand, during the transfer period and the second display period of the type-B sub-frame in the even frame shown in FIG. 21, two cells 602 and 603 and two cells 604 and 605 shown in FIG. 20 are simultaneously lit.

On the other hand, during the transfer period and the second display period of the type-A sub-frame in the odd frame shown in FIG. 21, two cells 612 and 613 and two cells 614 and 615 shown in FIG. 20 are simultaneously lit, while, during the transfer period and the second display period of the type-B sub-frame in the odd frame shown in FIG. 21, two cells 613 and 614 and two cells 615 and 616 shown in FIG. 20 are simultaneously lit.

FIGS. 22 to 25 show states in which cells are grouped and lit in the above-described manner.

Figure 22A:
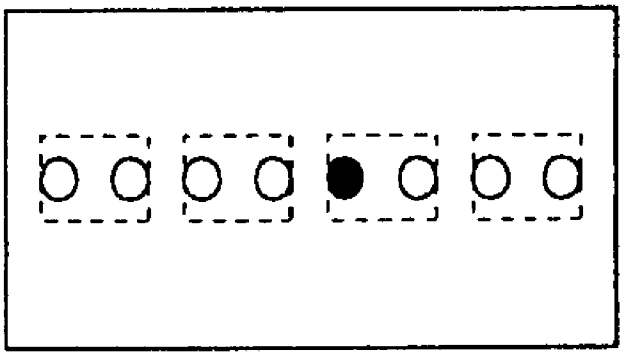
FIGS. 22A and 22B are diagrams showing a manner in which cells are grouped and lit in a type-A sub-frame in the even frame.
Figure 23A:
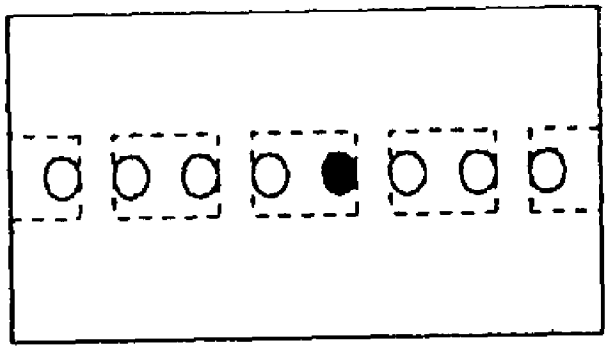
FIGS. 23A and 23B are diagrams showing a manner in which cells are grouped and lit in a type-B sub-frame in the even frame.

First, the manner of grouping cells and lighting grouped cells during the first display period is described. During the first display period in the even frame, even cells are addressed and lit as shown in FIGS. 22A and 23A. In this example, a fourth cell is selected.

Figure 24A:
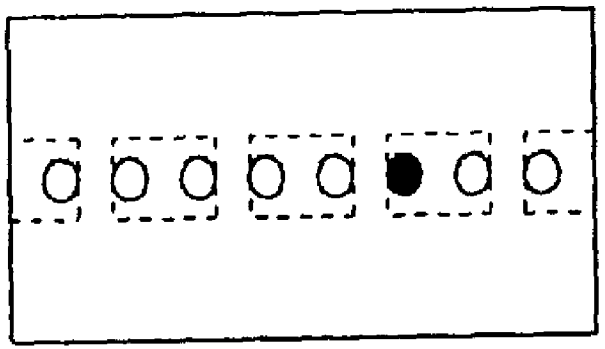
FIGS. 24A and 24B are diagrams showing a manner in which cells are grouped and lit in a type-A sub-frame in the odd frame.
Figure 25A:
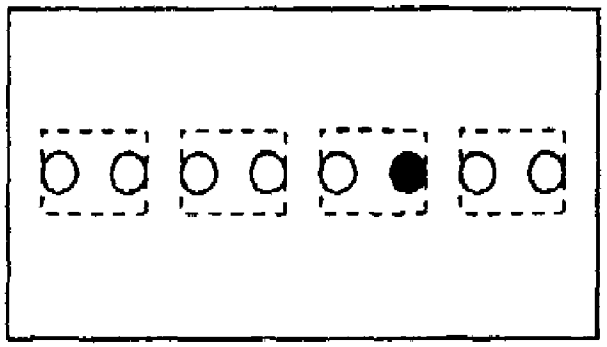
FIGS. 25A and 25B are diagrams showing a manner in which cells are grouped and lit in a type-B sub-frame in the odd frame.

On the other hand, during the first display period in an odd frame, an odd cell is addressed and lit as shown in FIGS. 24A and 25A. In this example, a third cell is selected.

Figure 22B:
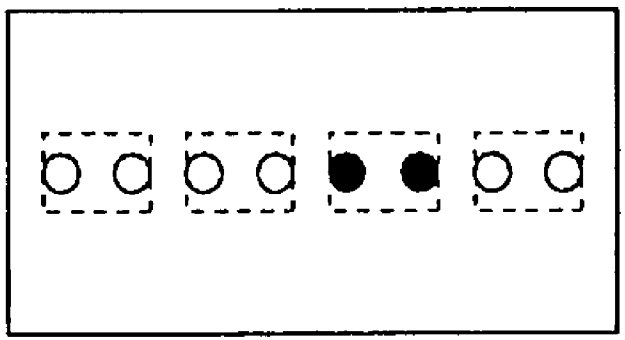
Figure 24B:
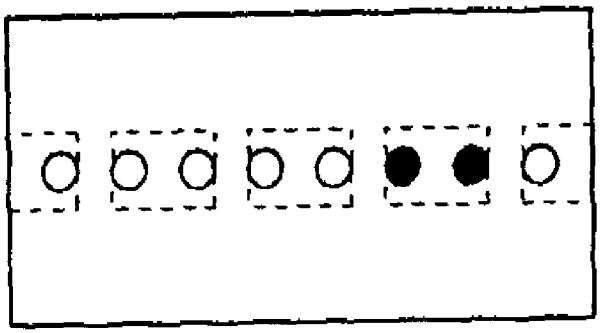

Now, the manner of grouping cells and lighting grouped cells during the second display period is described. During the second display period in the type-A sub-frame, the cell lit during the first display period and a cell adjacent in the upstream direction thereto are simultaneously lit as shown in FIGS. 22B and 24B. In the example shown in FIG. 22B, the fourth cell and the cell at the upper side thereof are lit, while in the example shown in FIG. 24B, the third cell and the cell at the upper side thereof are lit.

Figure 23B:
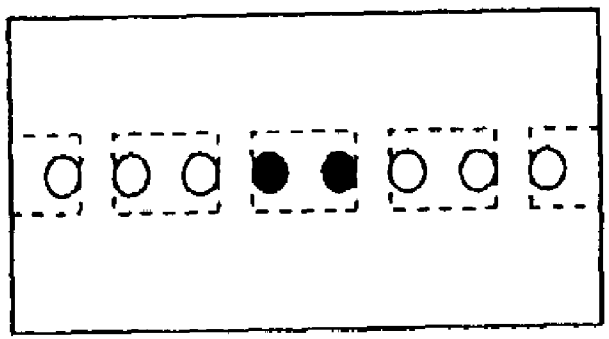
Figure 25B:
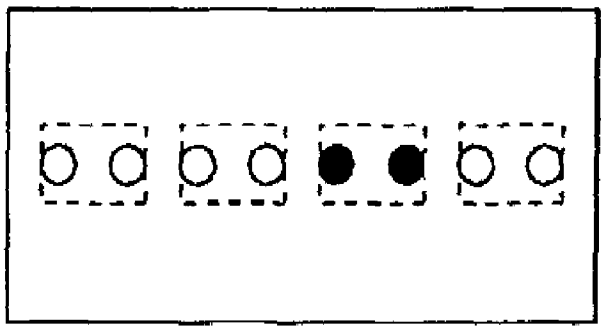

On the other hand, during the second display period in the type-B sub-frame, the cell lit during the first display period and an adjacent cell at the downstream side thereof are simultaneously lit as shown in FIGS. 23B and 25B. In the example shown in FIG. 23B, the fourth cell and the cell at the lower side thereof are lit, while in the example shown in FIG. 25B, the third cell and the cell at the lower side thereof are lit.

In order to group cells and lit cells in units of groups in the manner described above with reference to FIGS. 22 to 25, driving pulses with waveforms shown in FIGS. 26, 28, 30, and 32 are applied in respective four types of sub-frames. In response to applying such driving pulses, the states of cells on the PDP in the respective sub-frames become as shown in FIGS. 27, 29,31, and 33.

Figure 26:
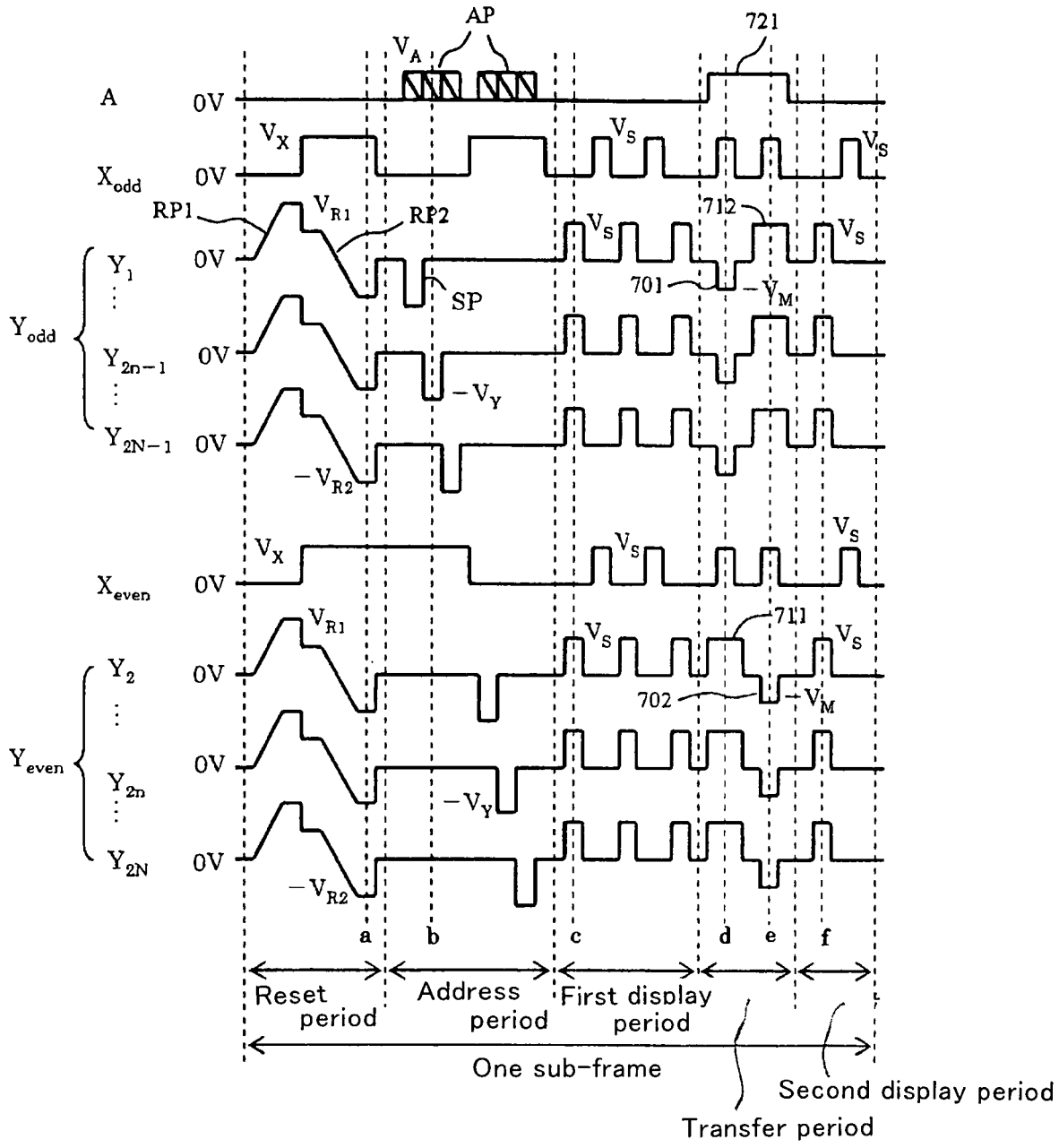
FIG. 26 is a diagram showing driving waveforms used in the type-A sub-frame in the even frame.
Figure 27:
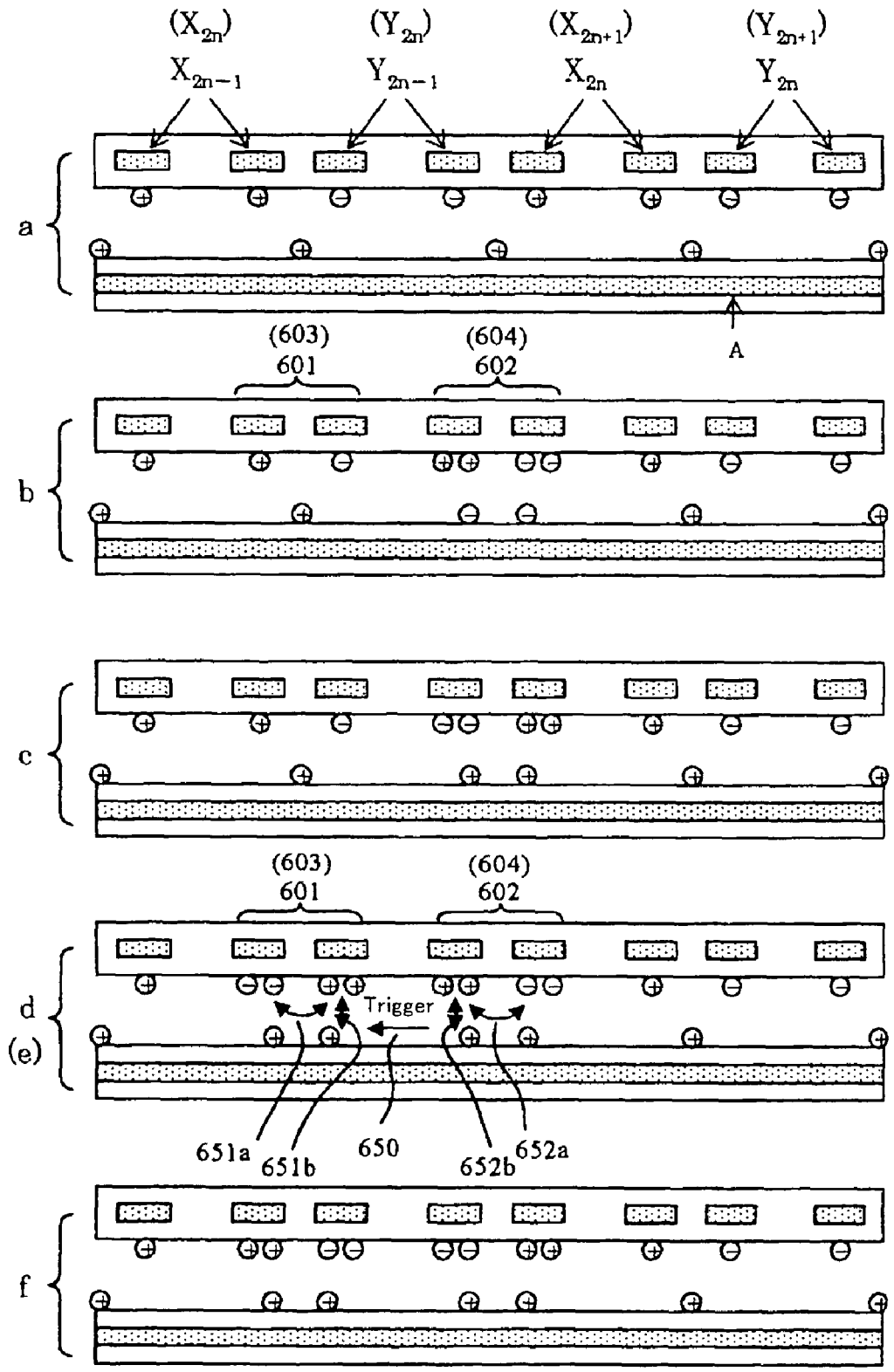
FIG. 27 is a diagram showing operating states of cells lit in the type-A sub-frame in the even frame.

FIG. 26 shows the waveforms of a first set of driving pulses used in a type-A sub-frame in the even frame, and FIG. 27 shows operating states of cells lit in this sub-frame.

Referring to the waveforms shown in FIG. 26, the wall charges in all cells are initialized (into the same state) by applying two types of ramp voltages RP1 and RP2.

Thereafter, in order to sequentially address only those cells at one side of each Y electrode pair in the address period, the display electrode pairs are grouped into a group of even X electrode pairs $X_{even}$ and a group of odd X electrode pairs $X_{odd}$. When odd Y electrode pairs $Y_{odd}$ ($Y_1$ to $Y_{2N-1}$) are sequentially addressed in the first half of each address period, the voltage applied to the odd X electrode pairs $X_{odd}$ is lowered so that no address discharge occurs at upstream sides of Y electrode pairs, while the voltage applied to the even X electrode pairs $X_{even}$ is increased so that an address discharge occurs at downstream sides. On the other hand, when even Y electrode pairs $Y_{even}$ ($Y_2$ to $Y_{2N}$) are sequentially addressed in a second half of each address period, the voltage applied to the even X electrode pairs $X_{even}$ is lowered so that no address discharge occurs at upstream sides of Y electrode pairs, while the voltage applied to the odd X electrode pairs $X_{odd}$ is increased so that an address discharge occurs at downstream sides.

During the first display period after the address period, a sustain pulse is applied so that display charges occur in cells which are located at one side (downstream side) of each Y electrode pair and which were addressed in the address period.

During the transfer period following the first display period, a voltage ($V_M$+Vs, that is, the difference between a voltage $-V_M$ applied to a Y electrode pair and a voltage Vs applied to an X electrode pair) slightly lower than the discharge starting voltage is applied to a cell (such as the cell 601 or 603 shown in FIG. 20) which is adjacent, in the upstream direction, to the addressed cell (such as the cell 602 or 604 shown in FIG. 20) in response to a discharge which was produced in the addressed cell (such as the cell 602 or 604 shown in FIG. 20). That is, the discharge in the addressed cell functions as a trigger which causes a discharge to be started in the cell adjacent, in the upstream direction, to the addressed cell. Thus, the discharge produced in the addressed cell is transferred into a cell at the upstream side of the addressed cell.

To transfer the discharge in the above-described manner, a transfer pulse 701 (with a voltage of $-V_M$) is applied to odd Y electrode pairs $Y_{odd}$ during the first half (step d) of the transfer period, and a transfer pulse 702 (with a voltage of $-V_M$) is applied to even Y electrode pairs $Y_{even}$ during the second half (step e) of the transfer period. In step d described above, discharges are transferred from cells addressed by odd Y electrode pairs $Y_{odd}$, while, in step e, discharges are transferred from cells addressed by even Y electrode pairs $Y_{even}$. In steps d and e, a positive transfer pulse (with a voltage of Vs) is applied to the odd X electrode pairs $X_{odd}$ and the even X electrode pairs $X_{even}$, respectively.

In the transfer period, in order that the discharge may be induced only in cells at the upstream sides without inducing a discharge in cells at the downstream sides, Y electrode pairs are grouped into a group of even Y electrode pairs $Y_{even}$ and a group of odd Y electrode pairs $Y_{odd}$, and driving pulses are applied so that a high voltage is not applied to cells adjacent via a corresponding X electrode pairs (cells at the upstream sides, in this case).

More specifically, in step d, when a negative pulse 701 (with a voltage of $-V_M$) for causing the discharge transfer is applied to the odd Y electrode pair group $Y_{odd}$, a positive pulse 711 is applied to the even Y electrode pair group $Y_{even}$ to suppress the discharge transfer. Similarly, in step e, when a negative pulse 702 (with a voltage of $-V_M$) for causing the discharge transfer is applied to the even Y electrode pair group $Y_{even}$, a positive pulse 712 is applied to the odd Y electrode pair group $Y_{odd}$ to suppress the discharge transfer.

In the discharge transfer process, if a pulse 721 is applied to the address electrode A thereby generating an opposed discharge between the address electrode A and the scanning electrode Y, a further enhancement of the discharge transfer can be achieved. The enhancement of the discharge transfer by this technique will be described in detail later in conjunction with step d shown in FIG. 27.

In the second display period following the transfer period, a sustain pulse is applied so that a display discharge occurs in the respective cell groups each including a cell addressed in the address period (that is, a cell in which the display discharge was produced in the first display period) and an adjacent cell which is adjacent in the upstream direction to the addressed cell and into which the discharge was transferred in the transfer period.

FIG. 27 shows operating states of cells for the case in which, in the type-A sub-frame of an even frame, the cells are driven by the driving signals having the waveforms shown in FIG. 26. In FIG. 27, states a to f correspond to steps a to f shown in FIG. 26.

Furthermore, in FIG. 27, electrodes are denoted in a double way to indicate two types of electrodes in the same figure. That is, $X_{2N-1}$ to $Y_{2N}$ denote electrodes associated with step d while ($X_{2n}$) to ($Y_{2n+}$) denote electrodes associated with step (e), wherein, in steps other than d and e, the states are similar for both types of electrodes.

Furthermore, cells are also denoted by reference symbols in a double way such that cells 601 and 602 correspond to electrodes $X_{2N-1}$ to $Y_{2N}$ and correspond to step d, while cells (603) and (604) correspond to electrodes ($X_{2N}$) to ($Y_{2n+1}$) and correspond to step (e).

In other figures, electrodes, cells, and steps will be denoted in a similar manner such that those parts denoted by reference symbols described in parentheses correspond to each other, while those parts denoted by reference symbols without being put in parentheses correspond to each other.

In FIG. 27, reference symbol a denotes a state into which cells are brought in the reset period so that the wall charge in all cells are uniformly initialized.

In FIG. 27, reference symbol b denotes a state into which cells are brought in the address period. In this state b, in the specific example shown in FIG. 27, of two cells located at both respective sides of a Y electrode pair, a cell at one side (at the downstream side, in this example) (such as the cell 602 or 604) is addressed (turned on). In this state b, the cell at the upstream side (such as the cell 601 or 603) is not addressed (maintained in the off-state).

In FIG. 27 (and elsewhere in the following description), cells 601 to 605 correspond to cells denoted by similar reference symbols in FIG. 20.

In FIG. 27, reference symbol c denotes a state into which cells are brought in the first display period. In this state c, in order to perform the displaying operation, a sustain discharge is produced in the cell 602 or 604 addressed in step b.

In FIG. 27, reference symbol d (or (e)) denotes a state into which cells are brought in the transfer period. In this state d, the discharge in the addressed cell 602 (or 604) is transferred into the cell 601 (or 603) located at the upstream side of the addressed cell 602 (or 604). In this discharge transfer process, a surface discharge denoted by reference symbol 652*a* is transferred into a surface discharge denoted by reference symbol 651*a*. In this discharge transfer process, if an opposed discharge is produced as denoted by reference symbol 652*b* or 651*b*, it becomes possible to perform the discharge transfer in an easier manner. More specifically, in addition to the surface discharge 652*a*, the opposed discharge 652*b* is produced, and a driving pulse is applied to the cell into which the discharges are to be transferred so that the driving pulse make it possible to simultaneously generate an opposed discharge and a surface discharge. Microscopically, when the surface discharge 652*a* is generated, the opposed discharge 652*b* is generated substantially simultaneously, and immediately thereafter the opposed discharge 651*b* and the surface discharge 651*a* are generated substantially simultaneously. Although such an opposed discharge is not necessarily needed for the discharge transfer, the opposed discharge contributes to a further enhancement of the discharge transfer. This is because the distance between the opposed discharges 652*b* and 651*b* in the respective cells 602 and 601 is smaller than the distance between the surface discharges 652*a* and 651*a*, and thus coupling between opposed discharges can occur easier than coupling between surface discharges.

As for the opposed discharge, only the discharge 652*b* may be generated, although it is more desirable to generate both the opposed discharges 652*b* and 651*b*. When the applied voltage is low, only one opposed discharge may occur.

In FIG. 27, reference symbol d denotes a process in which a discharge is transferred from a cell (such as the cell 602) adjacent at the downstream side to an odd Y electrode pair to a cell (such as the cell 601) adjacent at the upstream side to that odd Y electrode pair, while reference symbol (e) denotes a process in which a discharge is transferred from a cell (such as the cell 604) located at the downstream side of an even Y electrode pair to a cell (such as the cell 603) located at the upstream side of that even Y electrode pair.

In FIG. 27, reference symbol f denotes a state into which cells are brought in the second display period. In this state f, in order to achieve displaying, a sustain discharge is produced in the two cells (601 and 602, or 603 and 604) which were lit in step d or (e).

Figure 28:
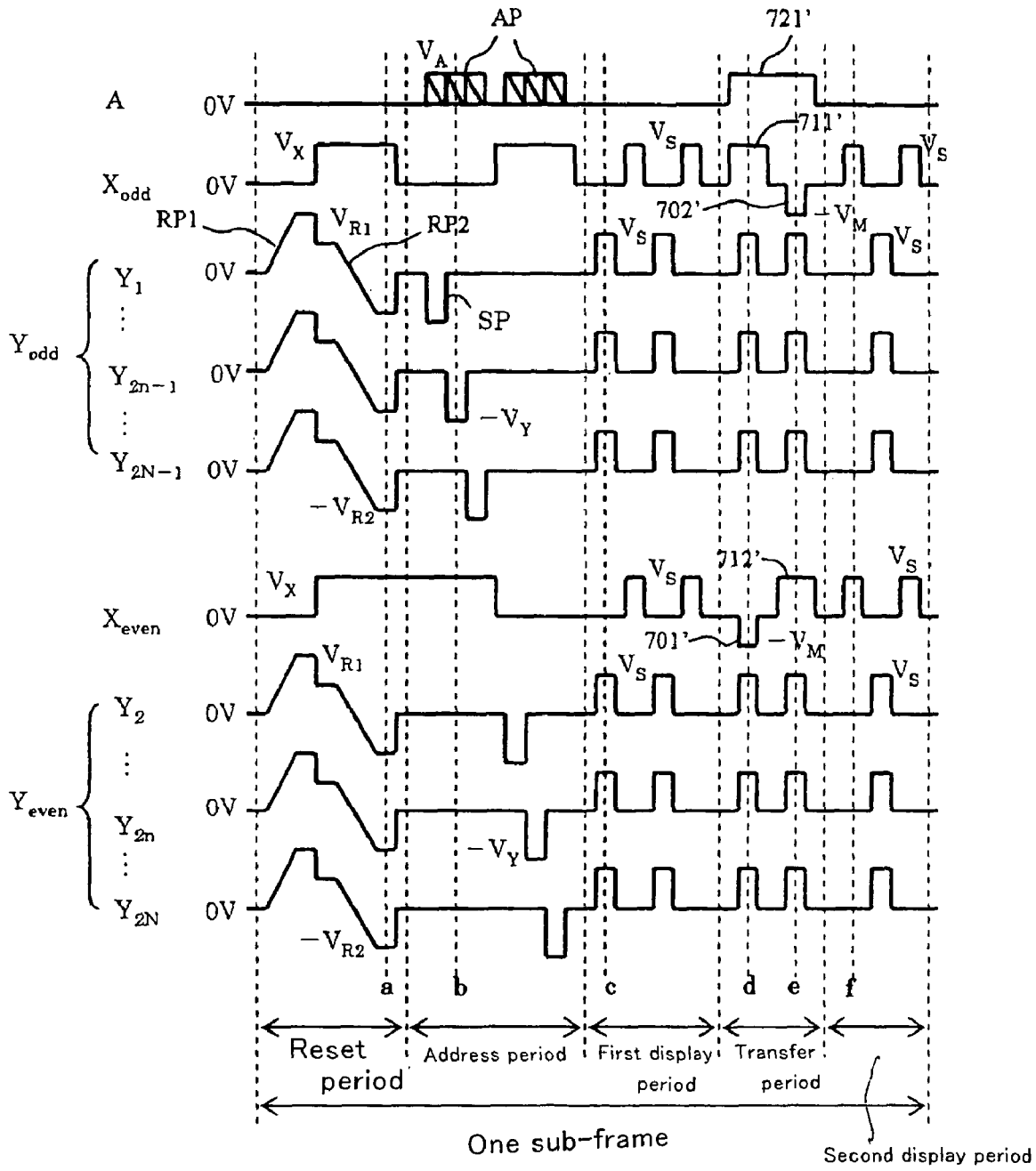
FIG. 28 is a diagram showing driving waveforms used in the type-B sub-frame in the even frame.
Figure 29:
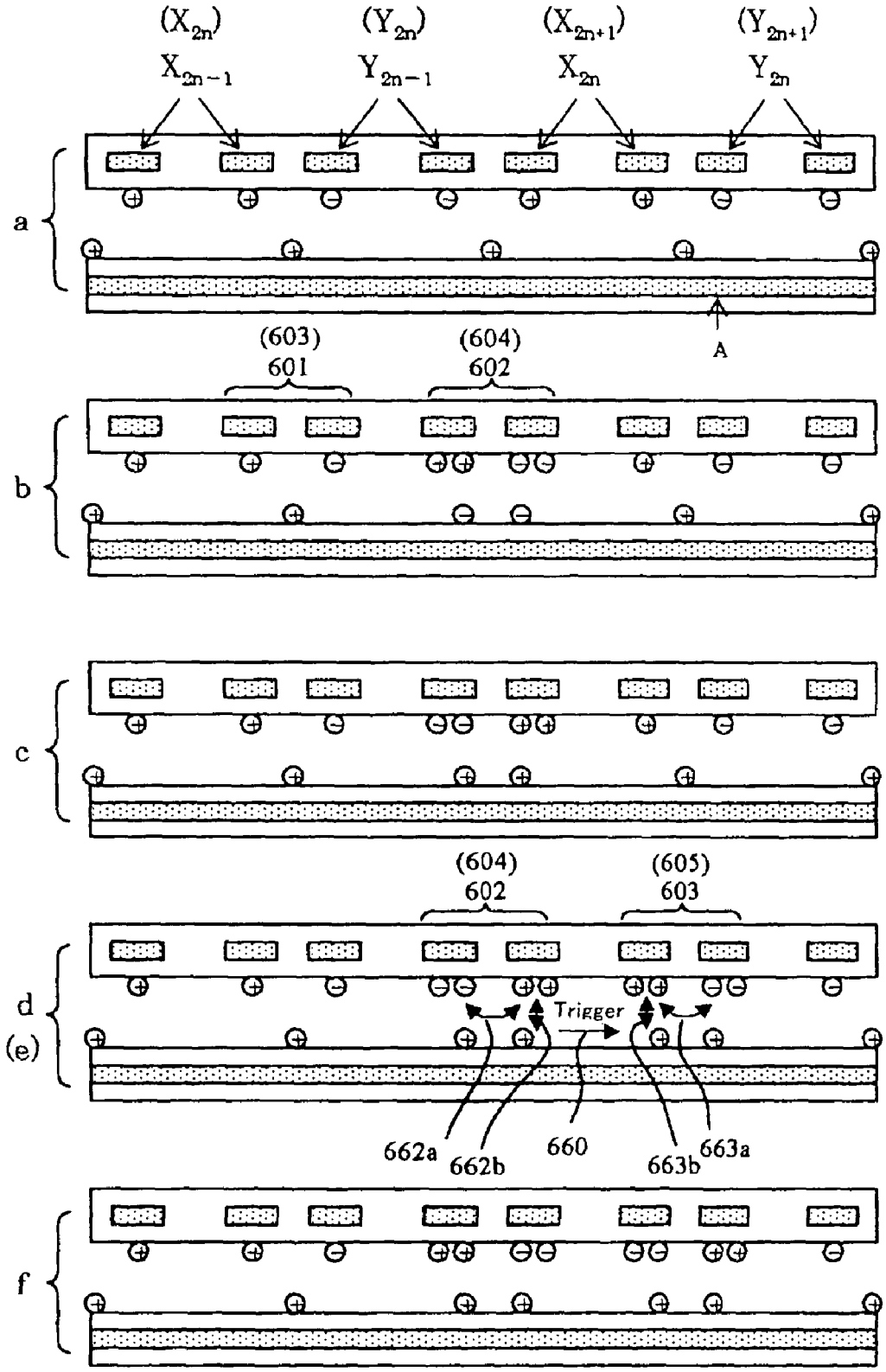
FIG. 29 is a diagram showing operating states of cells lit in the type-B sub-frame in the even frame.

FIG. 28 shows the waveforms of a second set of driving pulses used in a type-B sub-frame in the even frame, and FIG. 29 shows operating states of cells lit in this sub-frame.

In this second type sub-frame (the type-B sub-frame in the even frame), processing is performed in a similar manner to that performed in the first type sub-frame (the type-A sub-frame in an even frame), except that the discharge transfer in the transfer period is performed in an opposite direction. That is, in this second type sub-frame, unlike the first type sub-frame in which the discharge transfer is performed in the upstream direction, the discharge transfer is performed in the downstream direction.

Because of this, there is a difference in waveform in the transfer period between the driving waveform (FIG. 28) employed in the second type sub-frame (the type-B sub-frame in an even frame) and the driving waveform (FIG. 26) employed in the first type sub-frame (the type-A sub-frame in an even frame), and accordingly there is a slight difference in waveform at the end of the first display period and also at the beginning of the second display period.

A transfer pulse 701' (step d) or 702' (step e) for causing a discharge transfer into a downstream cell is applied to the even X electrode pairs $X_{even}$ or the odd X electrode pairs $X_{odd}$ (in the example shown in FIG. 26, transfer pulses 701 and 702 are applied to the Y electrode pairs). At the same time, to suppress the discharge transfer in the upstream direction, a pulse 711' (step d) or 712' (step e) is applied to the odd X electrode pairs $X_{odd}$ or the even X electrode pairs $X_{even}$ (in the example shown in FIG. 26, transfer suppression pulses 711 and 712 are applied to the Y electrode pairs).

In the discharge transfer process, if a pulse 721' is applied to the address electrode A thereby generating an opposed discharge between the address electrode A and the scanning electrode Y, a further enhancement of the discharge transfer can be achieved, as will be described later in conjunction with step d in FIG. 29.

In the second type sub-frame (the type-B sub-frame in an even frame), cells to be lit are driven in a different manner in the transfer period (step d or (e)) (as shown in FIG. 29) from the manner in which cells are driven in the first type sub-frame (the type-A sub-frame in an even frame) (shown in FIG. 27), and accordingly there is a difference in the driving operation to light the cells in the second display period (step f). In the other steps a to c, the operating states of the cells are similar to those shown in FIG. 27.

When the discharge in the cell (602 or 604) which was addressed in step b and lit in step c is transferred into the cell (603 or 605) at the downstream side, the states of cells become as shown in d or (e) of FIG. 29. When the surface discharge 662*a* is transferred into the surface discharge 663*a*, it is desirable to use two opposed discharges 662*b* and 663 or at least one opposed discharge 662*b* as in a similar manner as described above with reference to FIG. 27.

In FIG. 27, reference symbol f denote a state in which a display discharge is maintained in both cells (cells 602 and 603 or cells 604 and 605) turned on in step d or (e).

Figure 30:
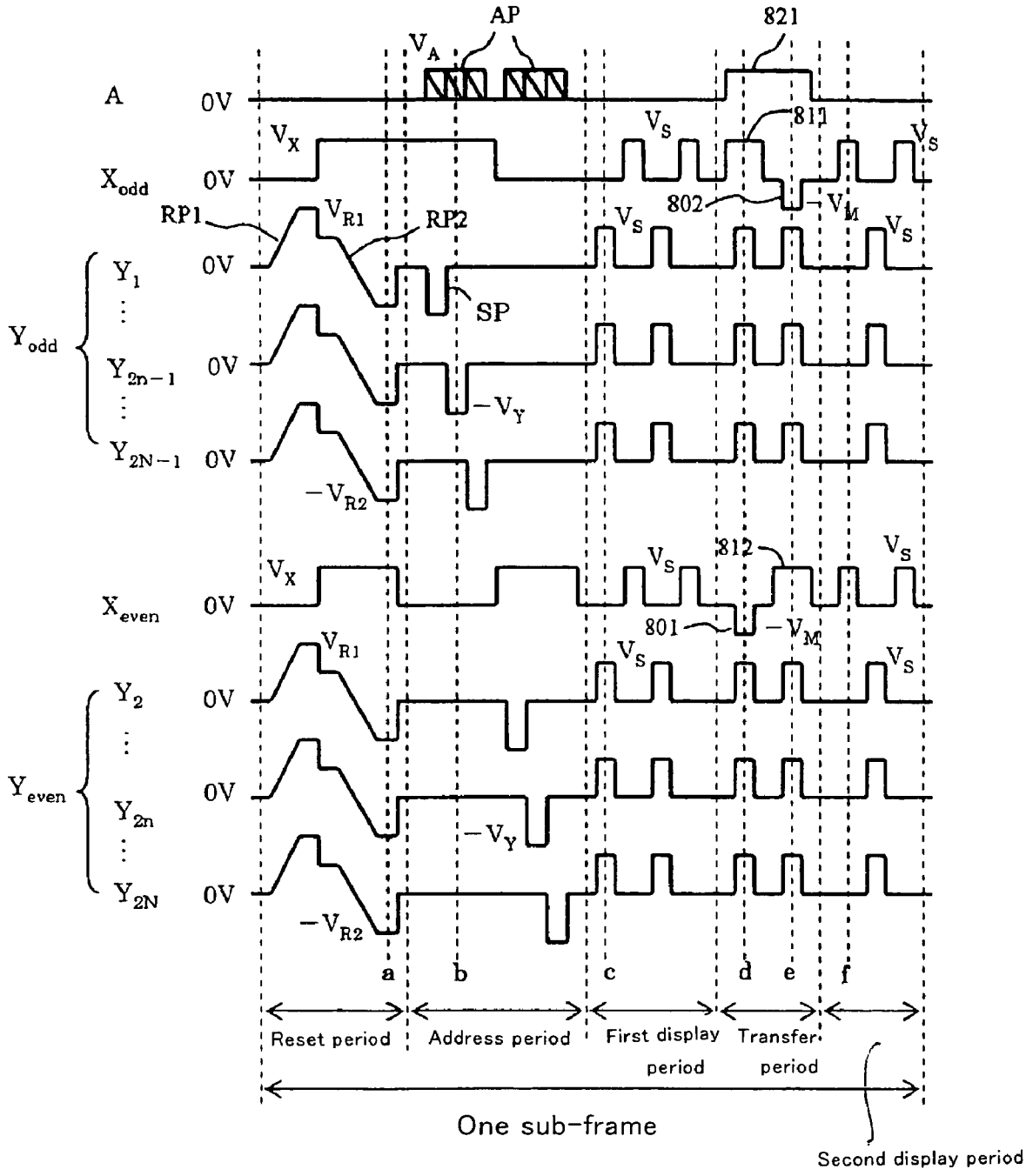
FIG. 30 is a diagram showing driving waveforms used in the type-A sub-frame in the odd frame.
Figure 31:
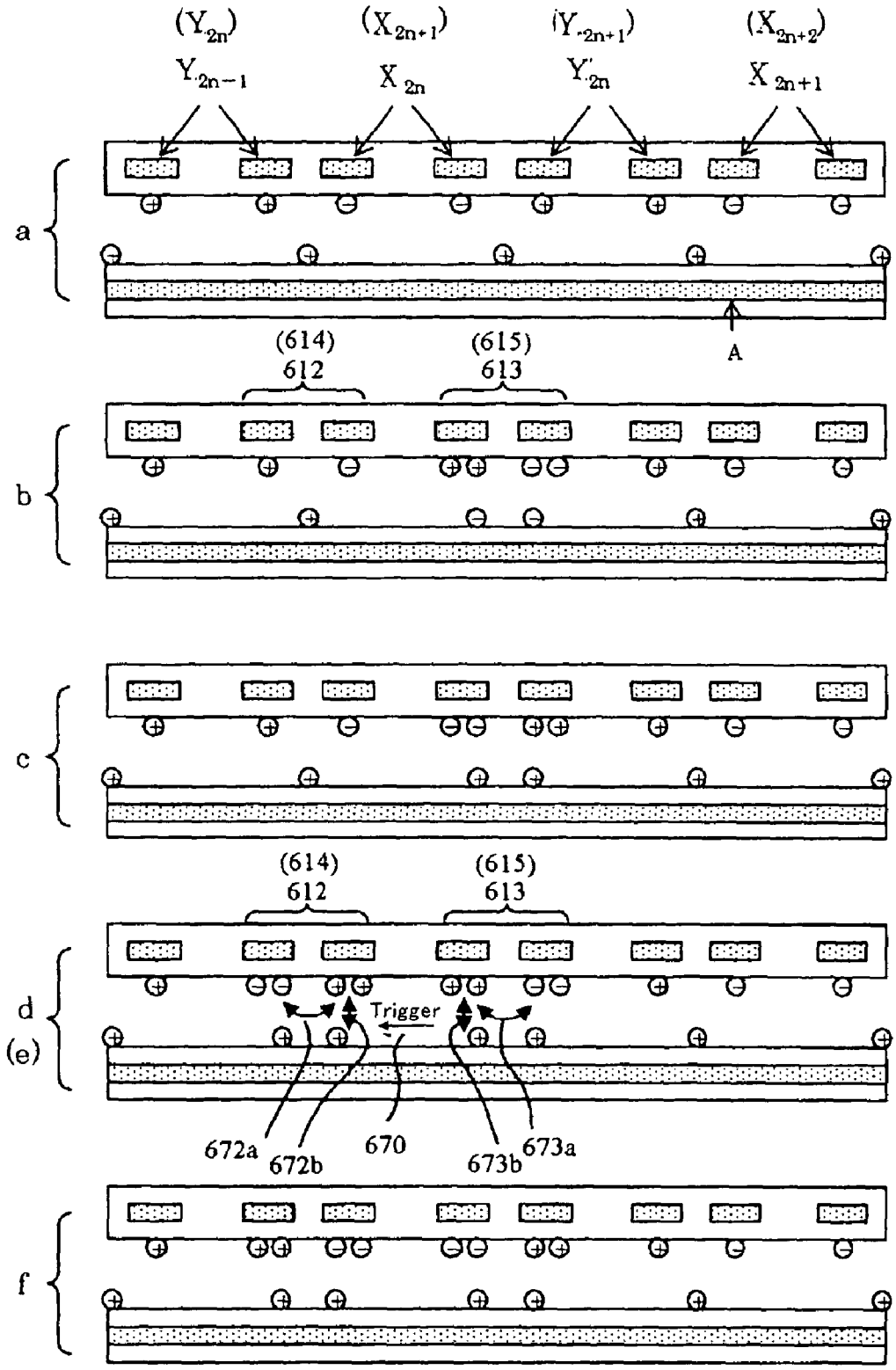
FIG. 31 is a diagram showing operating states of cells lit in the type-A sub-frame in the odd frame.

FIG. 30 shows the waveforms of a third set of driving pulses used in a type-A sub-frame in the odd frame, and FIG. 31 shows operating states of cells lit in this sub-frame.

In this third type sub-frame (the type-A sub-frame in an odd frame), the process is performed in a similar manner as in the first-type sub-frame (the type-A sub-frame in an even frame) except that different types of cells are addressed. More specifically, in the third type sub-frame, unlike the first type sub-frame in which cells in even display lines are addressed, cells in odd display lines of the PDP having the electrode structure shown in FIG. 20 are addressed in the address period.

To address cells in the odd display lines, when odd Y electrode pairs are sequentially addressed in the first half of the address period shown in FIG. 30, a non-selection level voltage (low voltage) is applied to even X electrode pairs $X_{even}$ and a selection level voltage (high voltage) is applied to odd X electrode pairs $X_{odd}$. Furthermore, when even Y electrode pairs are sequentially addressed in the second half of the address period, a non-selection level voltage (low voltage) is applied to odd X electrode pairs $X_{odd}$ and a selection level voltage (high voltage) is applied to even X electrode pairs $X_{even}$.

In the transfer period, in response to addressing the cells in the odd display lines of the PDP having the electrode structure shown in FIG. 20, driving pulses having the waveforms shown in FIG. 30 are applied so that discharges are transferred from addressed cells to adjacent cells adjacent in the upstream direction to the addressed cells. The driving waveform employed herein in the transfer period is similar to that shown in FIG. 28. Although there is a difference in transfer direction, that is, the transfer is performed in the downstream direction in FIG. 28 but in the upstream direction in FIG. 30, there is no difference in the waveform used in the transfer period between FIG. 28 and FIG. 30 because different types of cells are addressed in the address period (electrode pairs are grouped in a different manner).

As can be seen from FIGS. 27 and 31, the operating states of lit cells (FIG. 31) in the third type sub-frame (the type-A sub-frame in an odd frame) are similar to those of lit cells (FIG. 27) in the first type sub-frame (the type-A sub-frame in an even frame), that is, the wall charge pattern is similar to each other. However, there is a difference in the manner in which electrodes are grouped. That is, in the third type sub-frame (the type-A sub-frame in an odd frame), electrodes are grouped so that odd display lines of the PDP having the electrode structure shown in FIG. 20 are addressed, while in the first type sub-frame (the type-B sub-frame in an even frame), electrodes are grouped so that even display lines are addressed.

Figure 32:
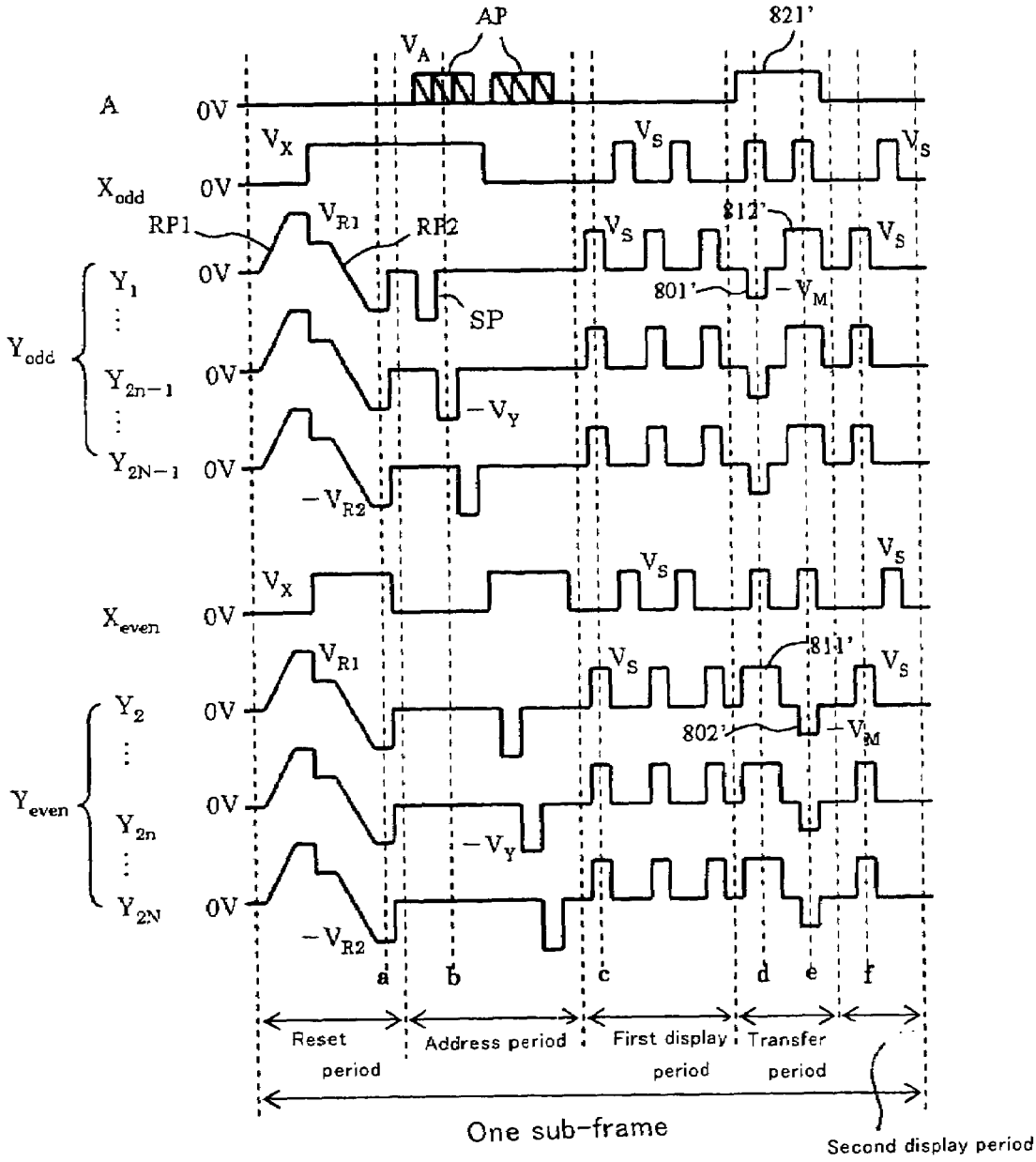
FIG. 32 is a diagram showing driving waveforms used in the type-B sub-frame in the odd frame.
Figure 33:
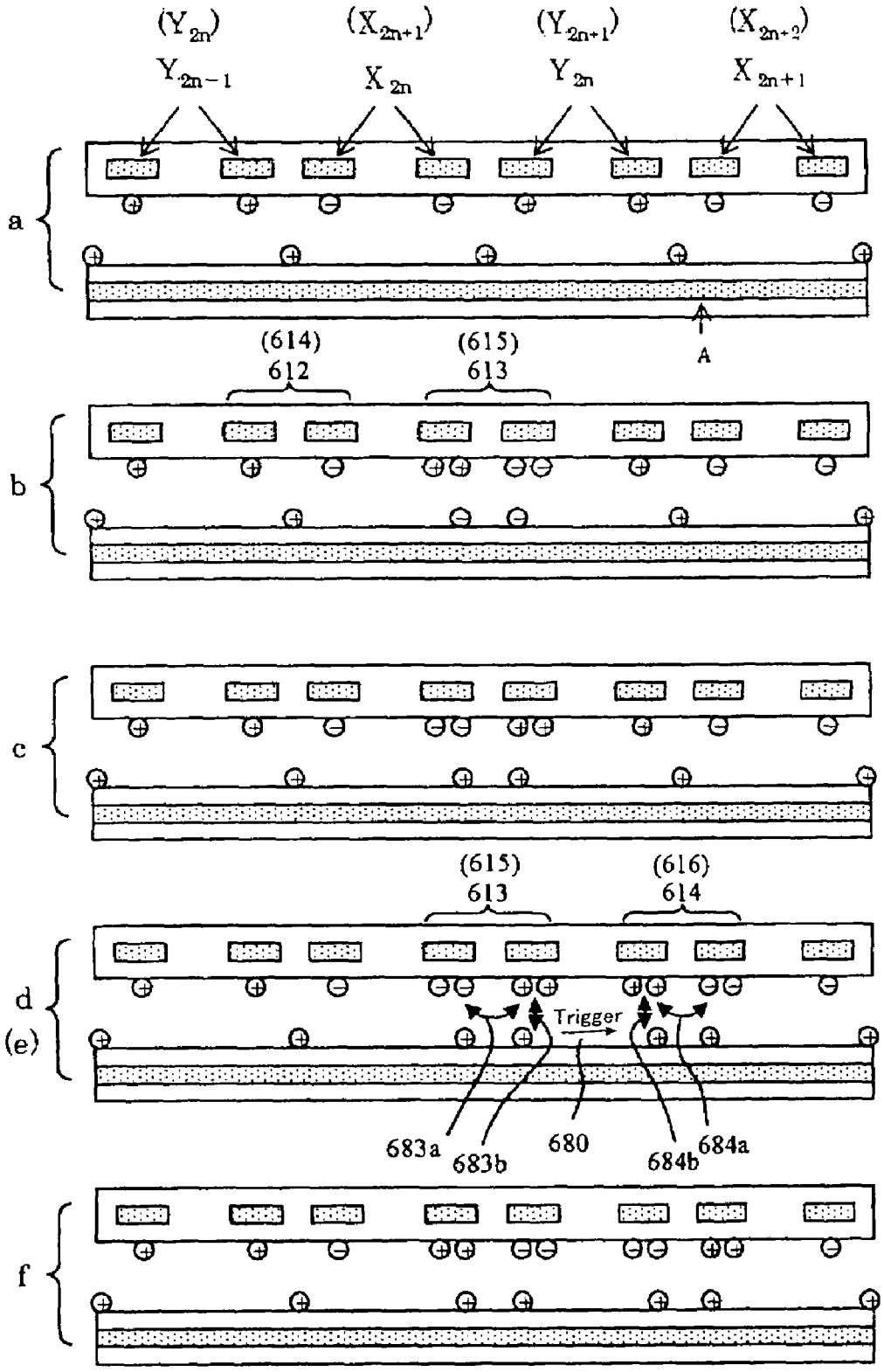
FIG. 33 is a diagram showing operating states of cells lit in the type-B sub-frame in the odd frame.

FIG. 32 shows the waveforms of a fourth set of driving pulses used in a type-B sub-frame in the odd frame, and FIG. 33 shows operating states of cells lit in this sub-frame.

In this fourth type sub-frame (the type-B sub-frame in an odd frame), the process is performed in a similar manner as in the second-type sub-frame (the type-B sub-frame in an even frame) except that different types of cells are addressed. More specifically, in the fourth type sub-frame, unlike the second type sub-frame in which cells in even display lines are addressed, cells in odd display lines of the PDP having the electrode structure shown in FIG. 20 are addressed in the address period.

To address cells in the odd display lines, when odd Y electrode pairs are sequentially addressed in the first half of the address period shown in FIG. 32, a non-selection level voltage (low voltage) is applied to even X electrode pairs $X_{even}$ and a selection level voltage (high voltage) is applied to odd X electrode pairs $X_{odd}$. Furthermore, when even Y electrode pairs are sequentially addressed in the second half of the address period, a non-selection level voltage (low voltage) is applied to odd X electrode pairs $X_{odd}$ and a selection level voltage (high voltage) is applied to even X electrode pairs $X_{even}$.

In the transfer period, in response to addressing the cells in the odd display lines of the PDP having the electrode structure shown in FIG. 20, a driving signal having the waveform shown in FIG. 32 is applied so that discharges are transferred from addressed cells to adjacent cells located at the downstream sides of the addressed cells. The driving waveform employed herein in the transfer period is similar to that shown in FIG. 26. Although there is a difference in transfer direction, that is, the transfer is performed in the upstream direction in FIG. 26 but in the downstream direction in FIG. 32, there is no difference in the waveform used in the transfer period between FIG. 26 and FIG. 32 because different types of cells are addressed in the address period (electrode pairs are grouped in a different manner).

As can be seen from FIGS. 29 and 33, the operating states of lit cells (FIG. 33) in the fourth type sub-frame (the type-B sub-frame in an odd frame) are similar to those of lit cells (FIG. 29) in the second type sub-frame (the type-B sub-frame in an even frame), that is, the wall charge pattern is similar to each other. However, there is a difference in the manner in which electrodes are grouped. That is, in the fourth type sub-frame (the type-B sub-frame in an odd frame), electrodes are grouped so that odd display lines of the PDP having the electrode structure shown in FIG. 20 are addressed, while in the second type sub-frame (the type-B sub-frame in an even frame), electrodes are grouped so that even display lines are addressed.

In the present embodiment, the first display period and the second display period are set such that the ratio thereof becomes substantially constant for all sub-frames, and type-A sub-frames and type-B sub-frames are alternately put in the order of weights of luminance. It is not necessarily needed to put alternately type-A sub-frames and type-B sub-frames, but they may be put randomly. In the case in which the ratio of the first display period to the second display period is set to 1:1, the luminance levels become as shown in FIG. 17B or 18B. It is desirable to determine the ratio of the first display period to the second display period to a proper value depending on the type of the PDP device.

Furthermore, it is desirable to adjust the luminance weights of the respective sub-frames taking into account the luminance of adjacent cells which are lit in the second display period.

In the first and second embodiments described above, electrode pairs are distinguished depending on whether they are odd (odd-numbered) or even (even-numbered) electrode pairs, and display lines are distinguished depending on whether they are odd (odd-numbered) or even (even-numbered) display lines. Note that they are distinguished only for the case in which the electrodes are constructed in the manner shown in FIG. 4 or 20. For a PDP having a different electrode structure (in which, for example, X and Y electrode pairs are replaced with each other), the electrode pairs and display lines should be dealt with differently, for example, in reverse manners.

In the charge transfer operation according to the first embodiment, the charge transfer operation is performed immediately before the display period. In contrast, in the second embodiment, the charge transfer operation is performed in the middle of the display period. However, the charge transfer operation is basically similar and there is no essential difference except for when it is performed, as can be understood from the description of the first and second embodiments.

Third Embodiment

In the first and second embodiments described above, the driving waveforms used in the display period are opposite in phase between X electrode pairs and Y electrode pairs, while the driving waveforms applied to any X electrode pair are the same in phase and the driving waveforms applied to any Y electrode pair are also the same in phase. This causes the display discharge to occur simultaneously in all cells, which results in a high peak discharge current. This is undesirable from the point of view of the operation margin and also the load imposed on the driver. Furthermore, the large discharge current results in large electromagnetic radiation.

Figure 34:
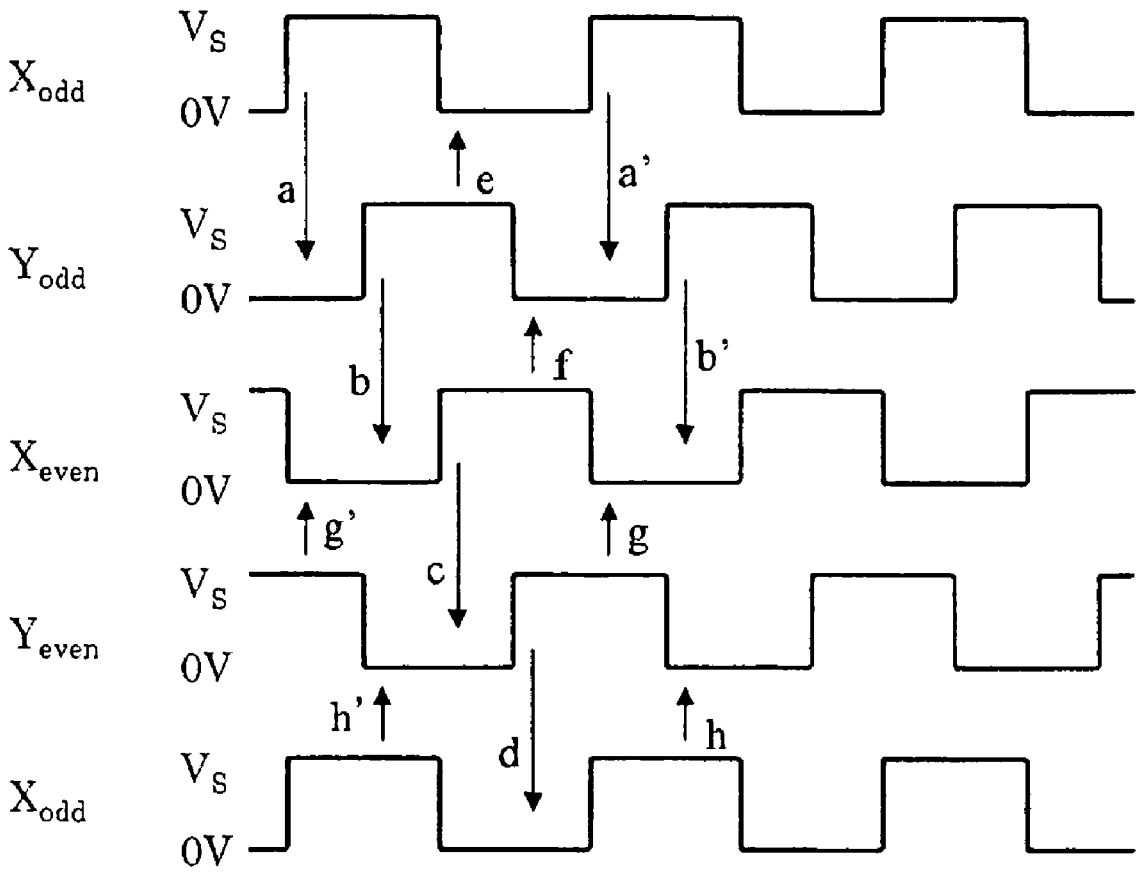
FIG. 34 is a diagram showing driving waveforms used in a display period according to the first embodiment.

To avoid the above problems, driving waveforms shown in FIG. 34 are employed. As shown in FIG. 34, four different driving pulses are applied to four types of electrode pairs $X_{odd}$, $Y_{odd}$, $X_{even}$, and $Y_{even}$, respectively. For ease of understanding of the locations at which discharges occurs, a driving pulse applied to one additional odd X electrode pair $X_{odd}$ is also shown at the bottom of the figure. As shown in FIG. 34, driving pulses applied to odd X electrode pairs $X_{odd}$ and even X electrode pairs $X_{even}$ are opposite in phase, and also opposite between those applied to $Y_{odd}$ and $Y_{even}$. On the other hand, driving pulses applied to adjacent X and Y electrode pairs are different in phase by 90 degrees. By using a plurality of different types of driving waveforms, cells are driven in dispersed fashion, and thus a reduction in the peak current can be achieved. Furthermore, currents flowing in opposite directions result in a reduction in electromagnetic radiation.

In FIG. 34, timings of generation of display discharges are indicated by reference symbols a to h. In one period, display discharges occur in a dispersed fashion at different times indicated by reference symbols a to h. The dispersion causes the discharge current in the same direction at the same point of time to be reduced to an about half level. Besides, for each discharge current, there is an opposite discharge current, and thus a reduction in electromagnetic radiation is achieved. In the example shown in FIG. 34, discharge currents are opposite between a and g', between b and h', between c and e, and between d and f.

Structure of the PDP Device

Figure 35:
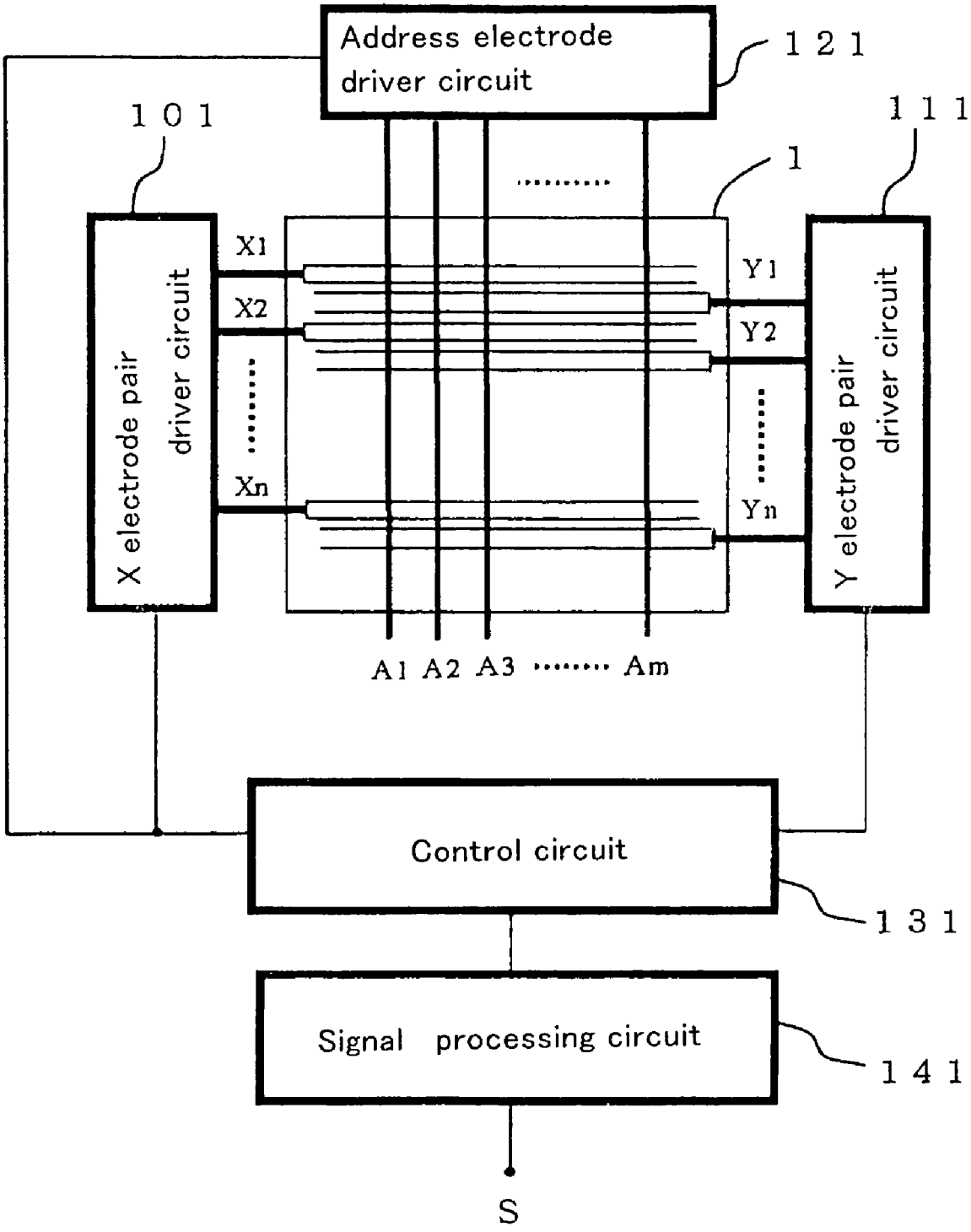
FIG. 35 is a diagram showing a PDP apparatus, which can be employed in any one of the embodiments of the present invention.

The structure of the PDP device usable in the first to third embodiments is shown in FIG. 35.

The PDP device shown in FIG. 35 includes a PDP (denoted by reference numeral 1 in FIG. 35) having the structure shown in the plan view of FIG. 4 or 20 or in the perspective view of FIG. 5, an X electrode pair driver circuit 101 for driving X electrode pairs of the PDP 1, a Y electrode pair driver circuit 111 for driving Y electrode pairs, an address electrode driver circuit 121 for driving address electrodes, a control circuit 131 for controlling those driver circuits, a control circuit 141 for processing a signal S input from the outside and transmitting the resultant signal to a control circuit 131.

In the PDP 1 including X electrode pairs and Y electrode pairs, shown in FIG. 35, the driver circuits 101 and 111 drive the electrode pairs in accordance with any one of the first to third embodiments. The PDP apparatus shown herein can also be employed in a fifth embodiment which will be described later. However, in the fifth embodiment, electrodes are not constructed in the form of electrode pairs but each electrode works singly. Therefore, in the fifth embodiment, the "electrode pairs" including X electrode pairs and Y electrode pairs in the PDP device shown in FIG. 35 should be read as "electrodes", and the "X electrode pair driver circuit 101" and the "Y electrode pair driver circuit 111" should be read as the "X electrode driver circuit 101" and the "Y electrode driver circuit 111", respectively.

Fourth Embodiment

In this fourth embodiment, a technique of improving the structure of the PDP in terms of, for example, the electrodes, the barrier ribs, and the light blocking film, is disclosed. If a panel having one of first to sixth structure described below is used instead of the PDP having the structure shown in FIG. 4 or 20, a further improvement in characteristics or performance of the PDP device can be achieved.

Figure 36:
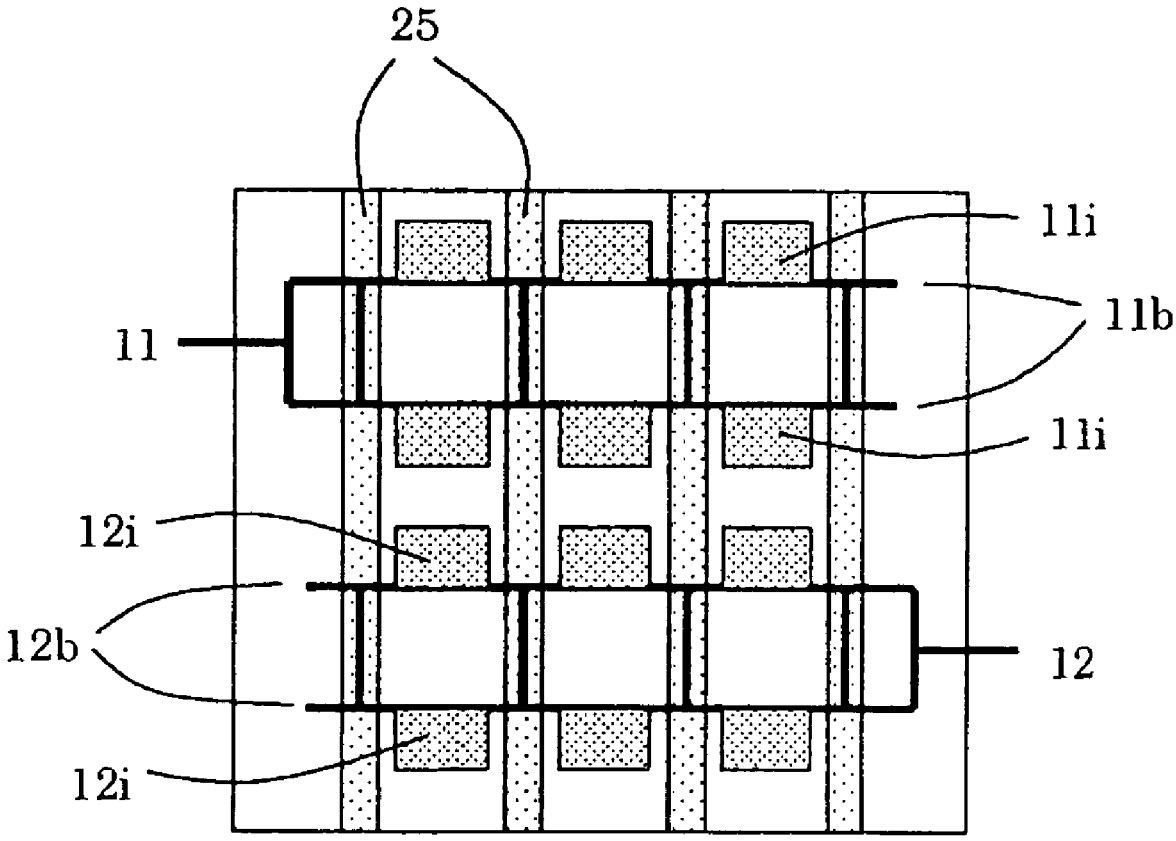
FIG. 36 is a diagram showing a first PDP structure according to a fourth embodiment.

FIG. 36 shows a first PDP structure.

In this structure, two elements forming each of X electrode pairs 11 and Y electrode pairs 12, that is, transparent electrodes 11*i* and 12*i* and bus electrodes 11*b* and 12*b*, are improved.

More specifically, two bus electrodes 11*b* and 12*b* of respective two electrode pairs are electrically connected together in an area outside the display area. In addition, connecting bars are formed on the corresponding barrier ribs 25. Because the connecting bars of the bus electrodes are formed on barrier ribs 25, the connecting bars do not result in degradation in isolation between vertically adjacent cells. Furthermore, in this structure, because bus electrodes are connected in parallel by the connecting bars, a reduction in electric resistance of each electrode pair is achieved. Besides, electrical disconnection does not occur even when a physical disconnection occurs in the bus electrodes.

On the other hand, each of the transparent electrodes 11*i* and 12*i* is divided into a plurality of island-shaped portions which extend outward from the corresponding bus electrode and which are disposed between adjacent barrier ribs. Use of this structure makes it possible to isolate discharges from each other by non-discharge gaps (located between two adjacent bus electrodes) in a more reliable fashion.

Figure 37:
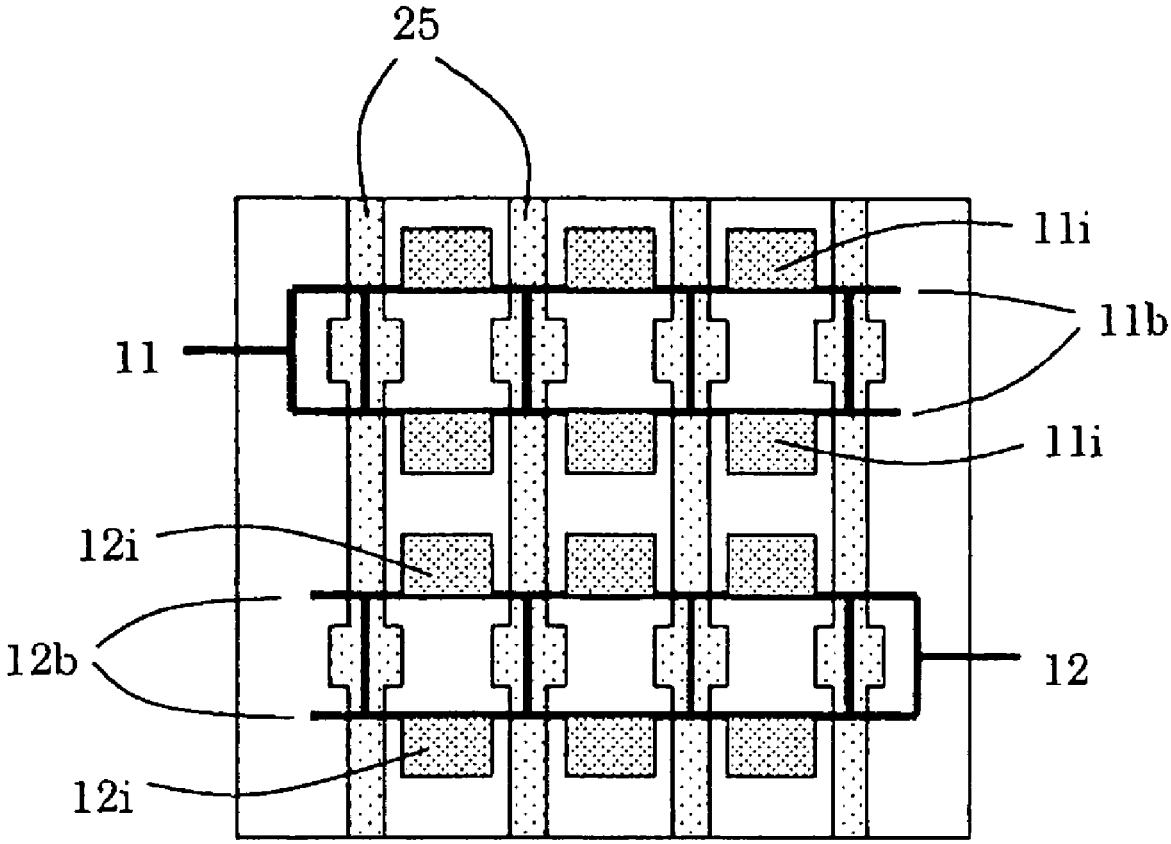
FIG. 37 is a diagram showing a second PDP structure according to the fourth embodiment.

FIG. 37 shows a second PDP structure.

This structure is similar to the PDP structure shown in FIG. 36, except that the width of each barrier rib 25 is increased for portions at locations corresponding to non-discharge gaps. This results in a reduction in coupling between cells, and thus it becomes possible to further reduce the width of non-discharge gaps. Thus, it becomes possible to achieve further improvement in resolution.

Figure 38:
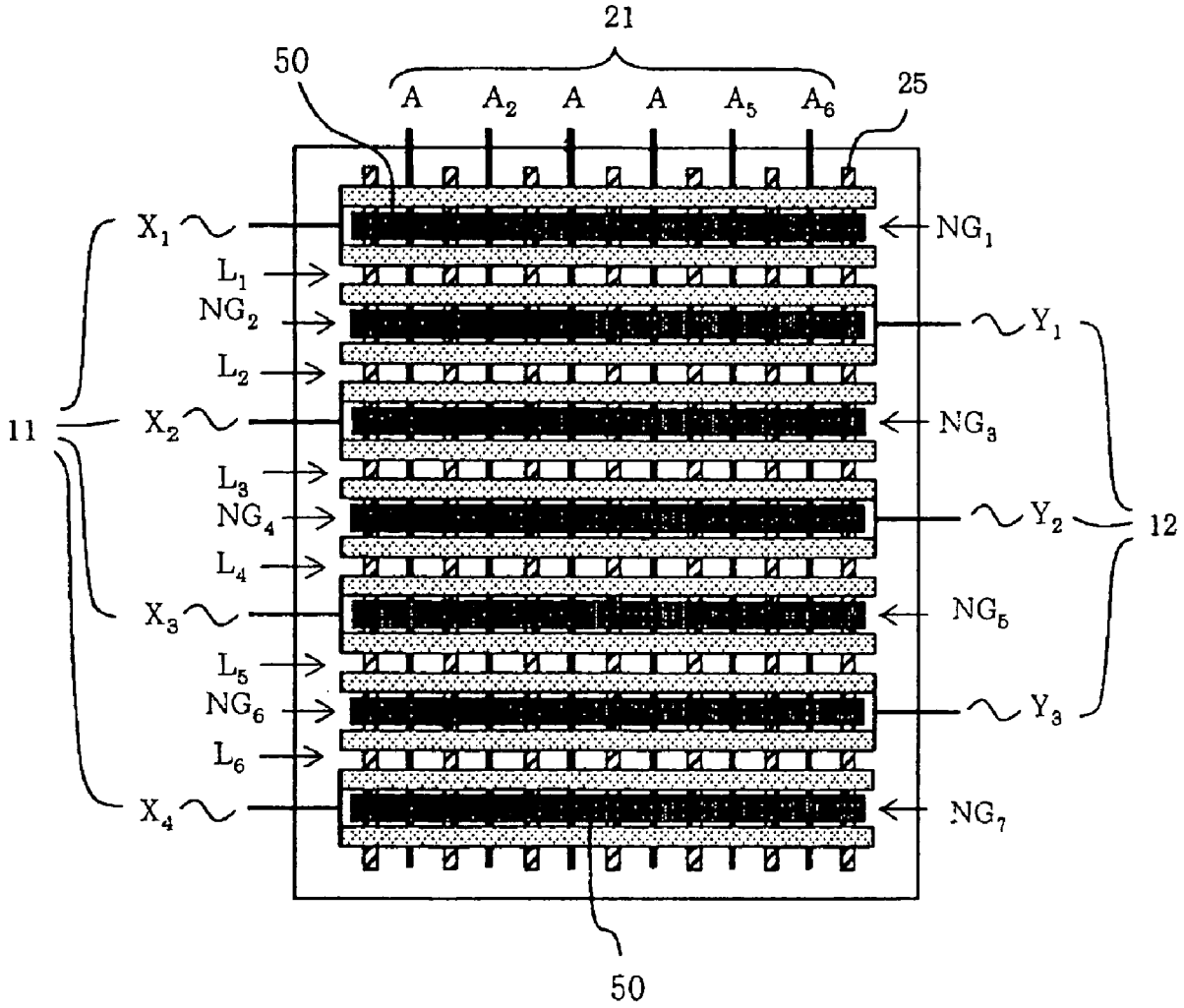
FIG. 38 is a diagram showing a third PDP structure according to the fourth embodiment.

FIG. 38 shows a third PDP structure.

In this structure, light blocking members 50 are additionally formed over the non-discharge gaps of the PDP having the structure shown in FIG. 4 or 20. This results in a reduction in reflection of external light incident on the PDP, and thus an increase in display contrast is achieved.

Figure 39:
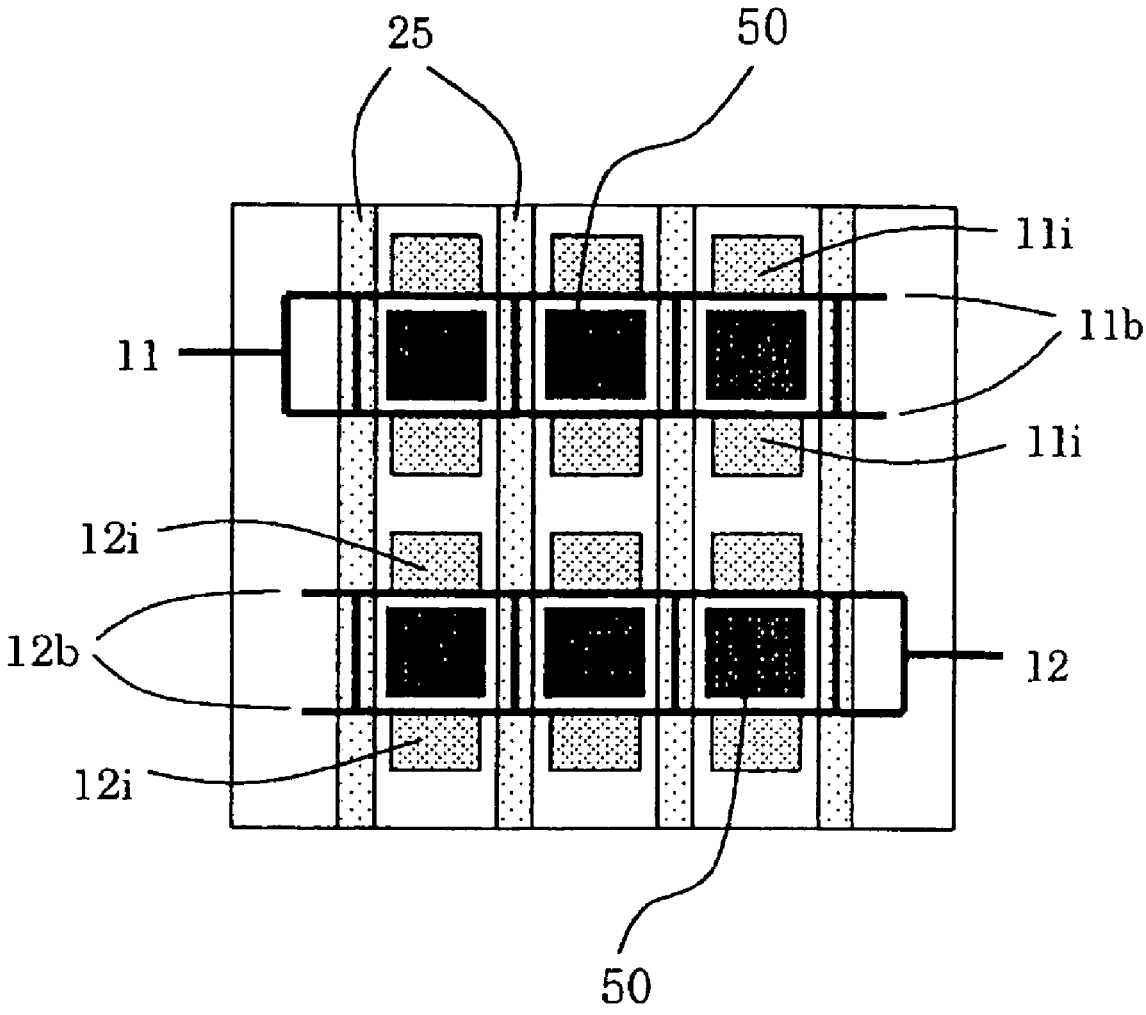
FIG. 39 is a diagram showing a fourth PDP structure according to the fourth embodiment.

FIG. 39 shows a fourth PDP structure.

In this structure, light blocking members 50 are additionally formed in areas surrounded by bus electrodes 11*b* and 12*b*, in the PDP structure shown in FIG. 36. This results in a further reduction in reflection of external light incident on the PDP compared with the PDP structure shown in FIG. 36, and thus a further increase in display contrast is achieved.

Figure 40:
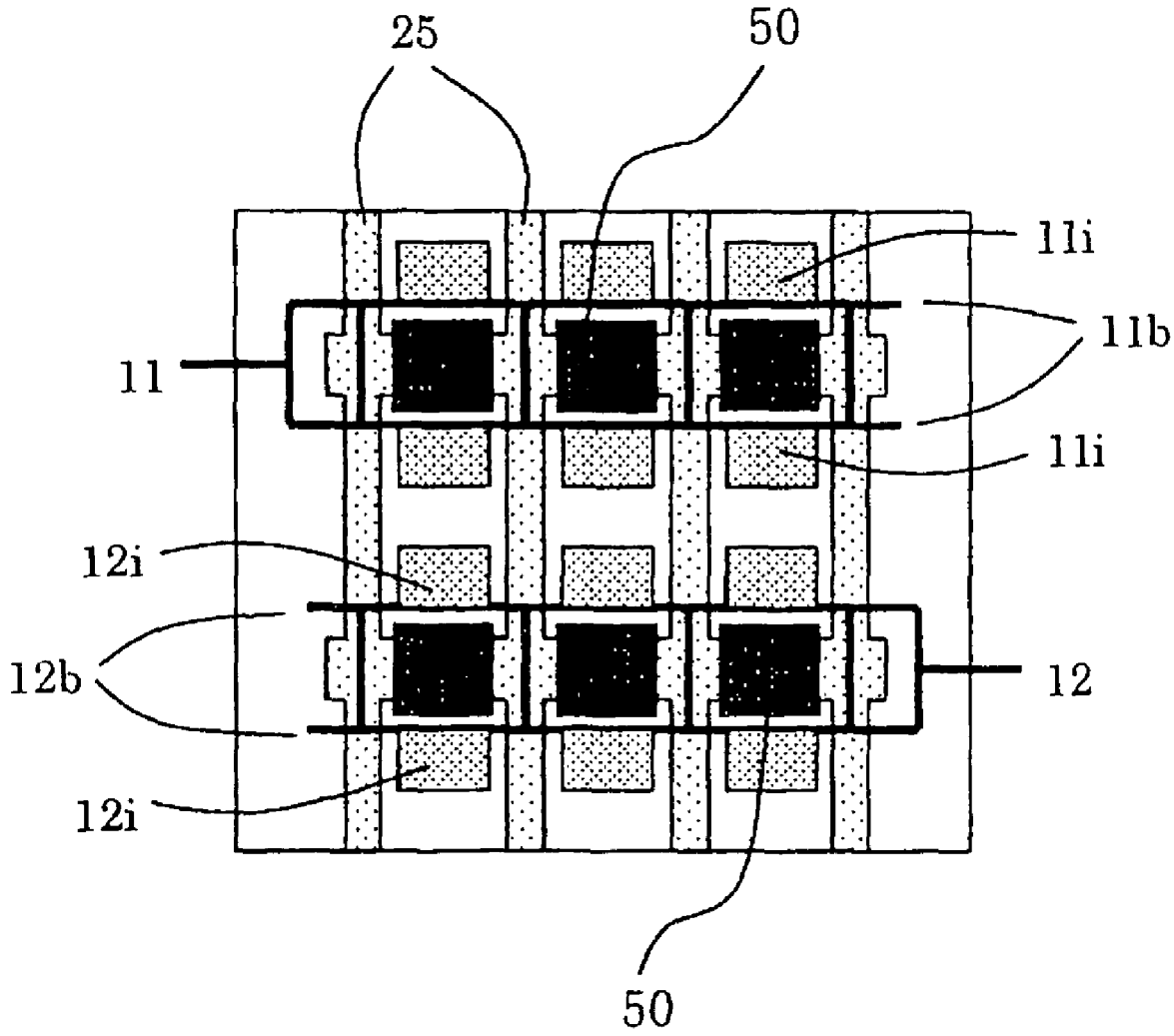
FIG. 40 is a diagram showing a fifth PDP structure according to the fourth embodiment.

FIG. 40 shows a fifth PDP structure.

In this structure, light blocking members 50 are additionally formed in areas surrounded by bus electrodes 11*b* and 12*b*, in the PDP structure shown in FIG. 37. This results in a further reduction in reflection of external light incident on the PDP compared with the PDP structure shown in FIG. 37, and thus a further increase in display contrast is achieved.

Figure 41:
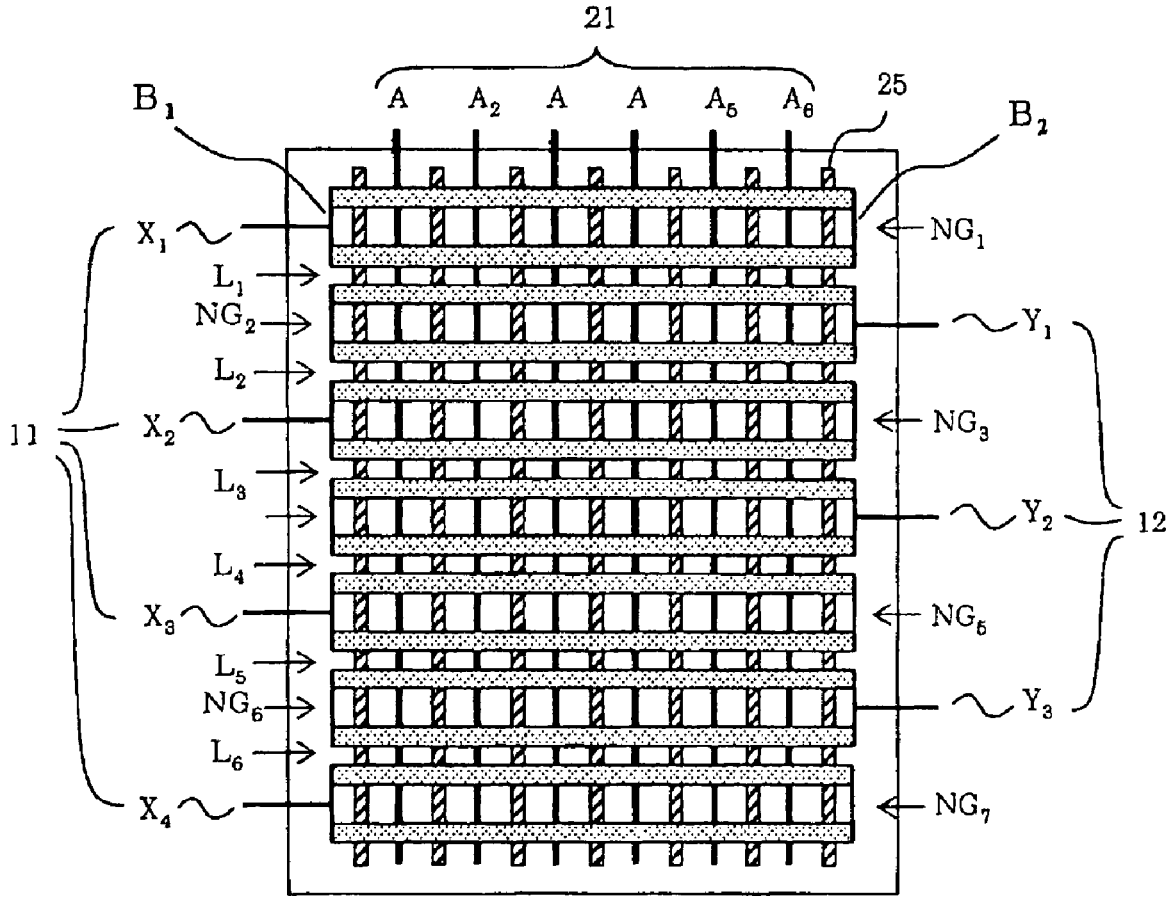
FIG. 41 is a diagram showing a sixth PDP structure according to the fourth embodiment.

FIG. 41 shows a sixth PDP structure.

In this PDP structure, as shown in FIG. 41, two electrodes of an X electrode pair $X_1$ are connected to each other via connecting bars $B_1$ and $B_2$ at both ends. The other X electrode pairs $X_2$ to $X_4$ and also Y electrode pairs $Y_1$ to $Y_3$ are also connected between their two electrodes in a similar manner. In this structure, even if one of two electrodes of some electrode pair is physically broken into two portions, electrically connection is maintained by the connecting bars $B_1$ and $B_2$ at the both ends.

Fifth Embodiment

In the first to third embodiments described above, the PDP structure includes non-discharge gaps.

The present invention may also be applied to a PDP structure including no non-discharge gaps (but including only discharge gaps successively disposed), if the electrode structure and/or the barrier rib structure are modified, as described below, to reduce the coupling between adjacent cell to a proper low level at which desirable small coupling can occur.

Figure 42:
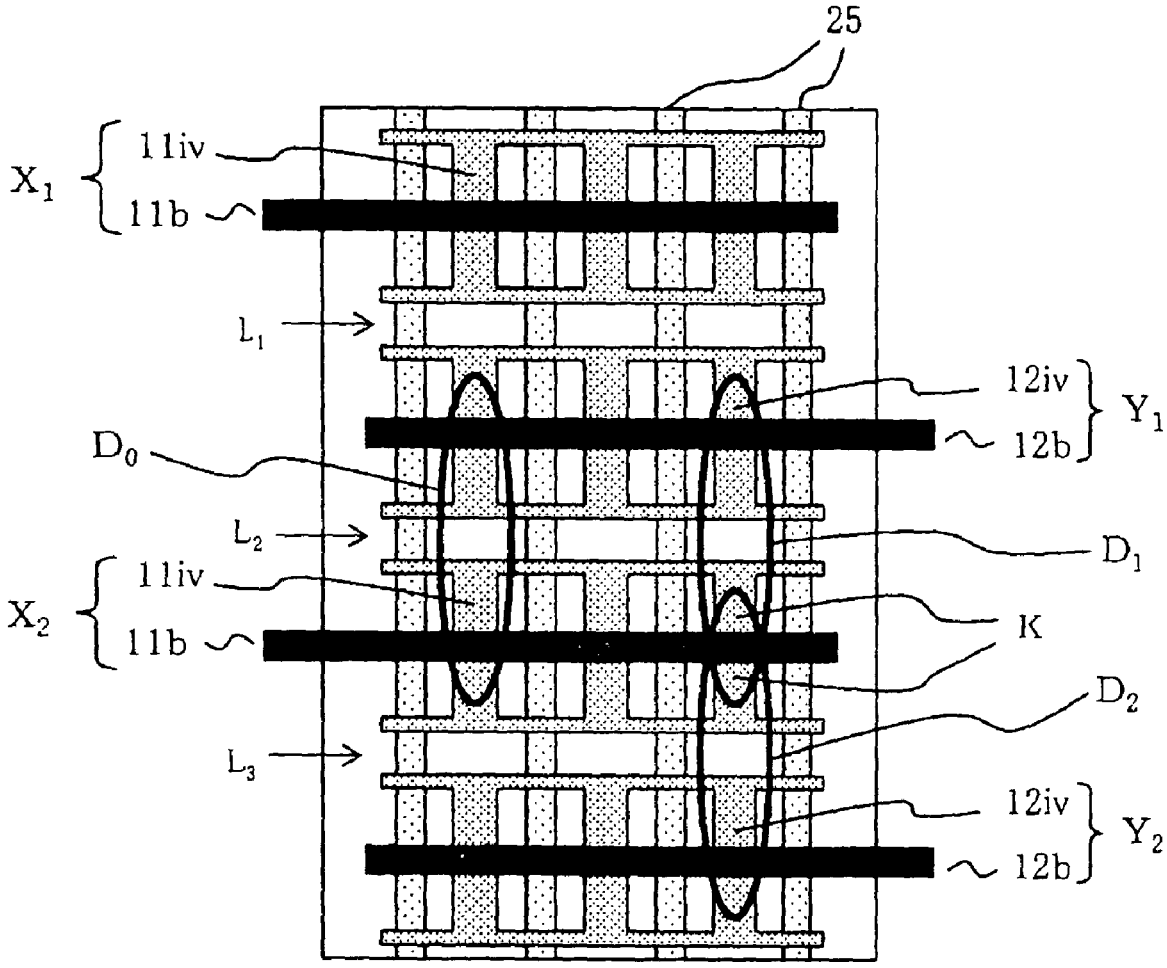
FIG. 42 is a diagram showing interference (coupling) between discharges, which occurs in a fifth embodiment.

If sustain discharges are simultaneously produced in two adjacent discharge gaps (that is, in two cells which are adjacent in the direction crossing the X or Y electrodes) in the PDP structure having no non-discharge gaps, a problem can occur due to interference between two discharges, and this makes it difficult to apply the driving method according to the present invention to such as a PDP structure. FIG. 42 shows an example of a manner in which interference (coupling) occurs between discharges.

The PDP structure shown in FIG. 42 is obtained by partially modifying the shape of transparent electrodes of the X and Y electrodes in the conventional interlace-type PDP shown in FIG. 1. More specifically, in order to reduce the size of the discharge in each cell thereby reducing the coupling (interference) between discharges in adjacent cells, transparent electrodes are formed in cells, as represented by reference symbols 11*iv* and 12*iv*, so as to extend in a direction (vertical direction) crossing the bus electrodes 11*b* and 12*b*. Both end of each of those vertical transparent electrodes are connected to a corresponding horizontal transparent electrode (extending in a direction parallel to lines of the matrix screen, the term "horizontal" is also used to such a direction elsewhere in the following description). Even in this PDP structure having the improved shape of transparent electrodes, discharges in adjacent to cells $D_1$ and $D_2$ overlap with each other as represented by reference symbol K, and thus coupling between discharges can occur. This makes it difficult to generate stable sustain discharges in adjacent two cells.

The above difficulty can be avoided by modifying the PDP structure shown in FIG. 42 so that each discharge occurs in a smaller region thereby reducing (or deleting) the coupling (interference) between discharges.

Figure 43:
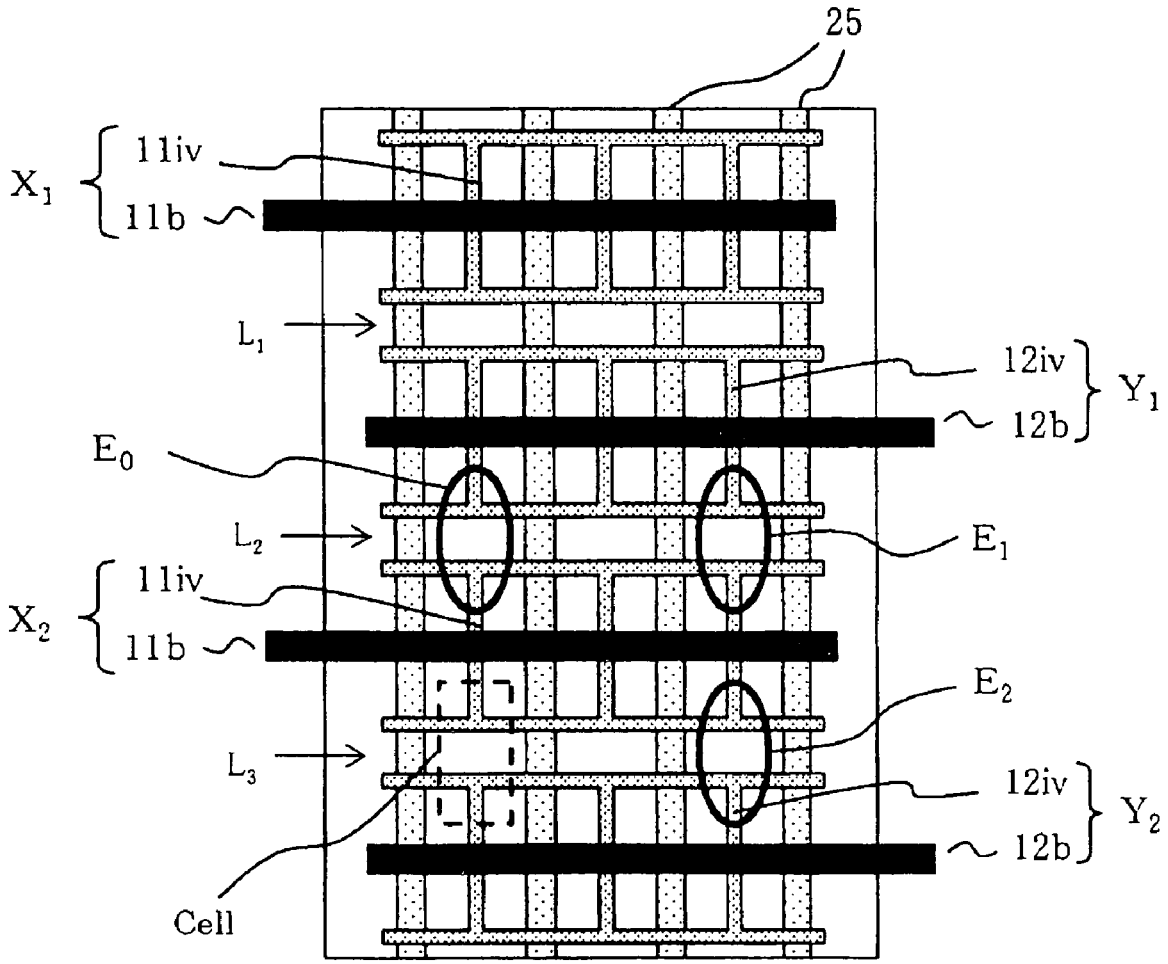
FIG. 43 is a diagram showing a first PDP structure according to the fifth embodiment, and also showing a manner in which discharges occur in this structure.

A first method to achieve the above purpose is to further reduce the width of the vertical transparent electrodes 11*iv* and 12*iv* as shown in FIG. 43. This results in a reduction in size of each discharge cell as represented by reference symbol Cell and also results in a reduction in size of each sustain discharge as represented by reference symbol $E_o$. As a result, discharges in adjacent cells are isolated from each other as represented by reference symbols $E_1$ and $E_2$. Although in the example shown in FIG. 43, only one vertical transparent electrode 11*iv* or $\mathbf{12}_{iv}$ is formed in each space between adjacent barrier rib 25, a plurality of vertical transparent electrodes may be formed.

A second method to achieve the purpose of improvement is to reduce the voltage of the discharge sustain voltage for generating a sustain discharge. This makes it possible to isolate sustain discharges in adjacent cell from each other even in the PDP structure shown in FIG. 42.

By employing both the first and second improvement methods, it is possible to reduce (eliminate) interference (coupling) between discharges in the PDP.

The state in which discharges are isolated from each other in the above-described manner is said to be "spontaneously isolated". If a PDP is capable of generating sustain discharges in the spontaneously isolated fashion, the driving method according to one of the first to third embodiments can be used.

The PDP structure, shown in FIG. 43, capable of generating sustain discharges in the spontaneously isolated is referred to as a first PDP structure. Other PDP structures capable of generating sustain discharges in the spontaneously isolated fashion while maintaining coupling between discharges to a proper degree are described below, wherein those structures will be referred to as second to seventh PDP structures, respectively.

Figure 44:
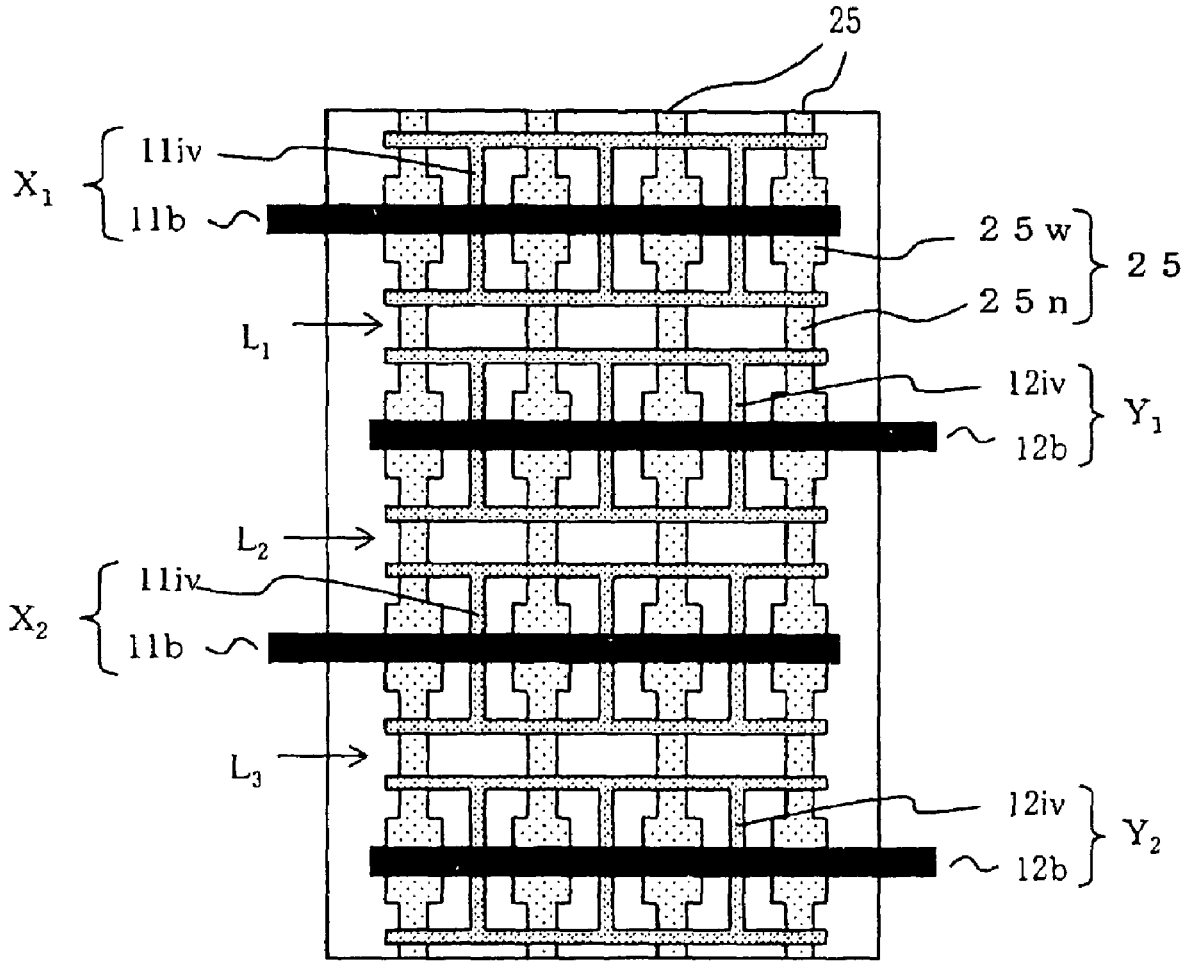
FIG. 44 is a diagram showing a second PDP structure according to the fifth embodiment.

FIG. 44 shows a second PDP structure.

This second PDP structure is obtained by modifying the shape of the barrier ribs 25 in the first PDP structure (FIG. 43). More specifically, the width of each barrier rib 25 is increased between adjacent cells, that is, in a region including a point through which the bus electrode 11*b* or 12*b* extends. That is, each barrier rib is formed so as to have a narrow portion 25*n* and a wide portion 25*w*, wherein the wide portion 25*w* extends from the narrow portion 25*n* into an island-like form. This structure makes it possible to reduce the coupling (interference) between discharges compared with the PDP structure shown in FIG. 43 (first PDP structure).

Figure 45:
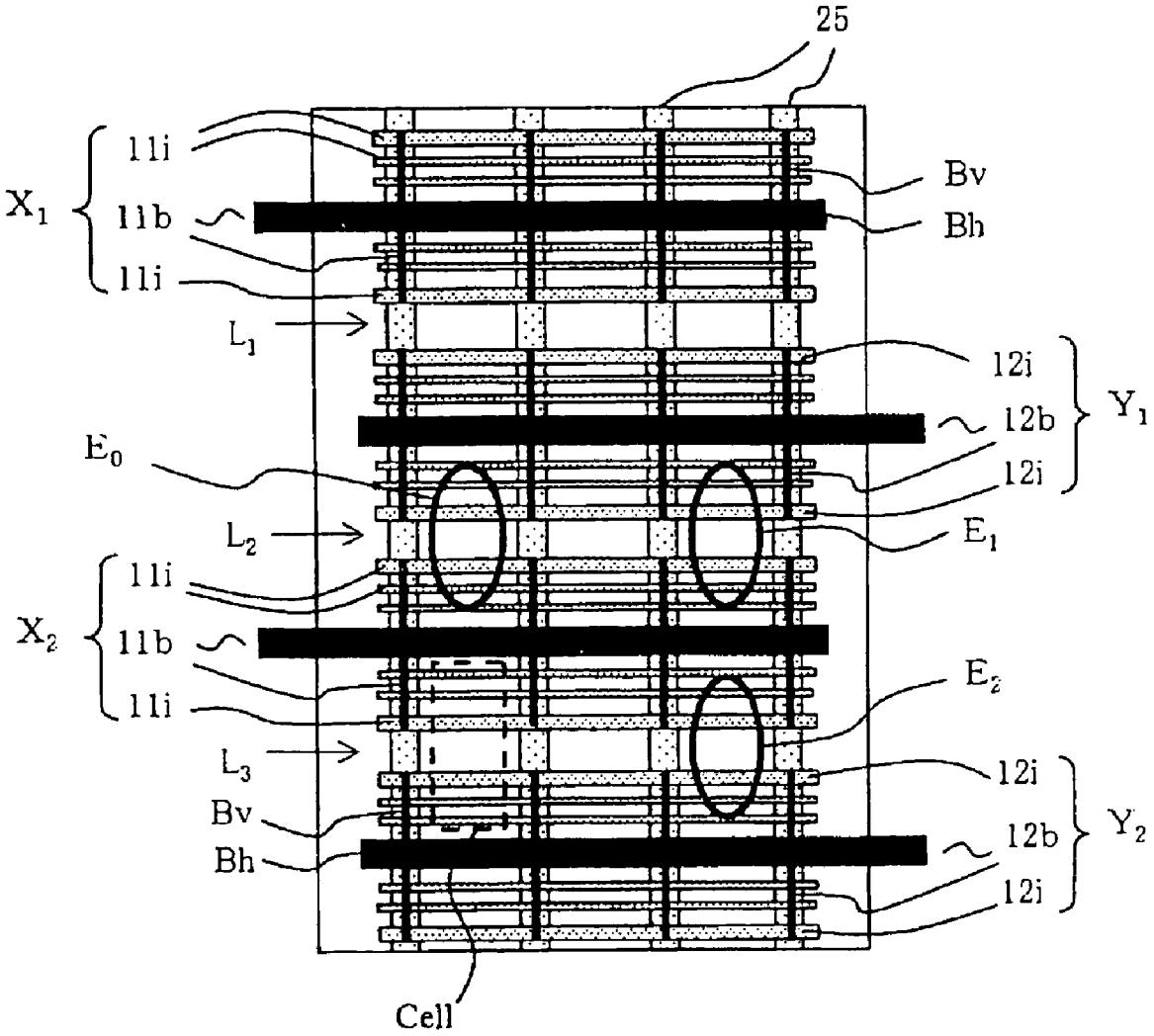
FIG. 45 is a diagram showing a third PDP structure according to the fifth embodiment.

FIG. 45 shows a third PDP structure.

This third PDP structure can be obtained by modifying the shape of the transparent electrodes 11*i* and 12*i*. In this structure, unlike the PDP structure shown in FIG. 43 (first PDP structure), a plurality of transparent electrodes 11*i* and 12*i* are formed such that they are spaced from a corresponding horizontal bus electrode Bh and they extend in a direction parallel to the horizontal bus electrode Bh. Furthermore, each of the bus electrodes 11*b* and 12*b* includes one horizontal bus electrode Bh and a plurality of vertical bus electrodes Bv, wherein the plurality of vertical bus electrodes Bv are respectively formed on corresponding barrier ribs 25 and the plurality of vertical bus electrodes Bv are electrically connected to the barrier ribs 25. The vertical bus electrodes Bv and the plurality of horizontal transparent electrodes are electrically connected to each other.

The PDP structure (third PDP structure) shown in FIG. 45 allows a reduction in coupling (interference) between discharges compared with the PDP structure (first PDP structure) shown in FIG. 43.

Figure 46:
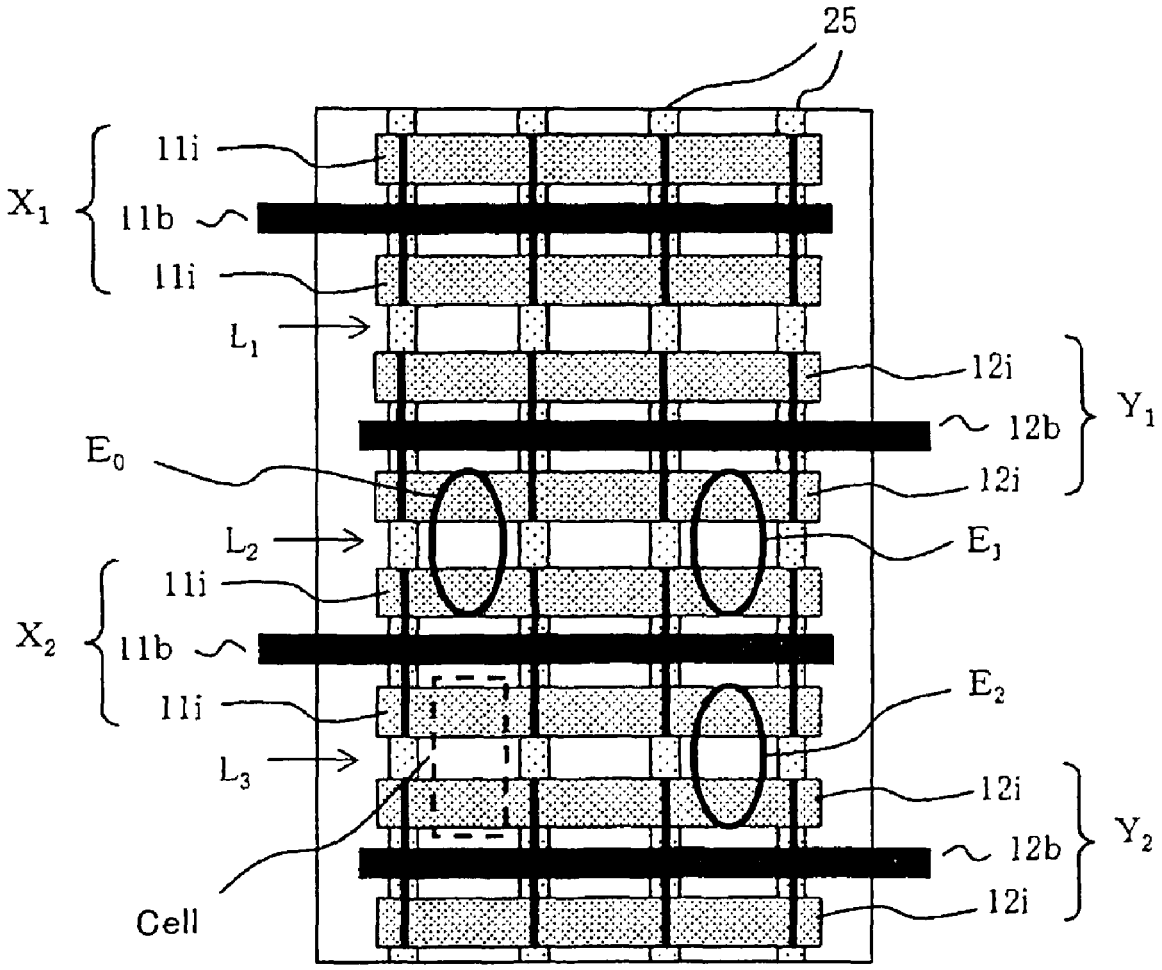
FIG. 46 is a diagram showing a fourth PDP structure according to the fifth embodiment.

FIG. 46 shows a fourth PDP structure.

This PDP structure is obtained by modifying the structure of the transparent electrodes 11*i* and 12*i* in the PDP structure (third PDP structure) shown in FIG. 45 such that two horizontal transparent electrode 11*i* extend in parallel with each bus electrode wherein one horizontal transparent electrode 11*i* is located at one side of the bus electrode and the other horizontal transparent electrode 11*i* is located at the other side. This allows the transparent electrodes to have a simple structure compared with the structure of the transparent electrodes used in the PDP structure (third PDP structure) shown in FIG. 45.

FIG. 47 shows a fifth PDP structure.

Figure 47A:
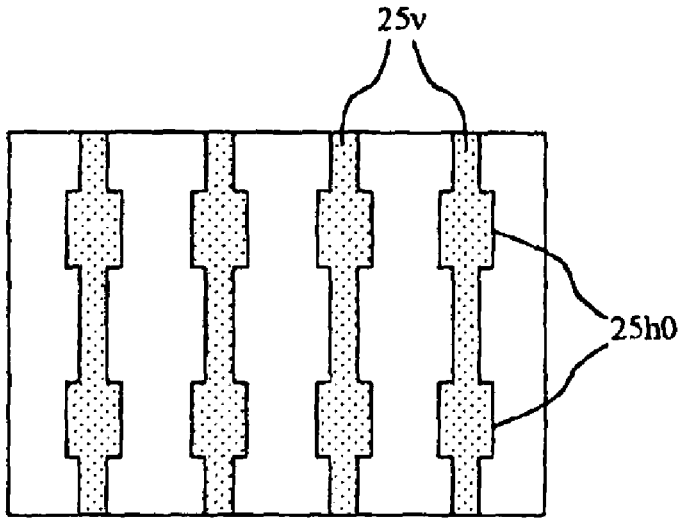
FIGS. 47A to 47C are diagrams showing a fifth PDP structure (rib structure) according to the fifth embodiment.
Figure 47B:
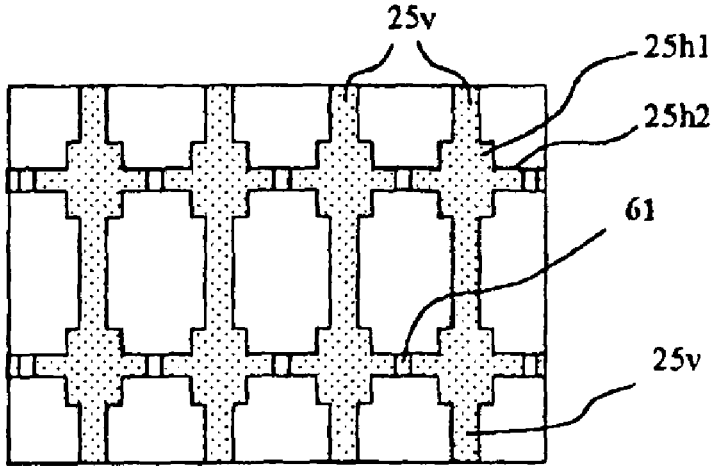
Figure 47C:
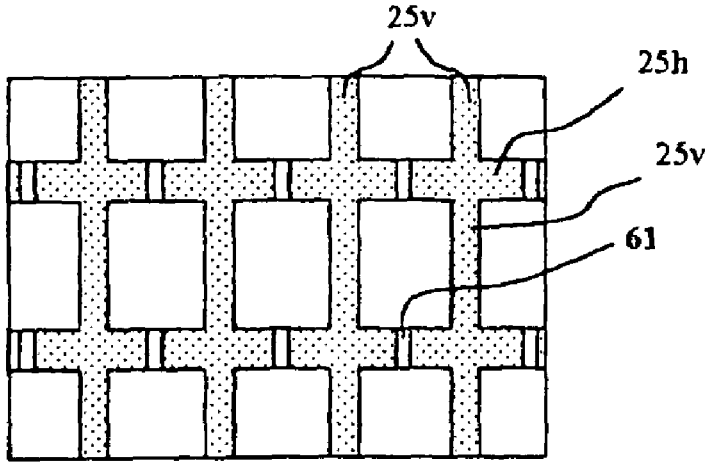

In this fifth PDP structure, the shape of the barrier ribs 25 is modified in one of manners shown in the form of plan views in FIGS. 47A to 47C. Of those, the shape shown in FIG. 47A is similar to that employed in the second PDP structure shown in FIG. 44.

The structures of the barrier ribs shown in FIGS. 47B and 47C allow a further reduction in coupling (interference) between discharges in adjacent cells compared with the structure shown in FIG. 47A. In the structures shown in FIGS. 47B and 47C, barrier rib portions 25*h*2 or 25*h* are formed so as to extend in the horizontal direction (along the display lines of the screen) crossing the vertical direction in which stripe-shaped barrier rib portions 25*v* extend, such that adjacent barrier rib portions 25*v* extending in the vertical direction are connected by the barrier rib portions 25*h*2 or 25*h* extending in the horizontal direction. Each horizontal barrier rib portion 25*h*2 or 25*h* has a gap 61 formed in the middle thereof.

If no gap 61 is formed, coupling (interference) between discharges in adjacent cells is eliminated substantially perfectly. In other words, by forming small gaps 61 as shown in FIG. 47B or 47C, it is possible to obtain proper coupling between discharges. The degree of coupling can be adjusted by varying the size of gaps 61.

The shape of the horizontal barrier ribs is not limited to that denoted by reference symbol 25*h*1 or 25*h*2 in FIG. 47B or that denoted by reference symbol 25*h* in FIG. 47C, but any other shape may be employed as long as adjacent vertical barrier ribs 25*v* are connected with each other by the horizontal barrier ribs each having a gap in the middle thereof.

FIGS. 48A, 48B1, 48B2 and 48B3 show a sixth PDP structure.

This sixth PDP structure is obtained by modifying the cross-sectional shape of the horizontal ribs 25*h* used in the PDP structure (fifth PDP structure) shown in FIGS. 47A to 47C.

FIG. 48A is a plan view showing the structure of the horizontal ribs. In the plan view, as can be seen, the structure is similar to that shown in FIG. 47C (fifth PDP structure). FIGS. 48B1 to 48B3 show examples of cross-sectional structures of the barrier ribs 25*h* and 25*v*, taken along line AA' of FIG. 48A and viewed from a direction denoted by an arrow Ad.

In the structure shown in FIG. 48B1, each horizontal barrier rib 25*h* disposed between two adjacent vertical barrier ribs 25*v* has a small gap 61 at the middle thereof. The degree of coupling between discharges in adjacent cells can be adjusted by varying the size of the gap 61. Each horizontal barrier rib 25*h* disposed between two adjacent vertical barrier ribs 25*v* may have a plurality of gaps 61.

In the structure shown in FIG. 48B2, the horizontal barrier ribs 25*h* are formed so as to have a height smaller than the height of the vertical barrier ribs 25*v* so that steps caused by the height difference serve as gaps which result in proper coupling between discharges in adjacent cells. The steps may be formed at the top and bottom.

In the structure shown in FIG. 48B3, a small recess 62 is formed at the center of the upper or lower surface of each horizontal barrier rib 25*h* disposed between two adjacent vertical barrier ribs 25*v*, so that the recess 62 results in proper coupling between discharges in adjacent cells. A plurality of recesses 62 may be formed on the upper or lower surface of each horizontal barrier rib 25*h* disposed between two adjacent vertical barrier ribs 25*v*. Furthermore, the recess 62 may be formed on both upper and lower surfaces of each horizontal barrier rib 25*h*.

Figure 49A:
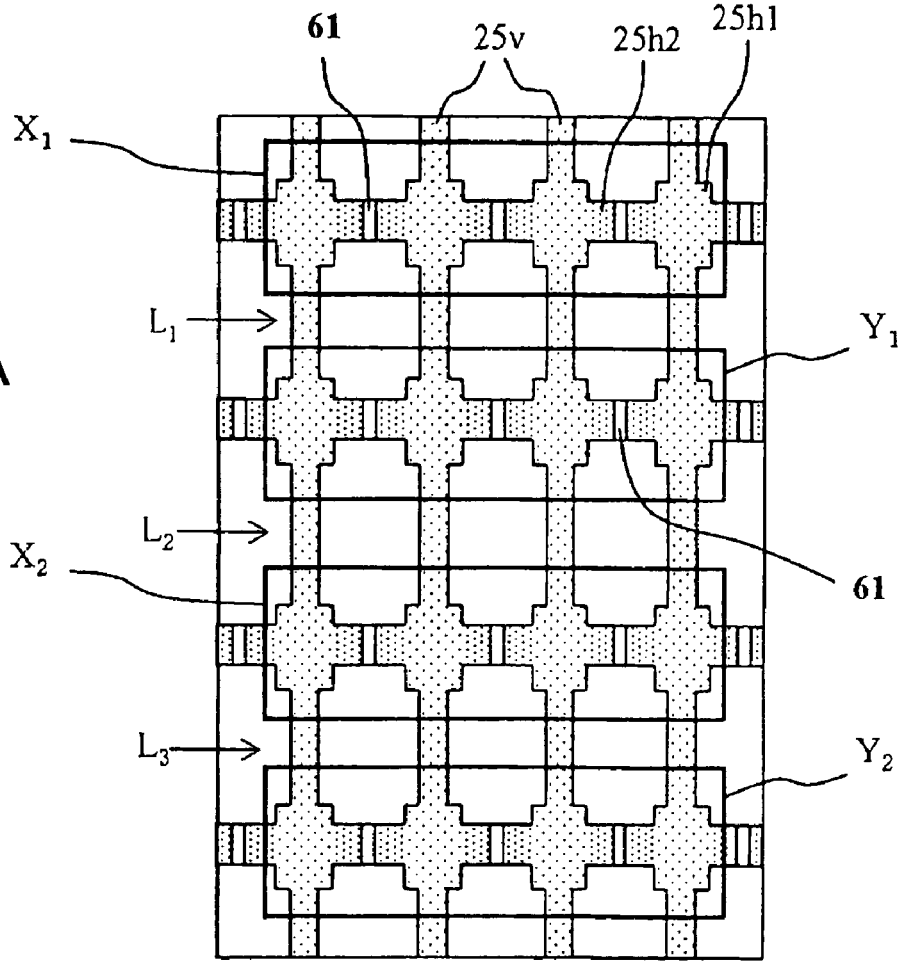
FIGS. 49A and 49B are diagrams showing a seventh PDP structure according to the fifth embodiment.

FIG. 49A shows a seventh PDP structure.

Figure 49B:
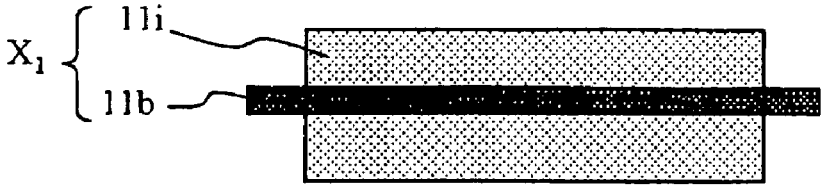

In this seventh PDP structure, the barrier ribs have a structure similar to that shown in FIG. 47B, and the X electrodes $X_1$ and $X_2$ and the Y electrodes $Y_1$ and $Y_2$ shown in FIG. 49A have a structure shown in FIG. 49B.

As can be seen from FIG. 49B, the structure of the X electrode $X_1$ is basically similar to the structure shown in FIG. 1. Note that although FIG. 49B shows only the structure of the X electrode $X_1$, the other X electrodes and Y electrode also have a similar structure.

By employing the structure shown in FIG. 49A for the interlace-type PDP, it becomes possible to adjust the degree of coupling between discharges in vertically adjacent cells to a proper low level. Thus, the PDP having the structure shown in FIG. 49A can be driven by the method according to one of the first to third embodiments of the present invention.

In the structure of the interlace-type PDP shown in FIG. 49A, the electrodes have a simple structure compared with the electrode structures employed in the PDP structures shown in FIGS. 43 to 46, but the barrier ribs have a complicated structure. That is, the respective PDP structures have their own advantages and disadvantages, and thus a proper PDP structure should be selected depending on the required performance or the like.

Next, for solving the above described problem, the present invention further more provides the method in which a plurality of cells composing a screen are grouped into a plurality of groups, each of group composed with two cell adjacent each other, and steps of partial addressing, transfer preparing, and maintaining lighting are sequentially performed to realize a matrix display composed by a plurality of the grouped two cells as a unit of light emission.

The partial addressing is an addressing by which one cell in each of the units is addressed. The addressing is an operation which changes the state of charge in a cell according to the cell to be lit or not during a period for maintaining a lighting in the cell. The transfer preparation is an operation which causes a discharge between display electrodes only in a cell to be lit, where the cell is one of addressed cells processed as objects of partial addressing. By the transfer preparation, the amount of wall discharge around a display electrode pair in the cell to be lit is controlled so as to become a similar or same distribution of wall discharge formed by a surface discharge.

The transfer is an operation by which a discharge between display electrodes is caused in cells to be lit of addressed cells and cells grouped therewith so as to make the state of wall charge in all cells to be lit to a state in which a discharge can be caused in a light maintaining period. By the transfer, the state of charge in the cell to be lit becomes to a state in which a discharge can be caused in a light maintaining period. A light maintaining is an operation in which display discharges are caused in each cell to be lit at the required times according to the brightness to be displayed.

A brightness of the light emitted from the unit is approximately as large as tow times than that from a cell as a unit of light emission because the unit of light emission is the group of two cells.

The transfer can make the required time for the addressing shorter than the total time for addressing each of cells in the group.

The transfer can lessen the limitation of relationship in location between the unit of light emission and the scanning electrode when the driver circuit drives only one display electrode of the display electrode pair as a scanning electrode.

The reliability of the transfer operation can be increased by performing the transfer preparing operation prior to the transfer operation. And the a matrix display capable of displaying high bright images with line pitch as same as cell arrangement pitch is realized when a frame is divided into two fields, then the cell grouping is made at every fields so that a lighting unit is shifted one cell in a column direction at every fields, and the above described addressing, transfer preparation, transfer, and light maintaining are operated at least in one of the fields.

Next, for solving the above described problem, the present invention further more provides the following method. In the method for solving the problem, a matrix display is provided which is performed by that display electrodes are grouped as the first and second electrodes so that the arrangements of the electrodes in two adjacent cells in the column direction is geometrically opposing each other in the column direction at every cells, and then performing the sequence of an addressing and light maintaining including two-electrodes simultaneous scanning. The two-electrodes simultaneous scanning is an operation which the two-electrodes, namely the two adjoining second electrodes, holding at least one of the first electrodes between them, are scanned in a certain moment at common timing.

Sixth Embodiment

Figure 50:
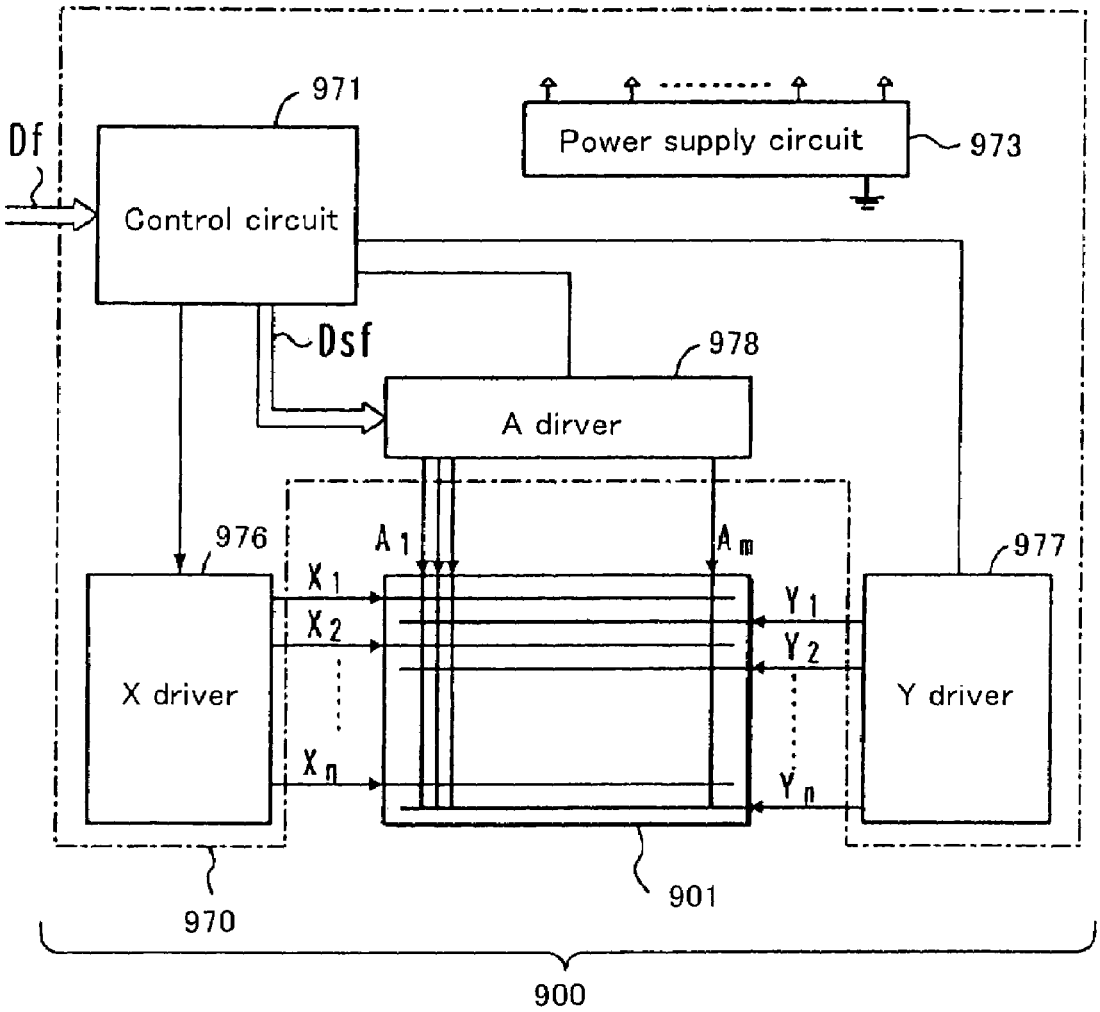
FIG. 50 is a diagram showing a display apparatus according to the sixth embodiment.

The sixth embodiment is directed to the method including a transfer and preferably applied to a plasma display panel having a structure in which interference between cells formed in a column direction can be caused. FIG. 50 shows a configuration of a display apparatus according the first embodiment.

The display apparatus 900 has an AC-type plasma display panel 901 (PDP) including a plurality of cells forming rows and columns in matrix screen, and a drive unit 970 for controlling lighting in the cells.

In the plasma display panel 901, display electrodes Xs and Ys are arranged in parallel each other to form a pair of electrodes for causing a display discharges in the form of surface discharge. Address electrodes are arranged so as to intersect the Xs and Ys electrodes. The display electrodes Xs and Ys are formed in the horizontal direction in FIG. 50, and the address electrodes As are formed in the column direction, namely a vertical direction. The total number of display electrodes Xs and Ys equals to the sum of the number of cells in a column and one, namely the sum is 2n. The total number of address electrodes As equals to the number of rows, that is, m. The subscripts added to the references X, Y, and A for display electrodes and address electrode show the order of arrangement in the panel.

The drive unit 970 has a control circuit 971 for performing a drive control, a power supply circuit 973 for supplying driving power, X driver 976 for controlling the electrical potential of the display electrode X, Y driver 977 for controlling the electrical potential of the display electrode Y, and an A driver 978 for controlling the electrical potential of the address electrode A.

The Y driver 977 has a scanning circuit for individually controlling every n display electrodes Ys. Image output apparatus, such as a television tuner for selecting a channel or a computer, sends frame data and associated synchronizing signals to a drive unit 970, where the frame data includes the data indicating the each level of brightness of red, green, and blue colors. The frame data Df is temporarily stored in a frame memory in the control circuit 971. The control circuit 971 can convert the frame data Df into a sub-field data Dsf for displaying images with assigned gray scale and send the sub-field data Dsf in a serial data form to the A-driver 978. The sub-field data Dsf is display data composed with data of 1 bit for single cell, where the value of each bit shows whether the associate cell should be lit or not, in other words the address discharge should be caused or not in the cell, in the corresponding sub-field.

Figure 51:
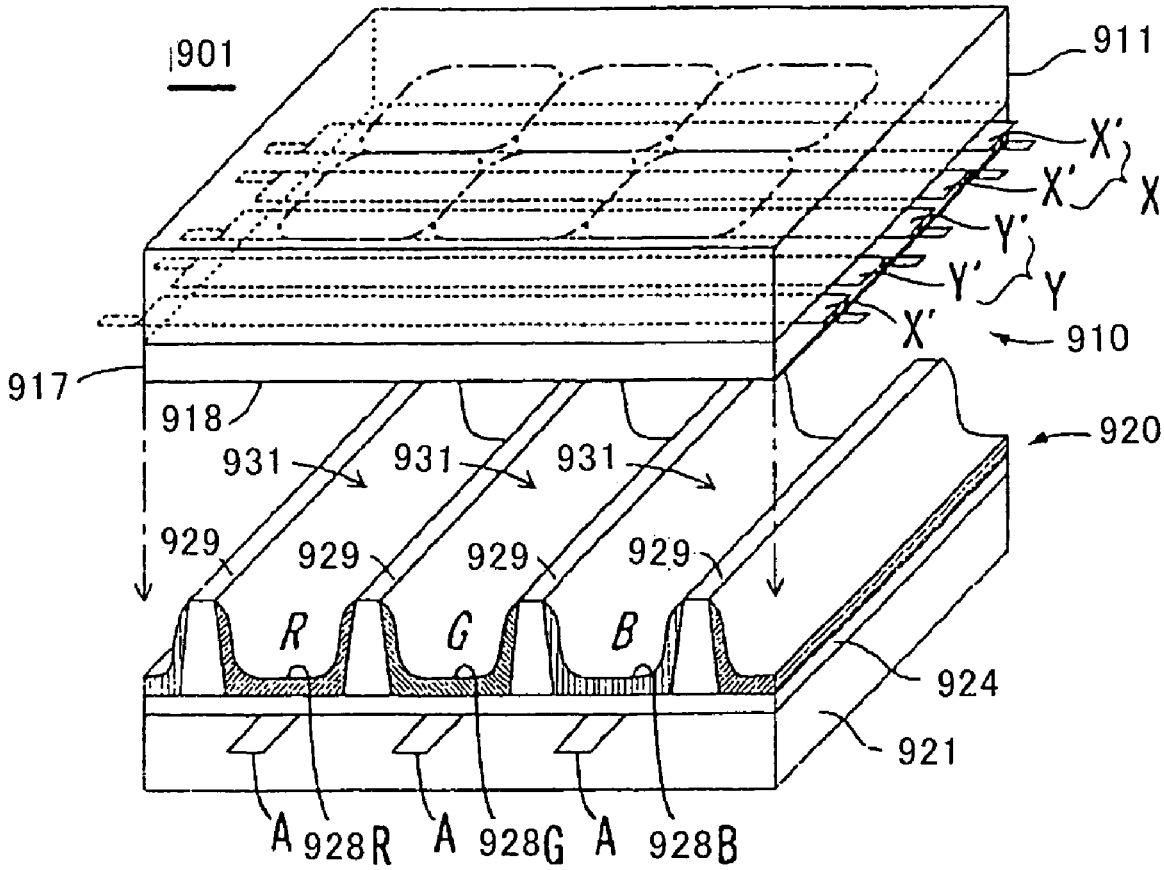
FIG. 51 is an exploded perspective view showing a PDP structure usable in the sixth to ninth embodiments.

FIG. 51 shows a cell structure in the plasma display panel 901. For intelligibility a part of the structure of PDP 901 is shown, where a pair of base plates 910 and 920 are separated so that the internal structure corresponding to the part of three cells in the row direction and two cells in the column direction can be seen easily.

The plasma display panel 901 comprises a pair of base plates 910 and 920. The base plate means a structure which comprises a glass substrate having a size wider than the size of a screen and at least a kind of panel component. The base plate 910 at a front side comprises a glass substrate 911, electrodes X's and Y's, a dielectric layer 917, and a protective film 918. Electrodes X' and Y' are respectively composed of a transparent electric conductive film formed in the stripe shape having wide width for forming a surface discharge gap and a metal film as a bus conductor formed in the shape having narrow width for decreasing the electric resistance of the electrode. A display electrode X is composed of a pair of adjoining electrodes X' and X', a display electrode Y is similarly composed of a pair of adjoining electrodes Y' and Y'. These display electrodes X and Y are covered by a dielectric layer 917 and a protective film 918. The base plate 920 at a rear side comprises a glass substrate 921, address electrodes A, insulating layer 924, a plurality of barrier ribs 929, and fluorescent layers 928R, 928G, and 928B. The barrier rib 929 is formed in a shape of a straight stripe in plan view and the barrier rib 929 is arranged at every gap between address electrodes. The barrier rib 929 functions so as to partition a gas discharge space into every column in a matrix display and to form the column space 931 corresponding to each column. The column space 931 continuously crosses all of lines. The fluorescent layers 928R, 928G, 928B are excited by ultraviolet rays emitted from discharge gas and emit lights. The italic characters R, G, B in the FIG. 51 show respectively the color of emitted light from the fluorescent layer.

Figure 52:
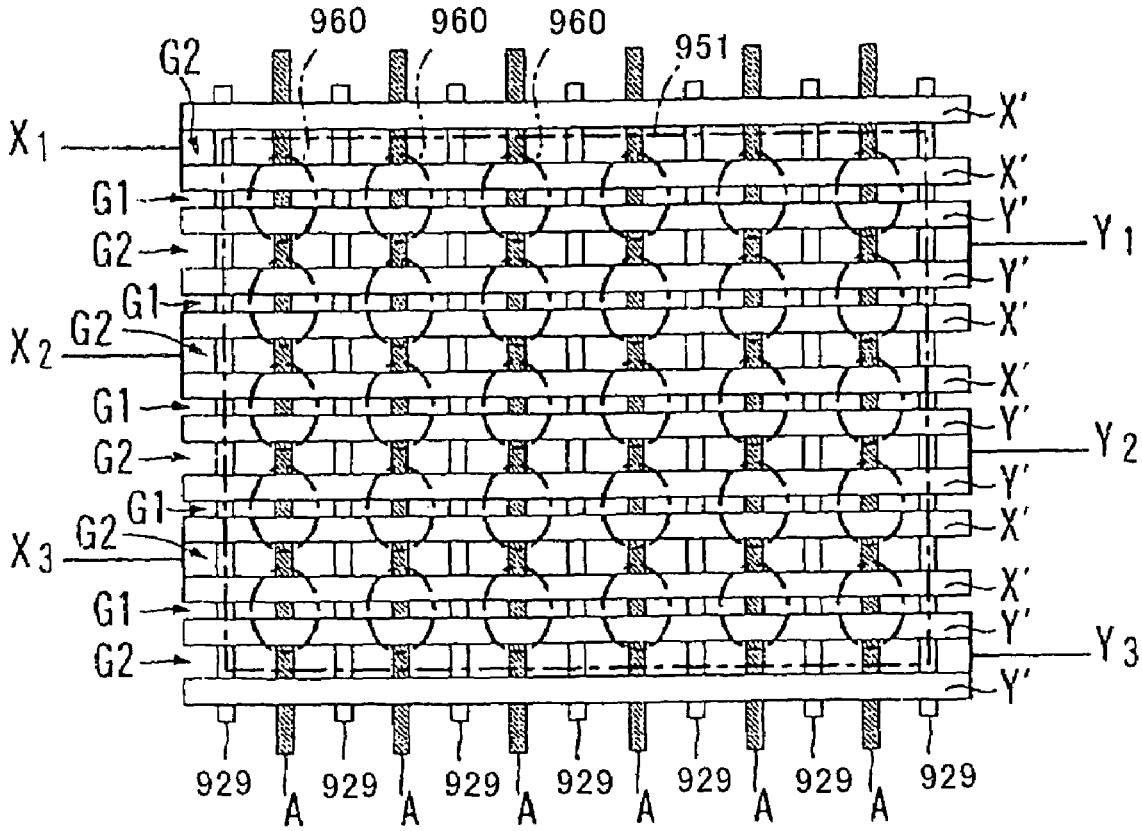
FIG. 52 is a diagram showing a structure of arrangement of electrodes, barrier ribs, and a screen.

FIG. 52 shows a schematic diagram of an arrangement of electrodes. Two adjoining electrodes X' and X' are separated by a gap G2 and electrically connected to form the display electrode X in an area outside the screen 951 composed of cells 960. Similarly, two adjoining electrodes Y' and Y' are separated by a gap G2 and electrically connected to form the display electrode Y in an area outside the screen 951. The electrical connecting part for a pair of electrodes X' is located at one side of the screen 951 and one for a pair of electrodes Y' at the other side for easily electrical connecting between each electrical connecting part and the driver. Each of display electrodes X and Y has divided into two electrodes within the area of screen 951. Display electrodes X and Y are arranged alternately such as in order of XYXY . . . XY, namely they adjoin each other. The electrodes X and Y are separated by discharge gap G1 so as to form a pair of electrodes for a surface discharge, where the pair functions as a pair of an anode and a cathode. The total number of electrode pairs equals to the number of cells in a column.

Figure 53:
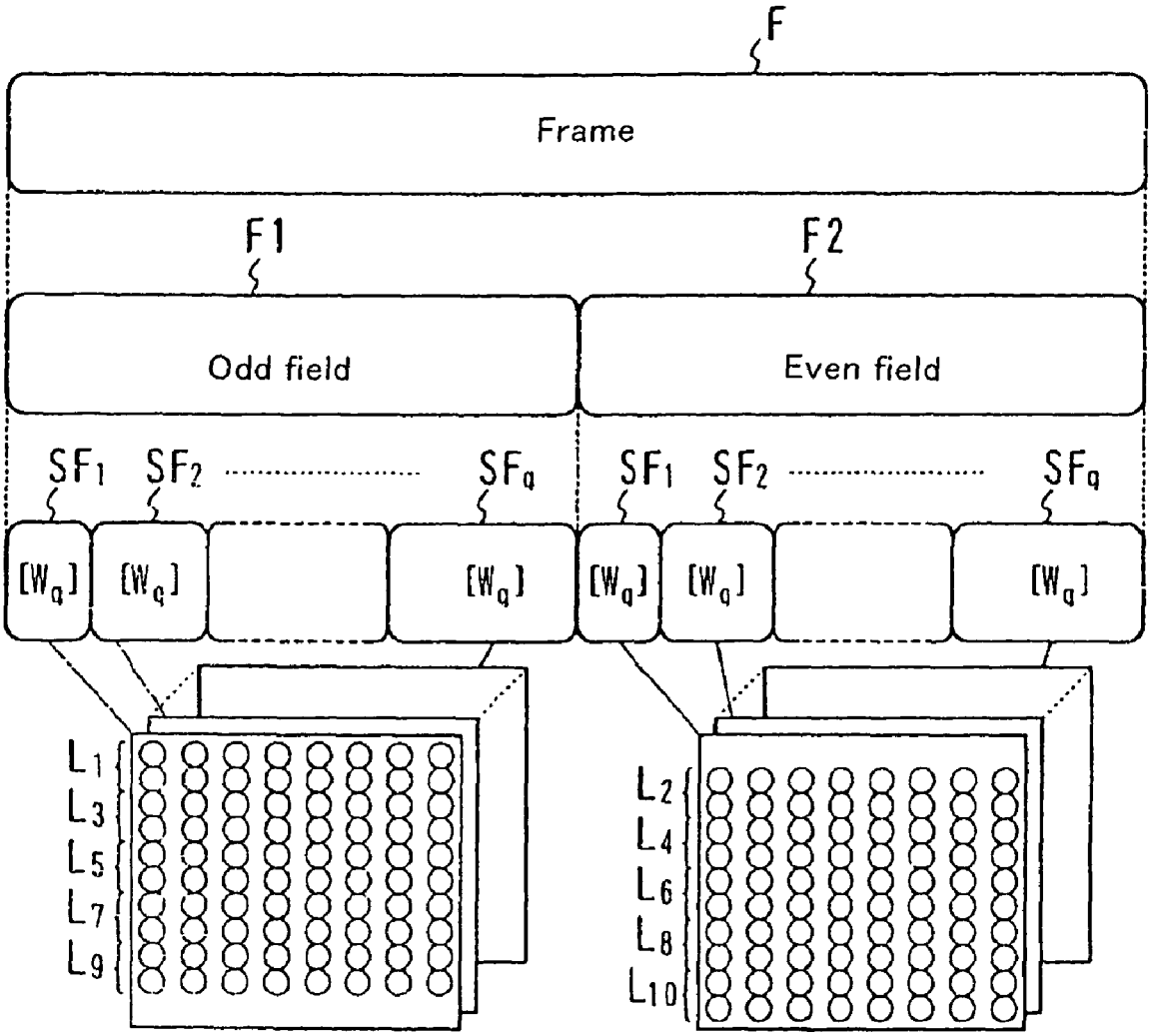
FIG. 53 is a diagram schematically showing a concept of structure of field.

The method of driving the plasma display panel 901 in the display apparatus 900 is described below. FIG. 53 schematically shows the structure of a frame and the division of the frame. A frame F is input into the apparatus 100 as an input image in a manner of time series. The frame F in a progressive format is transformed into a frame in interlace format. The frame F is composed of an odd and even fields F1, F2 each of which is transformed into sub-fields, $SF_1$–$SF_q$, the subscription indicating the order of displaying the frame is omitted hereinafter. Each of sub-field is weighted by brightness. The weight of brightness, ($W_1$, $W_2$, - - - , $W_q$), determines the number of times of discharge for display. The order of the sub-fields in time can be sequenced in the order of weight or other. On displaying data in sub-fields composing the odd field F1, the odd display lines, $L_1$, $L_3$, $L_5$, - - - , are used. On displaying data in sub-fields composing the even field F2, the even display lines, $L_2$, $L_4$, $L_6$, - - - , are used. It is important to know that each line L is composed of cells of which the number is two times that of columns for increasing the brightness of display.

The lighting unit in matrix display of the display apparatus 900 is a group of two adjoining cells arranged in a column direction. As shown in FIG. 54A, the lighting unit U1 in the odd field is composed of two cells in which a display electrode Y is used in both cells. As shown in FIG. 54B, the lighting unit U2 in the even field is composed of two cells in which a display electrode X is used in both cells. The amount of the gap of the line between the odd and even fields is the same as cell pitch P in the direction of the column. It is therefore possible to display with the same resolution as the interlace display in the conventional manner in which a cell is assumed to be a lighting unit.

Figure 55A:
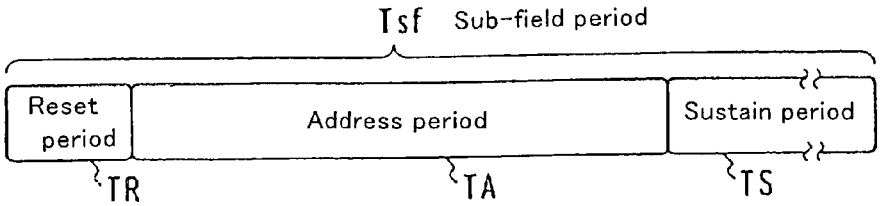
FIGS. 55A and 55B are diagrams showing details of sub-fields.
Figure 55B:
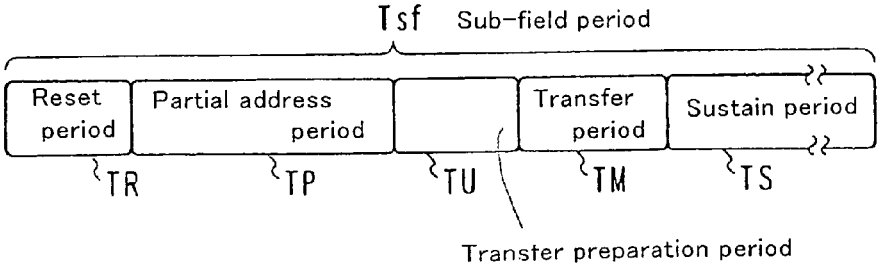

FIGS. 55A and 55B show the detail of the sub-field. A subfield period Tsf allocated in one subfield divides into a reset period TR, an address period TA, and sustain period TS when the odd field is displayed. A subfield period Tsf divides into a reset period TR, a partial address period TP, a transfer preparation period TU, a transfer period TM, and a sustain period TS when the even number field is displayed. A partial address period TP, a transfer preparation period TU, and a transfer period TM are peculiar to this invention.

The reset period TR is a period for the addressing preparation to make the wall charge of all cells even. The addressing preparation is generally noted as "initialization." The address period TA is a period for addressing in which the amount of the wall charge of the cell to be lit is increased more than that of other cells. The sustain period TS is a period for the lighting maintenance where the discharge for display is performed at required times according to the brightness to be displayed.

The partial address period TP is a period for partial addressing that is addressing only the one cell of the two cells as the lighting unit U2. The transfer preparation period TU is a period for preparing a transfer for decreasing bias of the wall-charge at the display electrodes in the cell, the cell should be lit and is one of the cells partially addressed. The transfer period TM is a period for transferring a wall charge as information in address cell to a cell as a one of addressed cells.

Figure 56:
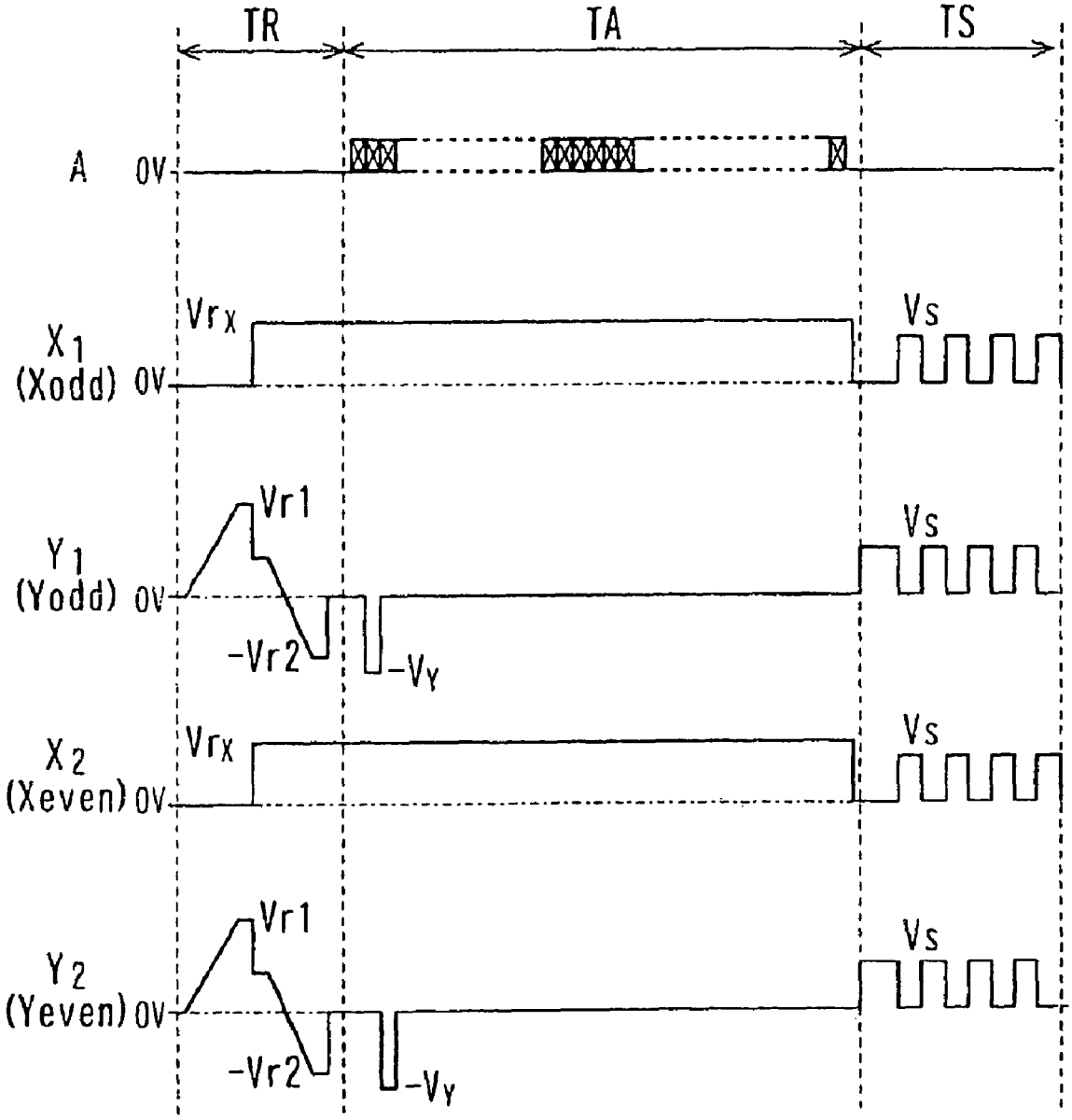
FIG. 56 is a diagram showing driving voltage waveforms applied to electrodes according to an odd field in the sixth embodiment.

FIG. 56 shows driving voltage waveforms in an odd field of the first embodiment. In the order of the arrangement of display electrodes Xs, the odd display electrodes Xs; $X_1$, $X_3$, $X_5$, - - - , are denoted as display electrodes $X_{odd}$, and the even display electrodes X; $X_2$ $X_4$, $X_6$, - - - , are denoted as display electrodes $X_{even}$. Similarly, the odd display electrodes Ys; $Y_1$, $Y_3$, $Y_5$, - - - , are denoted as display electrodes $Y_{odd}$, and the even display electrodes Y; $Y_2$, $Y_4$, $Y_6$, - - - , are denoted as display electrodes $Y_{even}$.

In the reset period, a positive ramp pulse is applied to the display electrodes Y. In other words, the potential of display electrode Y is monotonically raised from 0 to Vr1 by a bias control. Next, a negative ramp pulse is applied to the display electrode Y. Namely, the potential of display electrode Y monotonically falls from Vr1 to −Vr2 by the bias control. During the bias control being performed, a positive offset bias; Vrx, is applied to the display electrode X when it is required to increase the amplitude of an applied voltage between the sustain electrodes.

A weak discharge caused by the second application of the negative ramp pulse adjusts the wall voltage to a voltage corresponding to the value of the difference between amplitudes of a discharge starting voltage and an applied voltage.

In the address period TA, a scanning pulse having a amplitude −Vy is applied in turn to each display electrode Y. That is, the line selection is performed. In synchronization with selecting the line, an address pulse is applied to an address electrode A according to a selected cell on the selected line. An address discharge is caused to vary the predetermined amount of wall charge in the cell which is selected with the display electrode Y and an address electrode A, where the cell is called as a selected cell hereinafter. The selected cell is a cell to be lit in case of writing form, on the other hand the cell is a cell to be unlit in case of an erasing form. Hereinafter is described the explanation according to the addressing performed in the writing form.

In the sustain period, a positive sustain pulse having amplitude Vs is alternatively applied to the display electrodes Y and X. At every application of the pulse, a display discharge is caused between the display electrodes in the cell to be lit, where an appropriate amount of wall discharge is stored.

As shown in FIG. 56, the voltage waveforms applied to the display electrodes $X_{odd}$ and $X_{even}$ are same or similar each other in the odd field. As for the display electrodes $Y_{odd}$ and $Y_{even}$, the voltage waveforms applied to these electrodes are same or similar each other in the reset period RS and the sustain period TS.

Figure 57:
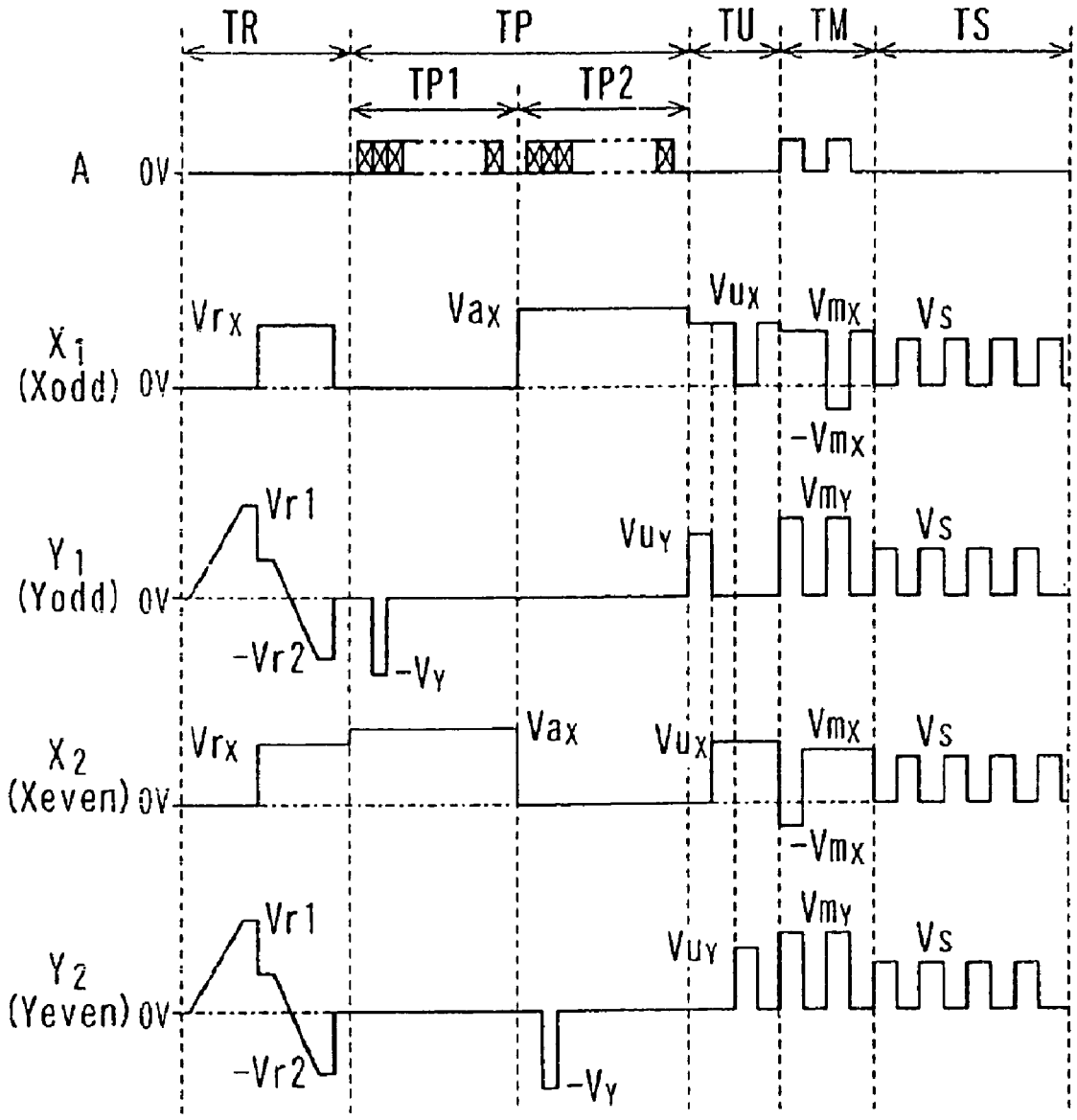
FIG. 57 is a diagram showing driving voltage waveforms applied to electrodes according to an even field in the sixth embodiment.

FIG. 57 shows driving voltage waveforms in an even field in the sixth embodiment. An explanation on the driving voltage waveforms in the reset and the sustain periods are omitted because they are same or similar to ones in the odd field.

The partial address period is divided into a first half address period TP1 and a later half address period TP2. In the period TP1, the potential of the display electrode $X_{even}$ is biased to a potential $V_{ax}$, and a scanning pulse having an amplitude −Vy is applied to every display electrode $Y_{odd}$ one at a time. That is, a cell at an upstream side, namely at upper side in FIGS. 54A and 54B, in the odd lighting unit U2 in each column of the screen is selected. In synchronization with the selection, an address pulse is applied for causing an address discharge to the address electrode A corresponding to a cell to be lit in the selected addressed cells. The operation, which is a part of the partial addressing, in the first half address period TP1 is called as "a first half addressing."

In the later half period TP, the potential of the display electrode $X_{odd}$ is biased to a potential Vax, and a scanning pulse having an amplitude −Vy is applied to every display electrode $Y_{even}$ one at a time. That is, a cell at the upstream side in the even lighting unit U2 in each column of the screen is selected. In synchronization with the selection, an address pulse is applied for causing an address discharge to an address electrode A corresponding to a cell to be lit in selected addressed cells. The operation in the later half period TP2 is called as "a later half addressing."

In the transfer preparing period TU, the electrode potential is controlled so that a discharge between display electrodes is caused twice in a cell, being one of first half address cells, in which a wall charge has been formed by an address discharge, and after the two discharges, the discharge between the display electrodes in a cell to be lit, the cell being one of the later half address cells, is caused twice. The display electrodes X and Y are temporarily biased to a potential Vux and Vuy respectively.

In the transfer preparation, it is required to cause a discharge in an address cell and not to cause a discharge in a transfer cell. The requirement is satisfied by setting the potential relationship as follow. That is, in the transfer preparation for the first half address cells, the display electrode Yodd is set to a high level voltage, a display electrode Xeven to a low level voltage for causing a discharge, a display electrode Xodd to a high level voltage for lowering the voltage applied to a later half transfer cell, a display electrode Yeven to a low level voltage for lowering the voltage applied to a first half transfer cell. In the transfer preparation for the later half address cells, the display electrode Yeven is set to a high level voltage, a display electrode Xodd to a low level voltage for causing a discharge, a display electrode Xeven to a high level voltage for lowering the voltage applied to a later half transfer cell, a display electrode Yodd to a low level voltage for lowering the voltage applied to a first half transfer cell.

In the transfer period TM, the electrode potential is at first controlled so that the discharge between the display electrodes is caused in a cell to be lit, where the cell is one of the first half address cells, and the discharge will induce a discharge between the electrodes in a adjacent cell. The adjacent cell is a cell to be lit which is one of first half transfer cells in group with a first half address cell. A cell which is unlit, namely in which a wall charge is not formed, is controlled so that a discharge is not caused. Next, the electrode potential is controlled so that the discharge between the display electrodes is caused in a cell to be lit, where the cell is one of the later half address cells, and the discharge will induce a discharge between the electrodes in an adjacent cell. The adjacent cell is a cell to be lit which is one of later half transfer cells in group with a later half address cell. When a discharge is caused in a cell, the potential of display electrodes X is biased to a potential $Vm_X$ or a potential $-Vm_X$ and the potential of display electrodes Y is biased to a potential $Vm_Y$ or a potential $-Vm_Y$.

Figure 58:
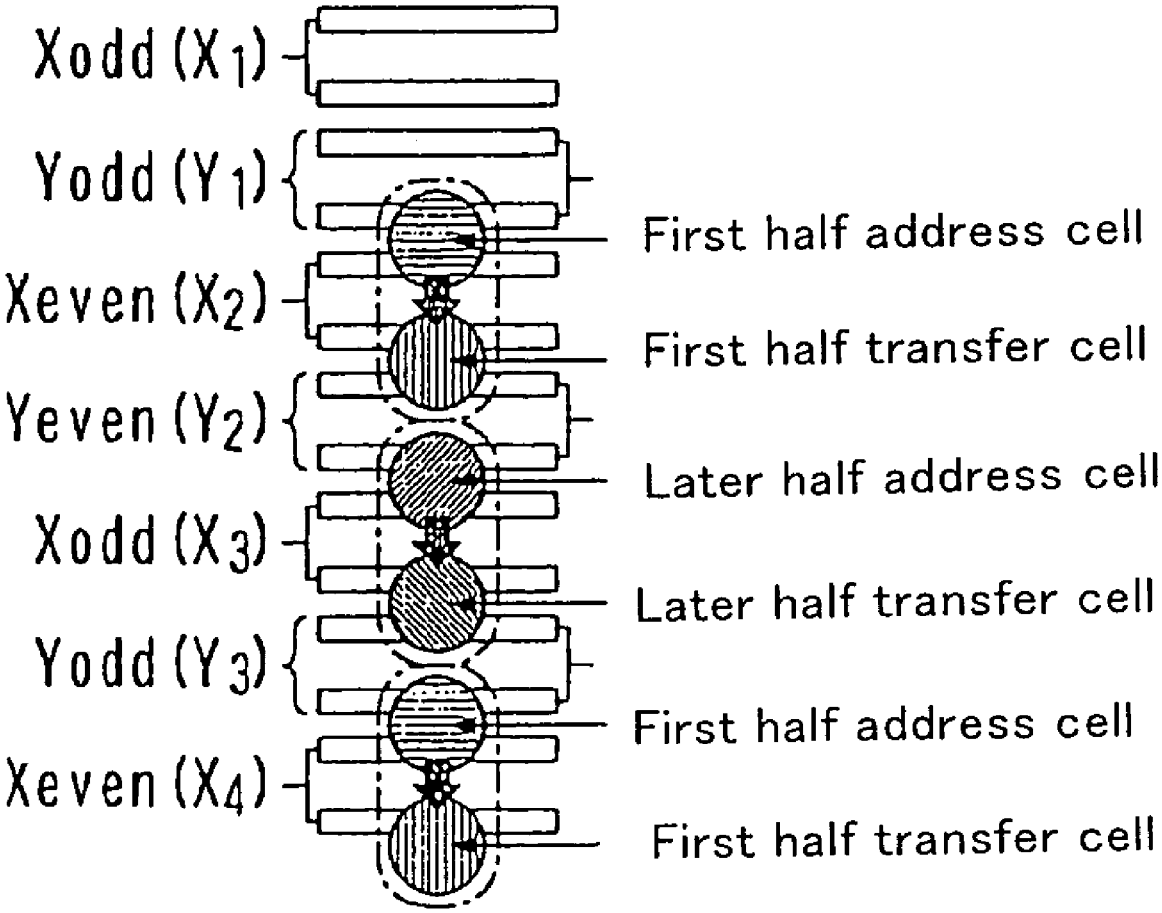
FIG. 58 is a diagram showing a direction of a transfer according to the sixth embodiment.

FIG. 58 shows a direction of the transfer. The addressing information is copied from a first half address cell to a first half transfer cell, from a later half address cell to a later half transfer cell, and from an upper side to a lower side in FIG. 58. When the address cell is to be lit, an amount of a wall charge formed in the transfer cell approximately equals that in the address cell. On the contrary, when the address cell is to be unlit, an amount of a wall charge in the transfer cell is kept in a little one because a discharge in the transfer cell is not caused due to no discharge in the address cell. That is, a transfer transmits the information that the address cell is lit or unlit to a transfer cell.

Figures 59A, 59B, 59C, 59D, 59E, 59F:
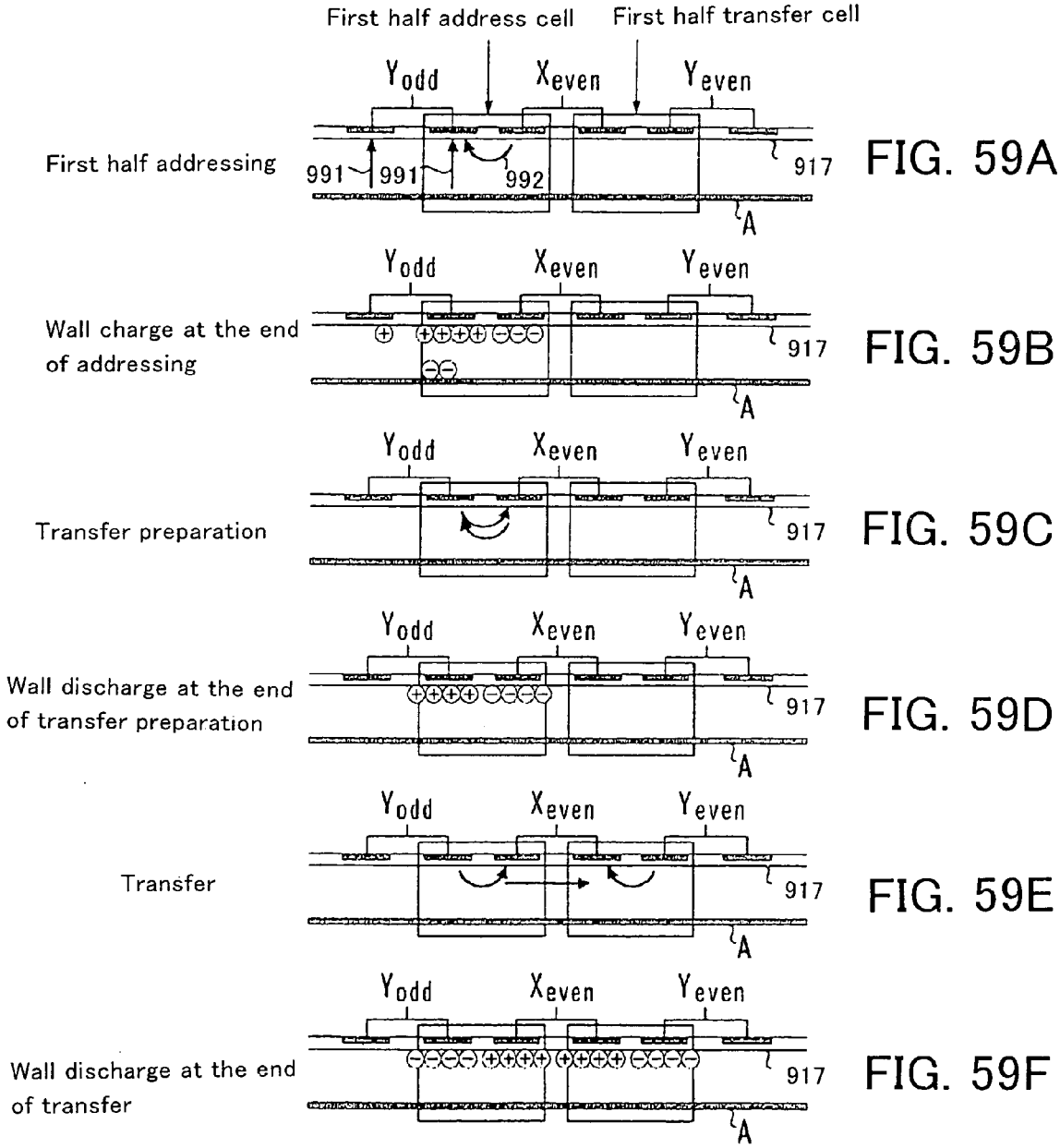
FIGS. 59A to 59F are diagrams showing a concept of a transfer preparation and transfer.

FIGS. 59A to 59F show the concept of the transfer preparation and the transfer. In these figures, a peculiar operation in the present invention is shown by the use of a first half address cell and a first half transfer cell. FIG. 59A shows a first half addressing in which an opposed discharge 991 is caused between the display electrode Yodd and the address electrode A and the opposed discharge 991 performs as a trigger for causing a surface discharge 992. Positively caused discharge 991 is liable to make an offset of wall discharge between display electrodes of the first half address cell at the end of addressing as shown in FIG. 59B. Thus, a distribution of the discharge at a display electrode pair tends to become non-uniform. The non-uniformity of the wall charge distribution makes the transfer unstable. Furthermore, the state of the first half address cell is easily transferred to the later half transfer cell to degrade the displayed images because the wall discharge is formed in the transfer cell of the display electrode Yodd. Next, the transfer preparation is performed to causes a surface discharge in only a first half address cell for preventing these problems. By the transfer preparation, the wall charge distribution around the display electrodes in the first -half address cell becomes uniform as shown in FIG. 59D. In this embodiment, the number of times of the discharge in the transfer preparation is twice and the polarity of the wall discharge at the end of transfer preparation is same one at the beginning of the transfer preparation. As shown in FIG. 59E, in the period of the transfer, a surface discharge is caused in the first half address cell and then the surface discharge functions as a trigger to cause a surface discharge in the first half transfer cell. By these two surface discharges, each wall discharge is formed in the first half address cell and a first half transfer cell respectively, where each amount of the wall discharges is approximately equal as shown in FIG. 59F.

Seventh Embodiment

Figure 60:
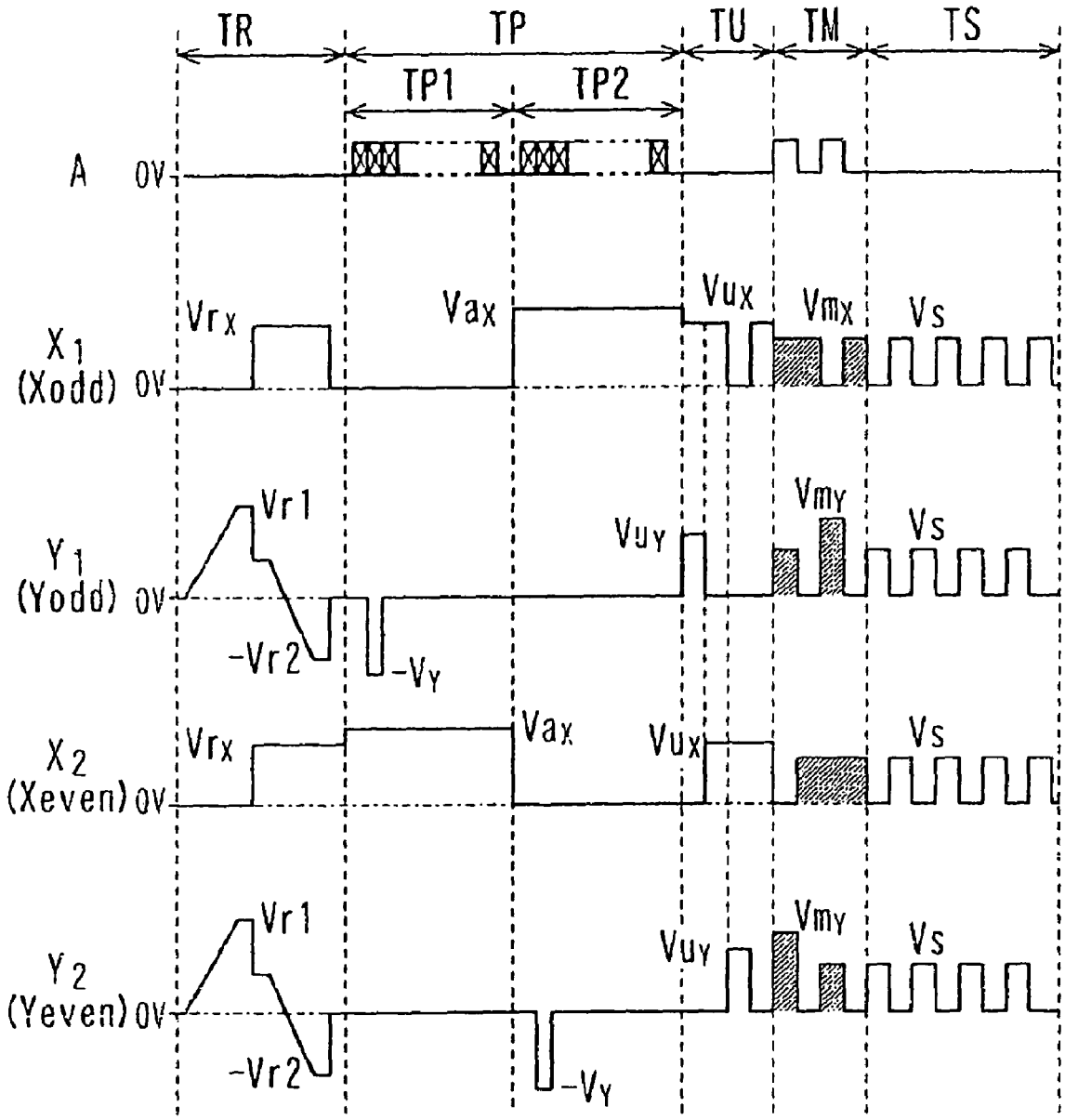
FIG. 60 is a diagram showing driving voltage waveforms applied to electrodes according to an even field in the seventh embodiment.

FIG. 60 shows the driving voltage waveforms in an even field of the seventh embodiment. The waveforms hatched in a transfer period TM of the seventh embodiment are different from ones in the sixth embodiment.

In the seventh embodiment, the potential of electrodes is controlled so that the high voltage is not applied to the address cell at the transfer while the high voltage is applied to only transfer cell. In the transfer operation of the sixth embodiment, for example, the voltage applied to the transfer cell is adjusted to one not higher than a discharge starting voltage and not less than a sustaining voltage by biasing the potentials of display electrodes Yodd and Yeven to the potential VmY and the potential of the display electrode Xeven to a negative potential −VmX. Under these control, the discharge in the transfer cell is caused by the discharge in the address cell as a trigger. In this case, a high voltage is applied to address cell as well, therefore, the discharge can easily spread to function effectively as a trigger to cause a discharge in the transfer cell. The transferring process, however, tends to be unstable because the discharge in the address cell can spread in the direction to the later half transfer cell. The problem above can be solved by the seventh embodiment.

Eighth Embodiment

Figure 61A:
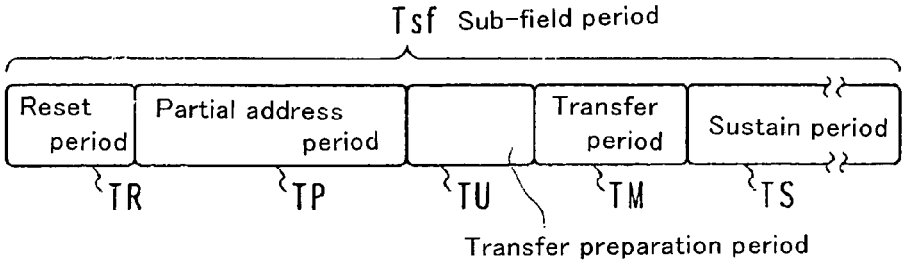
FIGS. 61A and 61B are diagrams showing details of sub-fields according to the eighth embodiment.
Figure 61B:
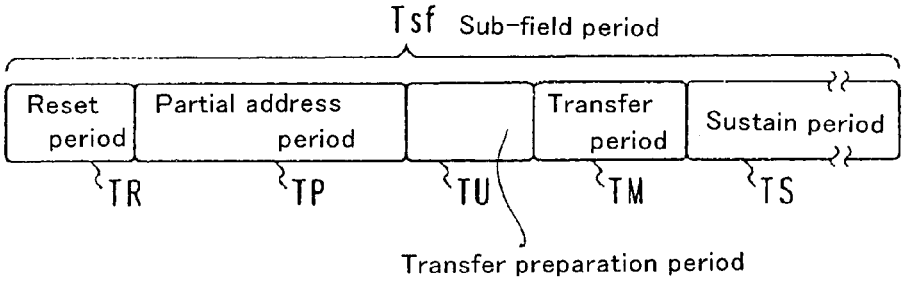

FIGS. 61A and 61B show the details of the sub-field in the eighth embodiment. Both of the odd and even fields are respectively divided into a reset period TR, a partial address period TR, a transfer preparation period TU, a transfer period TM, and a sustain period TS.

In this embodiment, an addressing including transfer is performed in display by even field, while the cells in both sides of a display electrode Y are selected by the electrode Y in the first embodiment. For this reason the problem of the unstable addressing caused by excessively spread discharge is solved.

Figure 62:
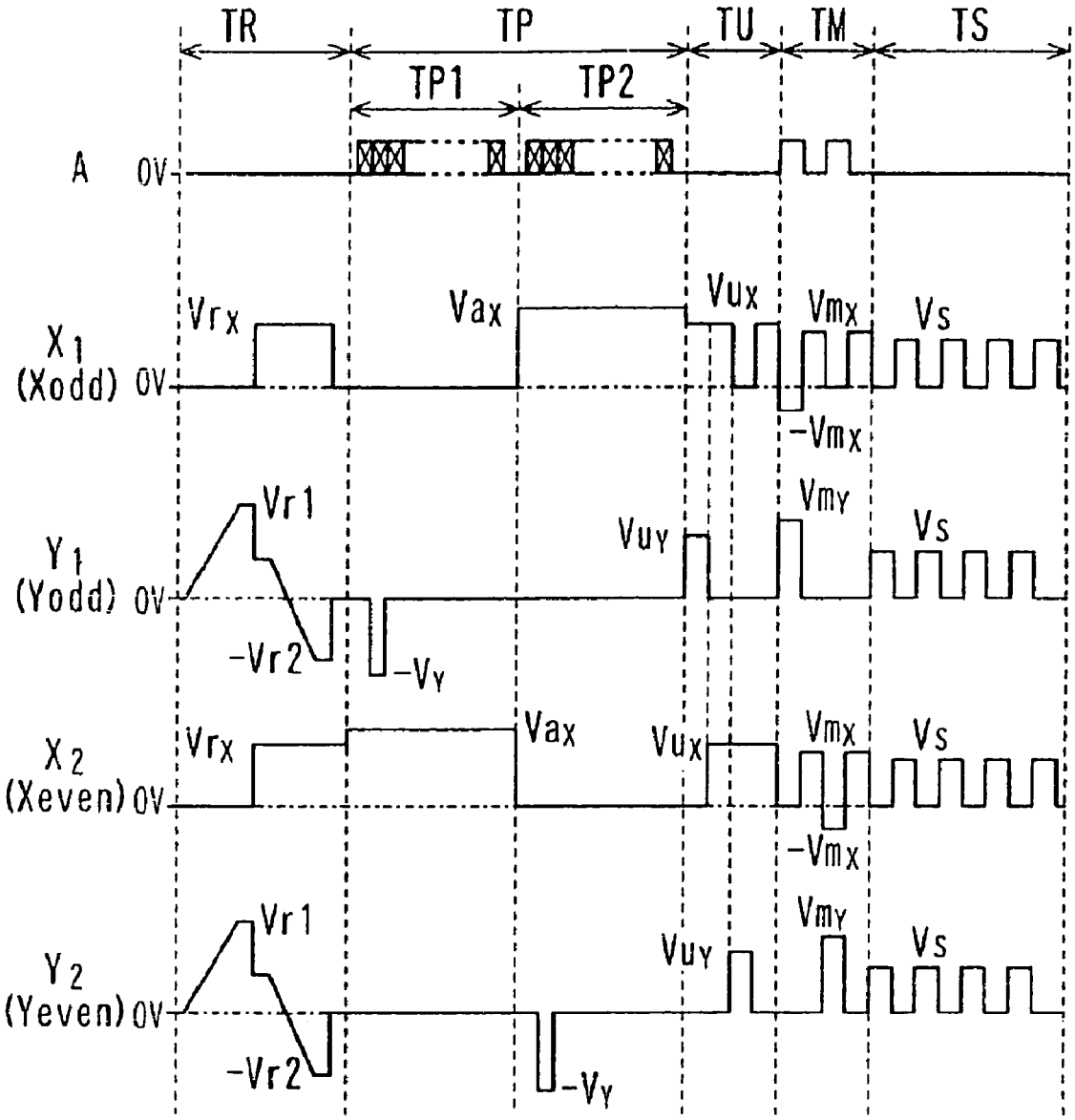
FIG. 62 is a diagram showing driving voltage waveforms applied to electrodes according to an odd field in the eighth embodiment.

FIG. 62 shows driving voltage waveforms used in an odd field of the eighth embodiment, while driving voltage waveforms described in the sixth or seventh embodiments are used also in an even field of this embodiment. The voltage waveforms in the address, transfer preparation, and transfer periods TP, TU, and TM are different from ones in the sixth embodiment. In the eighth embodiment, a cell composed of a pair of display electrodes Yodd and Xodd is a first half address cell, and a cell composed of a pair of display electrodes Yeven and Xeven is a later half address cell. Furthermore, a cell composed of a pair of display electrodes Yodd and Xeven is a first half transfer cell, and a cell composed of a pair of display electrodes Yeven and Xodd is a later half transfer cell.

Ninth Embodiment

Figure 63:
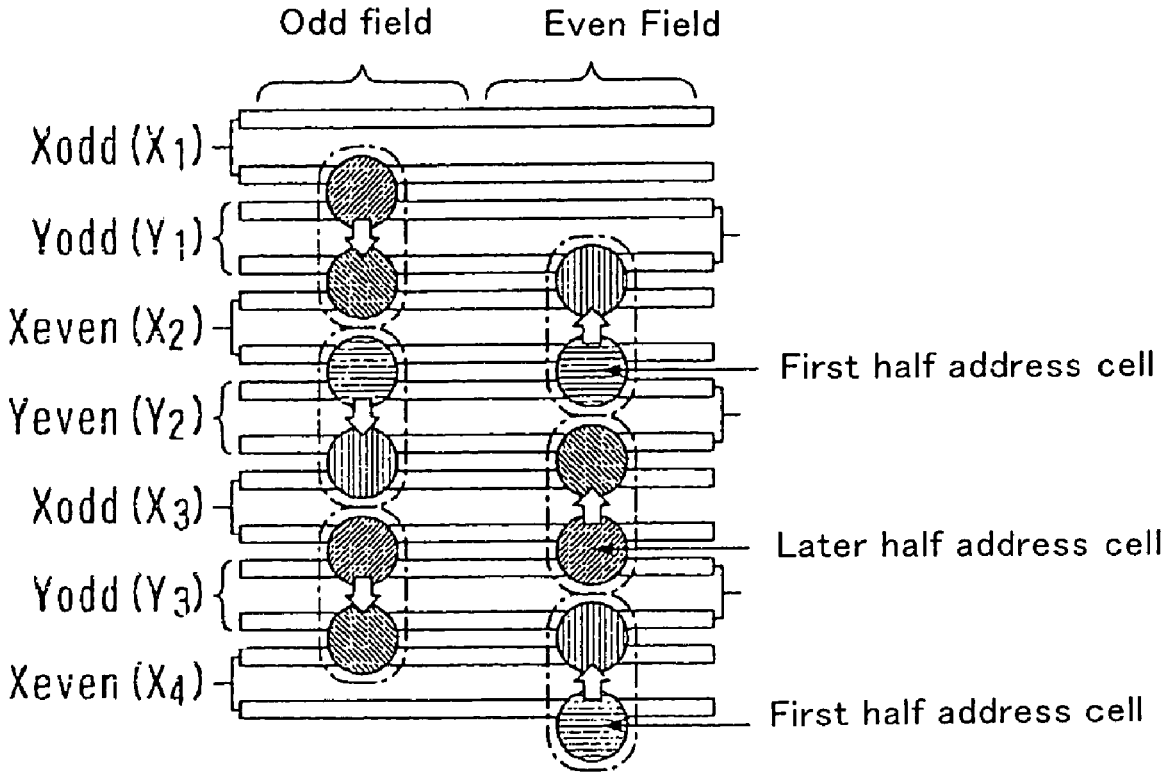
FIG. 63 is a diagram showing directions of transfer according to the ninth embodiment.

FIG. 63 shows the direction of transfer in the ninth embodiment. In the embodiment, the transfer is performed in both of an odd and an even fields, where the directions of the transfer are different each other. The transfer in the odd field is performed from the upside stream to the downside, on the contrary the transfer in the even field is performed from the downside stream to the upside stream. In both fields, a first half cell is composed of a pair of a display electrodes Yeven and Xeven, and the later half cell is composed of a pair of a display electrodes Yodd and Xodd.

Figure 64:
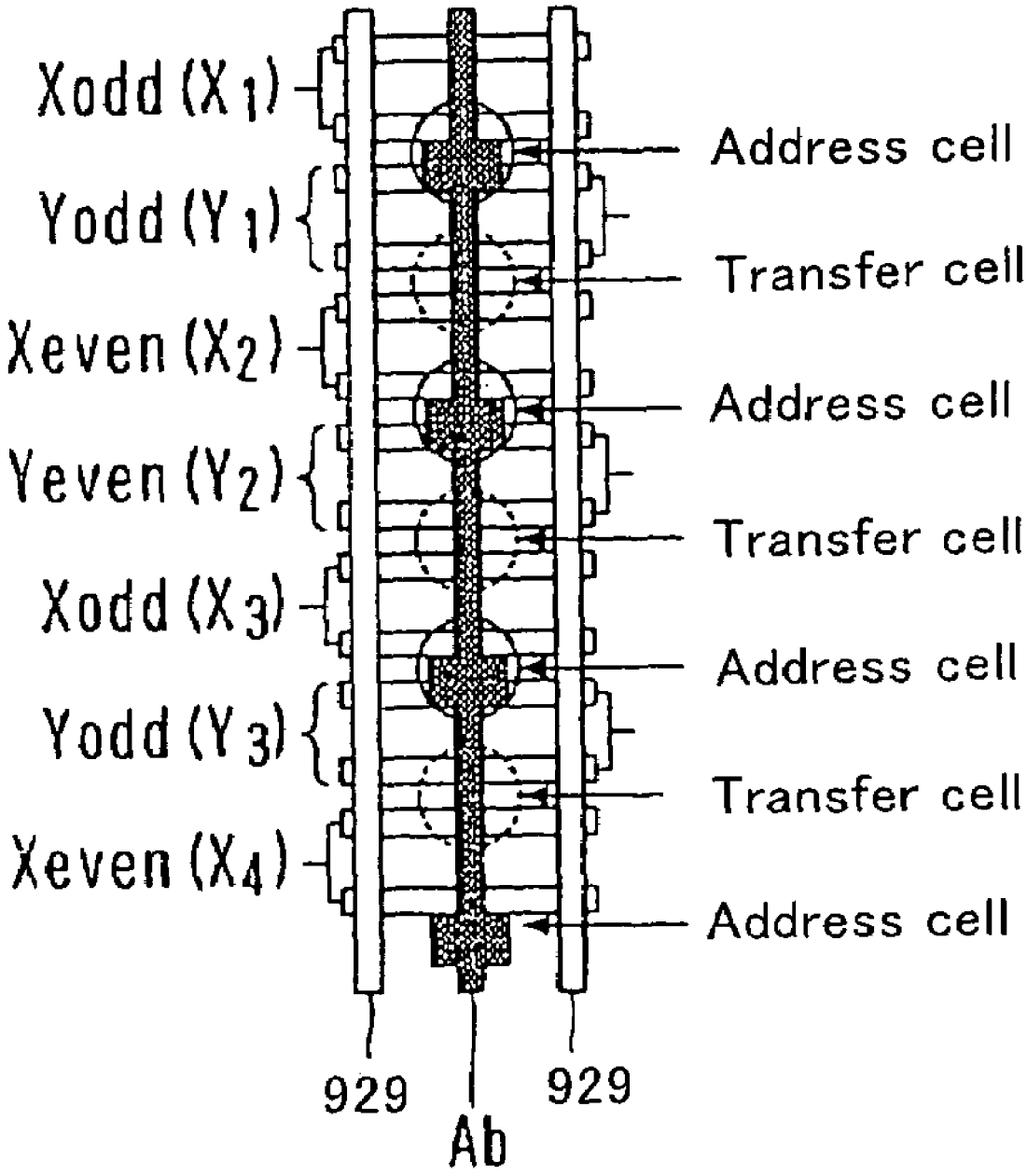
FIG. 64 is a diagram showing an example of address cell structure.

Each cell is fixed as one of an address or a transfer cell, therefore the structure of the cell can be designed for preferable one as the address cell or the transfer cell, which can enlarge the permitted limit of driving voltage. FIG. 64 shows an example of a cell structure including an address electrode having a preferable figure, where the address electrode has a patterned shape of stripe having a wider part corresponding to the address cell area and its position. The shape can lowers the starting voltage of an opposed discharge. Furthermore, the stable addressing is performed because the address discharge can be caused more easily in an address cell than in a transfer cell.

In addition to the embodiments described above, the following methods and apparatus are preferable to achieve the objects described above.

A method (1) of driving a plasma display panel so as to display an image using two types of frames including an odd frame and an even frame, the plasma display panel including: a plurality of electrodes formed on a substrate so as to extend in one direction; and discharge gaps for generating a discharge and non-discharge gaps in which no discharge occurs, each of the discharge gaps and the non-discharge gaps being formed between adjacent electrodes of the plurality of electrodes, the discharge gaps and the non-discharge gaps being disposed alternately, two electrodes of each electrode pair, between which there is one of the non-discharge gaps, being electrically connected to each other, each of the discharge gaps being partitioned into a plurality of cells, the method comprising the step of driving the plasma display panel in such a manner that the cells are grouped into cell groups such that each cell group includes two or three cells at successive locations in a direction crossing the electrode pairs; and the cells are driven in units of cell groups, wherein the grouping of cells is performed differently for even and odd frames such that, in one type of frame, locations of two or three cells grouped into each group are shifted by one cell, in the direction crossing the electrode pairs, from the locations of cells grouped together in the other type of frame.

A method (2) of driving a plasma display panel, set forth in the method (1), wherein each of the frames is divided into a plurality of sub-frames; and in a case in which each cell group includes two cells, said two cells of each cell group are both turned on at least in part of a display period in one sub-frame, while in a case in which each cell group includes three cells, two adjacent cells of three cells in each group are both turned on at least in part of the display period in one sub-frame.

A method (3) of driving a plasma display panel, set forth in the method (1), wherein the plurality of electrode pairs includes scanning electrode pairs for selecting one or more cells and display electrode pairs for, in conjunction with the scanning electrodes, turning on the selected one or more cells; and in one of the odd and even frames, the cell selection is performed such that two cells adjacent to each scanning electrode pair are grouped together and cells are selected or unselected in units of groups.

A method (4) of driving a plasma display panel, set forth in the method (3), wherein in the other one of the odd frame and even frames, one of two cells adjacent to each scanning electrode pair is selected or unselected, and the state of the selected cell is transferred into a cell which is adjacent, via one of the display electrodes, to said selected cell.

A method (5) of driving a plasma display panel including line-shaped discharge gaps each having a plurality of cells; and line-shaped non-discharge gaps having no discharge cell, the discharge gaps and the non-discharge gaps being disposed alternately, each non-discharge gap being formed between one of electrode pairs each including two electrodes electrically connected to each other, the plurality of electrode pairs including scanning electrode pairs for selecting one or more cells and display electrode pairs for, in conjunction with the scanning electrodes, turning on the selected one or more cells, the scanning electrode pairs and the display electrode pairs being disposed alternately, the method comprising the step of driving the plasma display panel so as to display an image by using an address period during which one or more cells are selected and a display period during which discharges are simultaneously generated in the selected one or more cells, the method further comprising the step of:

when applying in the address period a scanning pulse to a scanning electrode pair, applying a selection bias voltage to one of two display electrode pairs adjacent to the scanning electrode pair and applying a non-selection bias voltage to the other one of the two display electrode pairs, whereby one of two cells adjacent to the scanning electrode pair is lit or unlit.

A method (6) of driving a plasma display panel, set forth in the method (5), wherein a transfer period is provided immediately prior to or in the middle of the display period;

and wherein the method further comprises the step of, in the transfer period, transferring the discharge in the cell lit in the address period into a cell which is adjacent, in a direction crossing the electrode pairs, to the lit cell, wherein the transferring of the discharge is triggered by the discharge in the cell lit in the address period.

A method (7) of driving a plasma display panel, set forth in the method (6), wherein, in the transfer period, a voltage lower than a discharge starting voltage and higher than a discharge sustaining voltage is applied between the display electrode pair to which the selection bias voltage is applied and two scanning electrode pairs adjacent to that display electrode pair, whereby the discharge in the cell lit in the address period is transferred into a cell which is adjacent, via the display electrode to which the selection bias was applied, to said cell lint in the address period, wherein the transferring of the discharge is triggered by the discharge in the cell lit in the address period.

A method (8) of driving a plasma display panel, set forth in the method (5), wherein, in the address period, display lines corresponding to the discharge gaps are sequentially scanned to select desired one or more cells in such a manner that display lines of one of two display line groups are first sequentially scanned and then display lines of the other one of two groups are sequentially scanned, one group consisting of odd display lines, the other group consisting of even display lines.

A method (9) of driving a plasma display panel, set forth in the method (7), wherein the transfer of the discharge includes:

a step of simultaneously transferring discharges in cells of one of display line groups one of which consists of odd display lines and the other one of which consists of even display lines; and a step of simultaneously transferring discharges in cells of the other display line group.

A method (10) of driving a plasma display panel, set forth in the method (5), wherein the selection bias voltage is applied to one of electrode pair groups one of which consists of odd display electrode pairs and the other one of which consists of even display electrode pairs, and the non-selection bias voltage is applied to the other electrode pair group.

A method (11) of driving a plasma display panel including a plurality of electrodes formed on a substrate so as to extend in one direction; and discharge gaps for generating a discharge and non-discharge gaps in which no discharge occurs, each of the discharge gaps and the non-discharge gaps being formed between adjacent electrodes of the plurality of electrodes, the discharge gaps and the non-discharge gaps being disposed alternately, electrodes of each electrode pair, between which there is one of the non-discharge gap, being electrically connected to each other, each of the discharge gaps being partitioned into a plurality of cells, the method comprising the step of:

when one of two cells adjacent to one electrode pair on the plasma display panel has been preliminarily set into an on-state, applying a voltage lower than a discharge starting voltage and higher than a discharge sustaining voltage between the transfer electrode pair and two electrode pairs adjacent to the transfer electrode pair so that the discharge in the one cell preliminarily set in the on-state functions as a trigger of transfer of the discharge thereby transferring the discharge in the cell preliminarily set in the on-state into a cell which is adjacent via the transfer electrode pair to the cell preliminarily set in the on-state.

A method (12) of driving a plasma display panel, set forth in the method (11), wherein the plasma display panel includes a plurality of address electrodes crossing the electrode pairs, and wherein when a pulse for transferring the discharge is applied to the transfer electrode pair, a pulse is applied to a corresponding address electrode to generate a plane-to-plane discharge between the transfer electrode pair and the corresponding address electrode thereby reinforcing the discharge serving as the trigger.

A method (13) of driving a plasma display panel, set forth in the method (12), wherein the pulse applied to the address electrode rises at a time prior to the pulse for performing the transfer.

A plasma display apparatus (14) comprising:

a plasma display panel including:

a plurality of electrodes formed on a substrate so as to extend in one direction;

discharge gaps for generating a discharge, each discharge gap being formed between adjacent electrodes of the plurality of electrodes;

non-discharge gaps in which no discharge occurs, each non-discharge gap being formed between adjacent electrodes of the plurality of electrodes;

couplers electrically coupling electrodes of each electrode pair between which one of the non-discharge gaps is formed; and barrier ribs partitioning each discharge gap into a plurality of cells, the discharge gaps and the non-discharge gaps being disposed alternately; and a driver circuit for driving the plasma display panel to display an image by using two types of frames including an odd frame and an even frame in such a manner that cells are grouped such that two or three cells adjacent to one another in a direction crossing the electrode pairs are grouped together, and lighting states of cells are controlled in units of cell groups, wherein the grouping of cells is performed differently for even and odd frames such that, in one type of frame, locations of two or three cells grouped into each group are shifted by one cell, in the direction crossing the electrode pairs, from the locations of cells grouped together in the other type of frame.

A plasma display apparatus (15) comprising:

a plasma display panel including:

line-shaped discharge gaps including a plurality of cells;

non-discharge gaps including no discharge cell;

barrier ribs partitioning the plurality of cells; and a plurality of electrode pairs, one of the non-discharge gaps being disposed between two electrodes of each electrode pair, two electrode of each electrode pair being electrically connected to each other, the plurality of electrode pairs including scanning electrode pairs and display electrode pairs, the scanning electrode pairs and the display electrode pairs being disposed alternately, a driver circuit for driving the plasma display panel so as to display an image using an address period during which one or more cells are selected and a display period during which discharges are simultaneously generated in the selected one or more cells, in such a manner that in the address period, when a scanning pulse is applied to a scanning electrode pair, a selection bias voltage is applied to one of two display electrode pairs adjacent to the scanning electrode pair and a non-selection bias voltage is applied to the other one of the two display electrode pairs, whereby one of two cells adjacent to the scanning electrode pair is lit or unlit.

A plasma display apparatus (16) comprising a plasma display panel and a driver circuit, the plasma display panel including:

a plurality of electrodes formed on a substrate so as to extend in one direction;

discharge gaps for generating a discharge, each discharge gap being formed between adjacent electrodes of the plurality of electrodes; and non-discharge gaps in which no discharge occurs, each non-discharge gap being formed between adjacent electrodes of the plurality of electrodes;

the discharge gaps and the non-discharge gaps being disposed alternately, electrodes of each electrode pair, between which one of the non-discharge gaps is formed, being electrically connected to each other, the plasma display panel further including barrier ribs partitioning each of the discharge gaps into a plurality of cells, the driver circuit serving to drive the plasma display panel in such a manner that when one of two cells adjacent to one electrode pair on the plasma display panel has been preliminarily set into an on-state, an electrode pair which is adjacent via said one of two cells to said one electrode pair is selected as a transfer electrode pair; and a voltage lower than a discharge starting voltage and higher than a discharge sustaining voltage is applied between the transfer electrode pair and two electrode pairs adjacent to the transfer electrode pair so that the discharge in the one cell preliminarily set in the on-state functions as a trigger of transfer of the discharge thereby transferring the discharge in the cell preliminarily set in the on-state into a cell which is adjacent via the transfer electrode pair to the cell preliminarily set in the on-state.

A method (17) of driving a plasma display panel by using two types of frames including odd frame and an even frame, each odd frame and each odd frame including a plurality of sub-frames, the plasma display panel including discharge gaps and non-discharge gaps disposed alternately, each non-discharge gap being disposed between a pair of electrodes electrically connected to each other, each discharge gap being partitioned into a plurality of cells so as to form one display line, the method comprising the steps of:

dividing each of the sub-frames into an address period and a display period and dividing the display period into a first display period and a second display period; and lighting one or more cells in such a manner that during the first display period, in one of the even and odd frames, only one or more cells in even display lines are lit without lighting any cell in odd display lines, while in the other one of the even and odd frames, only one or more cells in odd display lines are lit without lighting any cell in the even display lines, while during the second display period, not only the one or more cells lit in the first display period are lit, but also one of two cells, which are adjacent in a direction crossing the electrode pairs to each cell lit in the first display period, is simultaneously lit.

A method (18) of driving a plasma display panel set forth in the method (17), wherein a transfer period during which a discharge is transferred is provided between the first display period and the second display period, and in the transfer period, a discharge in each cell lit in the first display period is transferred into one of two cells which are adjacent, in a direction crossing the electrode pairs, to the cell lit in the first display period, wherein the discharge in each cell lit in the first display period functions as a trigger which causes the transfer to start.

A method (19) of driving a plasma display panel set forth in the method (17), wherein the ratio between the first display period and the second display period in each sub-frame is set to be substantially constant.

A method (20) of driving a plasma display panel set forth in the method (17), wherein, in the second display period, two cells adjacent to each cell lit in the first display period are alternately selected as the cell which is simultaneously lit together with the cell which was lit in the first display period, the selection of the one of two cells being performed in order of luminance weight in respective sub-frames of each frame.

A method (21) of driving a plasma display panel set form in the methods (1), (11) or (17), wherein, in a display period during which a discharge is simultaneously generated in a plurality of preselected cells on the plasma display panel having the electrode pairs, alternating pulses are applied to electrode pairs such that the phase differs by 180 degrees between any two electrode pairs which are adjacent via one electrode pair to each other and by 90 degrees between any two electrode pairs which are directly adjacent to each other.

A method (22) of driving a plasma display panel by using two types of frames including an even frame and an odd frame, the plasma display panel on which a plurality of display lines each including a plurality of cells are formed, the method comprising the step of:

driving the plasma display panel such that each dot of display data is displayed by a combination of on-states of three cells including a cell directly corresponding to said dot and two cells adjacent to said cell directly corresponding to said dot.

A method (23) of driving a plasma display panel set forth in the method (22), wherein the luminance levels of the three cells are set so that the center cell is at a high level and the two cells adjacent to the center cell are at a level lower than the high level.

A method (24) of driving a plasma display panel set forth in the method (22), wherein each of the frames is divided into a plurality of sub-frames, and two adjacent cells of each cell of three cells are both turned on at least in part of a display period in one sub-frame.

A method (25) of driving a plasma display panel set forth in the method (22), wherein each of the frames is divided into a plurality of sub-frames, and two cells adjacent to the center cell are turned on such that one of the two cells is turned on in one sub-frame and the other one of the two cells is turned on in a different sub-frame.

A method (26) of driving a plasma display panel set forth in the method (24), wherein the display period of each of the sub-frames is divided into a first display period and a second display period, one cell is turned on in the first display period, and said one cell and one of two cells, which are adjacent to said one cell and one of which is located in a display line at a side of said one cell and the other one of which is located in a display line at the opposite side of said one cell, are turned on in the second display period.

A plasma display apparatus (27) comprising:

a plasma display panel including:

discharge gaps and non-discharge gaps, which are formed alternately, each non-discharge gap being formed between electrodes which are electrically connected to each other, and barrier ribs partitioning each of the discharge gaps into a plurality of cells; and a driver circuit for dividing the plasma display panel in such a manner that:

a display period of each sub-frame in a frame is divided into a first display period and a second display period;

during the first display period, one or more cells in one of two groups are lit in even frames, while one or more cells in the other group are lit odd frames, one of the two group consisting of cells in even lines, the other group consisting of cells in odd lines; and during the second display period, not only the one or more cells lit in the first display period are lit, but also a cell which is adjacent, at an upper or lower side, to each cell lit in the first display period is simultaneously lit.

A plasma display apparatus (28) set forth in the plasma display apparatus (14), (15), (16), or (27), wherein the gap distance of the non-discharge gaps of the plasma display panel is greater than that of the discharge gaps.

A plasma display apparatus (29) set forth in the plasma display apparatus (14), (15), (16), or (27), wherein the couplers of the plasma display panel are provided outside a display area of the plasma display panel.

A plasma display apparatus (30) set forth in the plasma display apparatus (14), (15), (16), or (27), wherein the couplers of the plasma display panel are formed so as to overlap with the barrier ribs in plan view.

A plasma display apparatus (31) set forth in the plasma display apparatus (14), (15), (16), or (27), wherein the barrier ribs of the plasma display panel are formed such that their width is greater in the non-discharge gaps than in the discharge gaps.

A plasma display apparatus (32) set forth in the plasma display apparatus (14), (15), (16), or (27), wherein the plasma display panel further includes a light-shielding member covering each of the non-discharge gaps.

A plasma display apparatus (33) set forth in the plasma display apparatus (14), (15), (16), or (27), wherein the couplers of the plasma display panel are provided at both ends of the electrode pairs.

A method (34) of driving a plasma display panel so as to display an image by using two types of frames including an odd frame and an even frame, the plasma display panel including a plurality of first electrodes arranged in one direction on a base plate; a plurality of second electrodes arranged between the plurality of first electrodes; and a plurality of cells formed by partitioning each gap between adjacent electrodes so that a surface discharge can be generated in each cell, the plasma display panel being capable of simultaneously generating sustaining discharges in cells which are adjacent via one of the electrodes, the plasma display panel including a path for coupling the discharges in said adjacent cells, the method comprising:

grouping cells such that two or three cells which are adjacent to one another in a direction crossing the electrodes are grouped together; and controlling lighting states of cells in units of cell groups, wherein the grouping of cells is performed differently for even and odd frames such that, in one type of frame, locations of two or three cells grouped into each group are shifted by one cell, in the direction crossing the electrodes, from the locations of cells grouped together in the other type of frame.

A plasma display apparatus (35) comprising a plasma display panel and a driver circuit, the plasma display panel including:

a plurality of first electrodes formed on a substrate so as to extend in one direction;

a plurality of second electrodes each of which is disposed between two adjacent electrodes of the plurality of first electrodes; and barrier ribs for partitioning each gap between adjacent electrodes such that a surface discharge can be generated in each region partitioned by barrier ribs, the plasma display panel being capable of simultaneously generating sustaining discharges in cells which are adjacent via one of the electrodes, the plasma display panel including a path for coupling the discharges in said adjacent cells, a drive circuit serving to drive the plasma display panel so as to display an image by using two types of frames including an odd frame and an even frame in such a manner that cells are grouped such that two or three cells adjacent to one another in a direction crossing the electrodes are grouped together, and lighting states of cells is controlled in units of cell groups, wherein the grouping of cells is performed differently for even and odd frames such that, in one type of frame, locations of two or three cells grouped into each group are shifted by one cell, in the direction crossing the electrodes, from the locations of cells grouped together in the other type of frame.

A plasma display apparatus (36) set forth in the plasma display apparatus (35), wherein each electrode of the plasma display panel includes a bus electrode extending in said one direction and a plurality of first transparent electrodes extending in a direction crossing the bus electrode, and the bus electrode and the first transparent electrodes are electrically connected with each other at intersections thereof.

A plasma display apparatus (37) set forth in the plasma display apparatus (36), wherein both ends of each of the first transparent electrodes are connected to two second transparent electrodes in the form of strips, respectively, extending in a direction parallel to the bus electrodes.

A plasma display apparatus (38) set forth in the plasma display apparatus (36), wherein each bus electrode is formed so as to extend along a center line extending in the longitudinal direction of the corresponding electrode.

A plasma display apparatus (39) set forth in the plasma display apparatus (35), wherein each electrode of the plasma display panel include a first bus electrode extending in said one direction, a second bus electrode extending in a direction crossing the first bus electrode, and a third transparent electrode which is spaced from the first but electrode and extends in parallel to the first bus electrode and which is electrically connected to the second bus electrode.

A plasma display apparatus (40) set forth in the plasma display apparatus (35), wherein each barrier rib of the plasma display panel includes a first barrier rib in the form of a strip extending in a direction crossing said one direction and a second barrier rib protruding from the first barrier rib in a direction parallel to said one direction.

A plasma display apparatus (41) set forth in the plasma display apparatus (36) or (39), wherein each barrier rib of the plasma display panel includes a first barrier rib in the form of a strip extending in a direction crossing said one direction and a second barrier rib protruding from the first barrier rib in a direction parallel to said one direction, the second barrier rib being formed so as to overlap with a bus electrode as set forth in the plasma display apparatus (36) or a first bus electrode set forth in the plasma display apparatus (39).

A plasma display panel (42) set forth in the plasma display apparatus (39), wherein the barrier ribs of the plasma display panel include first barrier ribs in the form of strips arranged in the direction crossing said one direction and second barrier ribs arranged to protrude from the first barrier ribs in a direction parallel to said one direction, and the second bus electrodes are arranged at positions overlapping the first barrier ribs.

A plasma display apparatus (43) set forth in the plasma display apparatus (35), wherein each barrier rib of the plasma display panel includes a first barrier rib in the form of a strip extending in a direction crossing said one direction and a third barrier rib extending in a direction parallel to said one direction, the first barrier rib and the third barrier rib being connected to each other at an intersection thereof, the third barrier rib including a gap between the third barrier rib and an adjacent first barrier rib.

A plasma display apparatus (44) set forth in the plasma display apparatus (35), wherein each barrier rib of the plasma display panel includes a first barrier rib in the form of a strip extending in a direction crossing said one direction and a third barrier rib extending in a direction parallel to said one direction, the first barrier rib and the third barrier rib being connected to each other at an intersection thereof, the third barrier rib including a notch between the third barrier rib and an adjacent first barrier rib.

A plasma display apparatus (45) set forth in the plasma display apparatus (35), wherein each barrier rib of the plasma display panel includes a first barrier rib in the form of a strip extending in a direction crossing said one direction and a third barrier rib extending in a direction parallel to said one direction, the first barrier rib and the third barrier rib being connected to each other at an intersection thereof, the third barrier rib being formed such that its portion adjacent to a first barrier rib has a height smaller than the height of that first barrier rib.

A plasma display apparatus (46) set forth in the plasma display apparatus (35), wherein each electrode of the plasma display panel includes a stripe-shaped transparent electrode and a bus electrode formed along the center line of the transparent electrode; and each barrier rib includes a first barrier rib in the form of a stripe extending in a direction crossing said one direction and also includes a third barrier rib in the form of a stripe extending in a direction parallel to said one direction, the third barrier rib including a gap or notch between the third barrier rib and an adjacent first barrier rib, the bus electrode and the third barrier rib being formed so as to overlap with each other.

A plasma display apparatus (47) set forth in the plasma display apparatus (35), wherein each of the first electrodes and each of the second electrodes of the plasma display panel are constructed into the form of a pair of electrodes which are spaced by a small distance from each other and which extend in parallel to each other and which are electrically connected to each other, and wherein a gap between two electrodes is a non-discharge gap in which no discharge occurs.

What is claimed is:

1. A method of driving a plasma display panel, the plasma display panel including: a plurality of electrodes formed on a base plate so as to extend in one direction;

discharge gaps for generating discharges, each discharge gap being formed between two adjacent the electrodes; non-discharge gaps in which no discharge occurs, each non-discharge gap being formed between adjacent the electrodes, wherein the discharge gaps and the non-discharge gaps are disposed alternately, the electrodes of each electrode pair, between which one of the non-discharge gaps is formed, being electrically connected to each other and each discharge gap being partitioned into a plurality of discharge cells, the method of driving the plasma display panel comprising:

driving each of first groups of cells together in first sets of repetitive frames, each said first group comprising a plurality of cells adjacent to one another in a direction crossing the electrode pairs; and driving each of second groups of cells together in second sets of repetitive frames, each said second group comprising at least one cell of a selected one of said first groups and at least one of another of said first groups adjacent to said selected one.

2. A method of driving a plasma display panel, the plasma display panel including a plurality of electrodes formed on a base plate so as to extend in one direction;

discharge gaps for generating discharges, each discharge gap being formed between two adjacent electrodes; and non-discharge gaps in which no discharge occurs, each non-discharge gap being formed between adjacent electrodes, the discharge gaps and the non-discharge gaps being disposed alternately, two electrodes of each electrode pair between which one of the non-discharge gaps is formed being electrically connected to each other, each discharge gap being partitioned into a plurality of discharge cells, the method of driving the plasma display panel comprising the step of displaying an image by using two types of frames including an odd frame and an even frame, the method further comprising:

grouping cells such that two or three cells which are adjacent to one another in a direction crossing the electrode pairs are grouped together; and controlling lighting states of cells in units of cell groups, wherein the grouping of cells is performed differently for even and odd frames such that, in one type of frame, locations of two or three cells grouped into each group are shifted by one cell, in the direction crossing the electrode pairs, from the locations of cells grouped together in the other type of frame.

3. A method of driving a plasma display panel according to claim 1, wherein:

each frame is divided into a plurality of sub-frames; and in a case in which grouping of cells is performed such that each cell group includes two cells, said two cells of each cell group are both turned on at least in part of a display period in one sub-frame, while in a case in which grouping of cells is performed such that each cell group includes three cells, two adjacent cells of three cells in each group are both turned on at least in part of the display period in one sub-frame.

4. A method of driving a plasma display panel, the plasma display panel including: line-shaped discharge gaps including a plurality of discharge cells; and line-shaped non-discharge gaps including no discharge cell, the discharge gaps and the non-discharge gaps being disposed alternately, each non-discharge gap being formed between one of a plurality of electrode pairs, electrodes of each electrode pair being electrically connected to each other, the plurality of electrode pairs including scanning electrode pairs for selecting cells to be lit and dispiay electrode pairs for, in conjunction with the scanning electrodes, turning on the selected cells, the scanning electrode pairs and the display electrode pairs being disposed alternately, the method of driving the plasma display panel comprising the steps of selecting cells during an address period and simultaneously discharging the selected cells during a display period thereby displaying an image, wherein:

when, in the address period, a scanning pulse is applied to a scanning electrode pair, a selection bias voltage is applied to one of two display electrode pairs adjacent to the scanning electrode pair, and a non-selection bias voltage is applied to the other one of the display electrode pairs, thereby bringing one of two cells adjacent to the scanning electrode pair into a lit or an unlit state.

5. A method of driving a plasma display panel including a plurality of electrodes formed on a base plate so as to extend in one direction; discharge gaps for generating discharges, each discharge gap being formed between two adjacent electrodes; and non-discharge gaps in which no discharge occurs, each non-discharge gap being formed between adjacent electrodes, the discharge gaps and the non-discharge gaps being arranged alternately, electrodes of each electrode pair between which one of the non-discharge gaps is formed being electrically connected to each other, each of the discharge gaps being partitioned into a plurality of discharge cells, the method comprising:

when one of two cells adjacent to one electrode pair on the plasma display panel has been preliminarily set into an on-state, selecting, as a transfer electrode pair, an electrode pair which is adjacent, via said one of two cells, to said one electrode pair; and applying a voltage lower than a discharge starting voltage and higher than a discharge sustaining voltage between the transfer electrode pair and two electrode pairs adjacent to the transfer electrode pair so that the discharge in the one cell preliminarily set in the on-state functions as a trigger of transfer of the discharge thereby transferring the discharge in the cell preliminarily set in the on-state into a cell which is adjacent via the transfer electrode pair to the cell preliminarily set in the on-state.

6. A method of driving a plasma display panel according to claim 5, wherein:

the plasma display panel includes a plurality of address electrodes crossing the electrode pairs, and when a pulse for transferring the discharge is applied to the transfer electrode pair, a pulse is applied to a corresponding address electrode to generate an opposed discharge between the transfer electrode pair and the corresponding address electrode thereby reinforcing the discharge serving as the trigger.

7. A plasma display apparatus, comprising:

a plasma display panel including:

a plurality of electrodes formed on a base plate so as to extend in one direction;

discharge gaps for generating discharges, each of the discharge gaps being formed between adjacent electrodes of the plurality of electrodes; and non-discharge gaps in which no discharge occurs, each of the discharge gaps being formed between adjacent electrodes of the plurality of electrodes;

the discharge gaps and the non-discharge gaps being arranged alternately, two electrodes of each electrode pair between which one of the non-discharge gaps is formed being electrically connected to each other, each of the discharge gaps being partitioned into a plurality of discharge cells, and a driver circuit for driving the plasma display panel to display an image by using two types of frames including an odd frame and an even frame whereby cells are grouped such that two or three cells adjacent to one another in a direction crossing the electrode pairs are grouped together, and lighting states of cells are controlled in units of cell groups, wherein the grouping of cells is performed differently for even and odd frames such that, in one type of frame, locations of two or three cells grouped into each group are shifted by one cell, in the direction crossing the electrode pairs, from the locations of cells grouped together in the other type of frame.

8. A method of driving a plasma display panel, the plasma display panel including discharge gaps and non-discharge gaps formed alternately, each non-discharge gap being formed between electrodes which are electrically connected to each other, each discharge gap being partitioned into a plurality of cells so as to form one display line, the method of driving the plasma display panel comprising the step of displaying an image by using two types of frames including an odd frame and an even frame, each frame including a plurality of sub-frames, the method further comprising:

dividing the display period into a first display period and a second display period in each sub-frame; and lighting one or more cells in such a manner that during the first display period, in one of the even and odd frames, only one or more cells in even display lines are lit without lighting any cell in odd display lines, while in the other one of the even and odd frames, cell to be lit in odd display lines are lit without lighting any cell in the even display lines, while during the second display period, not only cells to be lit in the first display period are lit, but also one of two cells, which are adjacent in a direction crossing the electrode pairs to each cell lit in the first display period, is simultaneously lit.

9. A method of driving a plasma display panel according to claim 8, wherein:

a transfer period during which a discharge is transferred is provided between the first display period and the second display period, and in the transfer period, a discharge in each cell lit in the first display period is transferred into one of two cells which are adjacent, in a direction crossing the electrode pairs, to the cell lit in the first display period, wherein the discharge in each cell lit in the first display period functions as a trigger which causes the transfer to start.

10. A method of driving a plasma display panel according to claim 8, wherein in the second display period, two cells adjacent to each cell lit in the first display period are alternately selected as the cell which is simultaneously lit together with the cell which was lit in the first display period, the selection of the one of two cells being performed in order of luminance weight in respective sub-frames of each frame.

11. A plasma display apparatus comprising:

a plasma display panel comprising:

a plurality of electrodes formed on a base plate so as to extend in one direction; and discharge gaps for generating discharges, each discharge gap being formed between two adjacent electrodes of the plurality of electrodes; and non-discharge gaps in which no discharge occurs, each non-discharge gap being formed between adjacent electrodes of the plurality of electrodes, the discharge gaps and the non-discharge gaps being disposed alternately, electrodes of each electrode pair between which one of the non-discharge gaps is formed being electrically connected to each other, the plasma display panel further comprising barrier ribs for partitioning each of the discharge gaps into a plurality of discharge cells; and a driver circuit for driving the plasma display panel in such a manner that when one of two cells adjacent to one electrode pair on the plasma display panel has been preliminarily set into an on-state, an electrode pair which is adjacent via said one of two cells to said one electrode pair is selected as a transfer electrode pair, and a voltage lower than a discharge starting voltage and higher than a discharge sustaining voltage is applied between the transfer electrode pair and two electrode pairs adjacent to the transfer electrode pair so that the discharge in the one cell preliminarily set in the on-state functions as a trigger of transfer of the discharge thereby transferring the discharge in the cell preliminarily set in the on-state into a cell which is adjacent via the transfer electrode pair to the cell preliminarily set in the on-state.

12. A method of driving a plasma display panel according to claims 1, 5, or 8, wherein, in a display period during which a discharge is simultaneously generated in a plurality of preselected cells on the plasma display panel having the electrode pairs, alternating pulses are applied to electrode pairs such that the phase differs by 180 degrees between any two electrode pairs which are adjacent via one electrode pair to each other and by 90 degrees between any two electrode pairs which are directly adjacent to each other.

13. A method of driving a plasma display panel by using two types of frames including an even frame and an odd frame, the plasma display panel on which a plurality of display lines each including a plurality of cells are formed, the method comprising:

driving the plasma display panel such that each dot of display data is displayed by a combination of on-states of three cells including a cell directly corresponding to said dot.

14. A method of driving a plasma display panel so as to display an image by using two types of frames including an odd frame and an even frame, the plasma display panel including a plurality of first electrodes formed on a substrate so as to extend in one direction, a plurality of second electrodes each of which is disposed between two adjacent electrodes of the plurality of first electrodes, and a plurality of cells formed by partitioning each gap between adjacent electrodes so that a surface discharge can be generated in each cell, the plasma display panel being capable of simultaneously generating sustaining discharges in cells which are adjacent via one of the electrodes, the plasma display panel including a path for coupling the discharges in said adjacent cells, the method comprising:

grouping cells such that two or three cells which are adjacent to one another in a direction crossing the electrodes are grouped together; and controlling lighting states of cells in units of cell groups, wherein the grouping of cells is performed differently for even and odd frames such that, in one type of frame, locations of two or three cells grouped into each group are shifted by one cell, in the direction crossing the electrodes, from the locations of cells grouped together in the other type of frame.

15. A plasma display apparatus comprising:

a display panel comprising:

a plurality of first electrodes formed on a substrate so as to extend in one direction;

a plurality of second electrodes each of which is disposed between two adjacent electrodes of the plurality of first electrodes; and barrier ribs partitioning each gap between adjacent electrodes such that a surface discharge can be generated in each region partitioned by barrier ribs, each of surface discharges being enclosed by barrier ribs such that surface discharges between adjacent gaps can be coupled with each other through one or more paths formed in the barrier ribs; and a driver circuit for driving the plasma display panel to display an image by using two types of frames including an odd frame and an even frame in such a manner that cells are grouped such that two or three cells adjacent to one another in a direction crossing the electrodes are grouped together, and lighting states of cells is controlled in units of cell groups, wherein the grouping of cells is performed differently for even and odd frames such that, in one type of frame, locations of two or three cells grouped into each group are shifted by one cell, in the direction crossing the electrodes, from the locations of cells grouped together in the other type of frame.

16. A plasma display apparatus comprising:

a plasma display panel comprising:

discharge gaps and non-discharge gaps formed alternately, each non-discharge gap being formed between electrodes which are electrically connected to each other; and barrier ribs for partitioning each of the discharge gaps into a plurality of discharge cells; and a driver circuit driving the plasma display panel in such a manner that:

a display period of each sub-frame in a frame is divided into a first display period and a second display period;

during the first display period, cells to be lit in one of two groups are lit in even frames, while one or more cells in the other group are lit odd frames, one of the two group consisting of cells in even lines, the other group consisting of cells in odd lines; and during the second display period, not only cells to be lit in the first display period are lit, but also a cell which is adjacent, at an upper or lower side, to each cell lit in the first display period is simultaneously lit.

17. A method of driving an AC type plasma display panel having a screen, a plurality of display electrodes and address electrodes being arranged in the screen, the display electrode for defining lines in a matrix display and composing a pair of display electrodes for display discharge, the address electrode for defining column in the matrix display, the method comprising:

performing a partial addressing, the partial addressing being an operation for one of two cells, the two cells composing a group and adjoining each other in the direction of the column, the operation for increasing an amount of wall charge in a cell to be lit of the group more than an amount of wall charge in the other cell by causing a discharge between the display and address electrodes in the cell to be lit or the other cell, wherein the matrix display being composed of a plurality of the groups;

preparing a transfer for forming a uniform distribution of the wall discharge close to the pair of display electrodes by causing a discharge between the display electrodes in the cell to be lit of address cells, the address cells being addressed by partially addressing;

performing a transfer for increasing an amount of wall charge in each of cells to be lit in the screen more than an amount of wall charge in each of cells to be unlit by causing a discharge between display electrodes in each of the cells in the group including the address cells; and maintaining a lighting by causing display discharges at times according to a required brightness in each of the cells to be lit in the screen.

18. A method of driving an AC type plasma display panel having a screen, a plurality of display electrodes and address electrodes being arranged in the screen, display electrodes defining lines in a matrix display and comprising a pair of display electrodes for display discharge, the address electrodes defining columns in the matrix display, the method comprising:

addressing for increasing an amount of wall charge in each of cells to be lit in the screen more than an amount of wall charge in other cells by a simultaneous scanning with two electrodes and by a potential controlling according to a display data to the address electrode, wherein the display electrodes comprises first-group electrodes and second-group electrodes, the first-group and second-group electrodes being disposed so that each positional relation in the direction of a column between the first-group and second-group electrodes in two cells adjoining in the direction of a column is reversely related to each other, the simultaneous scanning is an operation for temporally biasing each pair of second-group electrodes, at least one electrode of the first-group electrodes being disposed between the pair of second -group electrodes; and maintaining lighting by causing display discharges at times according to a required brightness in each of the cells to be lit in the screen.

19. A display apparatus comprising:

an AC type plasma display panel comprising:

the screen including a plurality of display electrodes and address electrodes, the display electrode for defining lines in a matrix display and composing a pair of display electrodes for display discharge, the address electrode for defining column in the matrix display; and a plurality of cells comprising the screen, two cells adjoining in the direction of a column being grouped as a group; and a driving circuit driving the AC type plasma display panel so as to display the matrix display, the matrix display including a plurality of group, the group comprising two cells as a light emitting unit, wherein the driving circuit performs a partial addressing, the partial addressing being an operation for one of two cells, the two cells comprising a group and adjoining each other in the direction of the column, the operation for increasing an amount of wall charge in a cell to be lit of the group more than an amount of wall charge in the other cell by causing a discharge between the display and address electrodes in the cell to be lit or the other cell, wherein the matrix display comprises a plurality of the groups; preparing a transfer for forming a uniform distribution of the wall discharge close to the pair of display electrodes by causing a discharge between the display electrodes in the cell to be lit of address cells, the address cells being addressed by partially addressing; performing a transfer for increasing an amount of wall charge in each of cells to be lit in the screen more than an amount of wall charge in each of cells to be unlit by causing a discharge between display electrodes in each of the cells being in the group including the address cells; and maintaining a lighting by causing display discharges at times according to a required brightness in each of the cells to be lit in the screen.

* * * * *